US007590361B2

(12) United States Patent
Chizawa et al.

(10) Patent No.: US 7,590,361 B2
(45) Date of Patent: Sep. 15, 2009

(54) IMAGE FORMING APPARATUS AND CONTROL METHOD THEREFOR

(75) Inventors: Noriyoshi Chizawa, Moriya (JP); Yoshihito Osari, Tokyo (JP); Michio Kawase, Abiko (JP); Masashi Oyumi, Abiko (JP); Shigeo Hata, Toride (JP); Kiyoshi Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 600 days.

(21) Appl. No.: 11/536,631

(22) Filed: Sep. 28, 2006

(65) Prior Publication Data

US 2007/0071460 A1 Mar. 29, 2007

(30) Foreign Application Priority Data

Sep. 29, 2005 (JP) ..... 2005-284413

(51) Int. Cl.
*G03G 15/00* (2006.01)

(52) U.S. Cl. ..... 399/13

(58) Field of Classification Search ..... 399/8, 399/9, 12, 13, 14, 15, 16, 18, 21, 23
See application file for complete search history.

(56) References Cited

U.S. PATENT DOCUMENTS 5,126,789 A * 6/1992 Fukuchi et al. ..... 399/18
5,652,942 A * 7/1997 Iseki et al. ..... 399/21

FOREIGN PATENT DOCUMENTS

JP 02-029063 A 1/1990
JP 11-292335 A 10/1999

* cited by examiner

*Primary Examiner*—Hoan H Tran
(74) *Attorney, Agent, or Firm*—Rossi, Kimms & McDowell, LLP

(57) ABSTRACT

An image forming apparatus includes a position detection circuit which detects the registration error amount between a recording medium conveyance unit and an image forming unit positioned by a positioning mechanism, on the basis of reading of a reference pattern arranged on either unit, and a controller which calculates a correction amount on the basis of the detected registration error amount and controls the operation timings of the image forming unit and recording medium conveyance unit in accordance with the correction amount.

19 Claims, 36 Drawing Sheets

FIG. 17A

1701

| | |
|---|---|
| 1 | UNIT ID |
| 2 | PROCESS SPEED (PS) (1) : X1 mm/sec |
| 3 | COLOR MODE AT PS(1) (C/BW/common) |
| 4 | POWER CONSUMPTION OF UNIT AT PS(1) : ×1(W) |
| 5 | MATERIAL PROCESSIBLE AT PS(1) : A |
| 6 | MATERIAL PROCESSIBLE AT PS(1) : B |
| ... | ... |
| N | PROCESS SPEED (PS) (2) : X2 mm/sec |
| N+1 | COLOR MODE AT PS(2) (C/BW/common) |
| N+2 | POWER CONSUMPTION OF UNIT AT PS(2) : ×2(W) |
| N+3 | MATERIAL PROCESSIBLE AT PS(2) : C |
| ... | ... |
| M | PROCESS SPEED (PS) (3) : X3 mm/sec |
| M+1 | COLOR MODE AT PS(3) (C/BW/common) |
| M+2 | POWER CONSUMPTION OF UNIT AT PS(3) : ×3(W) |
| M+3 | MATERIAL PROCESSIBLE AT PS(3) : E |
| ... | ... |
| L | MINIMUM DISTANCE BETWEEN SHEETS : Ymm |

1702

| | |
|---|---|
| 1 | UNIT ID (POWER UNIT ID) |
| 2 | SUPPLIABLE POWER : TT(W) |
| 3 | POWER SYSTEM DATA (5v, 24v etc) |

1703

| | |
|---|---|
| 1 | CONFIGURATION INFORMATION (4D/1D COLOR OR BW) |
| 2 | ITOP INTERVAL (FOR COLOR PRINTER) |
| 3 | ITOP ≥ SECONDARY TRANSFER DISTANCE (FOR COLOR PRINTER) |

FIG. 17B

1704

| | |
|---|---|
| 1 | PROCESS SPEED (PS) (1) : Z1 mm/sec |
| 2 | COLOR MODE AT PS(1) (C/BW/common) |
| 3 | MATERIAL PROCESSIBLE AT PS(1) : A |
| 4 | MATERIAL PROCESSIBLE AT PS(1) : B |
| 5 | PPM AT PS(1) : XXppm |
| ... | ... |
| N | PROCESS SPEED (PS) (1) : Z2 mm/sec |
| N+1 | COLOR MODE AT PS(2) (C/BW/common) |
| N+2 | MATERIAL PROCESSIBLE AT PS(1) : C |
| N+3 | PPM AT PS(1) : YYppm |
| ... | ... |
| M | PROCESS SPEED (PS) (3) : Z3 mm/sec |
| M+1 | COLOR MODE AT PS(3) (C/BW/common) |
| M+2 | MATERIAL PROCESSIBLE AT PS(1) : D |
| M+3 | PPM AT PS(1) : ZZppm |
| ... | ... |
| L | INCOMPATIBLE MATERIAL 1 : E |
| L+1 | COLOR MODE OF INCOMPATIBLE MATERIAL 1 |
| L+2 | INCOMPATIBLE MATERIAL 2 : F |
| L+3 | COLOR MODE OF INCOMPATIBLE MATERIAL 2 |
| ... | ... |

1705

| | |
|---|---|
| 1 | UNIT ID |
| 2 | POWER CONSUMPTION OF UNIT : TT(W) |
| 3 | USE POWER SYSTEM DATA (5v, 24v etc) |

FIG. 19

1911

| | |
|---|---|
| 1 | COMMAND ID (PAPER FEED REQUEST) |
| 2 | PAGE ID |
| 3 | COLOR MODE |
| 4 | PAPER SIZE |
| 5 | MATERIAL INFORMATION |
| 6 | PRINT SIDE (FIRST SIDE/SECOND SIDE) INFORMATION |

1912

| | |
|---|---|
| 1 | PAPER FEED STAGE INFORMATION |
| 2 | PAPER DISCHARGE DIRECTION (REVERSE/STRAIGHT/DOUBLE-SIDED) |

1913

| | |
|---|---|
| 1 | COMMAND ID (PAPER FEED REQUEST Ack) |
| 2 | PAGE ID |
| 3 | PAPER FEED STAGE INFORMATION |
| 4 | PAPER FEED STATUS (OK or NG) |
| 5 | NG FACTOR |

1914

| | |
|---|---|
| 1 | COMMAND ID (IMAGE FORMATION REQUEST) |
| 2 | PAGE ID |
| 3 | COLOR MODE |

1915

| | |
|---|---|
| 1 | COMMAND ID (IMAGE FORMATION NOTIFICATION) |
| 2 | PAGE ID |

1916

| | |
|---|---|
| 1 | COMMAND ID (PAGE END NOTIFICATION) |
| 2 | END STATUS (OK or NG) |
| 3 | NG FACTOR |

IMAGE FORMING APPARATUS AND CONTROL METHOD THEREFOR

BACKGROUND OF THE INVENTION

1. Field of the Invention

The present invention relates to an image forming apparatus and control method therefor.

2. Description of the Related Art

There is proposed an apparatus which forms an image by an electrophotographic process of irradiating a photosensitive drum serving as an image carrier with a laser beam or light from a light-emitting element (e.g., LED: Light Emitting Diode) that is modulated in accordance with recording information.

For example, there is proposed a color image forming apparatus having a plurality of image forming units which develop electrostatic latent images formed on photosensitive drums and transfer toner images of respective colors onto a transfer sheet or intermediate transfer belt.

A monochrome image forming apparatus is also proposed which develops an electrostatic latent image formed on one photosensitive drum and transfers a black toner image onto a transfer sheet.

For these image forming apparatuses, there is proposed an arrangement example of a copying machine which connects to a document scanning apparatus and sends document image information to an image forming apparatus to copy the document image.

For example, Japanese Patent Laid-Open No. 11-292335 and Japanese Utility Model Laid-Open No. 2-29063 each disclose an example of a combination of a paper feed unit and image forming apparatus. These references propose image forming apparatuses in each of which a plurality of paper feed units serving as the base of the image forming apparatus stack up replaceably and the bottom of the main body of the image forming apparatus has an opening for receiving sheets conveyed from the paper feed units.

An image forming apparatus is also proposed which can connect to a post-processing apparatus called a finisher for sorting transfer sheets printed by the image forming apparatus into respective copies or stapling respective copies. An image forming apparatus of this type and various post-processing apparatuses connectable to the image forming apparatus can operate to perform a series of printing and post-processing operations in cooperation with each other.

Some document scanning apparatuses have various scanning resolutions such as 400 dpi (dots per inch) and 600 dpi. A full-color image forming apparatus generally has a full-color CCD sensor which converts a scanned document image into a full-color image signal. A monochrome image forming apparatus often has a monochrome scanning CCD which converts a scanned document image into a monochrome image signal. Even for a monochrome image forming apparatus, a document scanning apparatus is proposed which has a full-color CCD sensor and converts a document image into a full-color image signal. Recently, a product is proposed which provides a scanner function of transmitting image information scanned by a document scanning apparatus to a desired destination via a network.

As described above, an apparatus arrangement is proposed in which an image forming apparatus cooperates with another apparatus to provide a function unimplementable by the single image forming apparatus.

Various proposals are also made for an apparatus arrangement which permits exchanging part of an image forming apparatus. For example, there is proposed an apparatus form which permits newly assembling a double-sided paper conveyance unit into an image forming apparatus of standard specifications. An image forming apparatus is also proposed in which some units in the apparatus are made detachable so that the functions of the image forming apparatus can change into an apparatus arrangement conforming to product specifications desired by a user.

There is also proposed an image forming apparatus of an arrangement which permits connecting the image forming apparatus to a controller arranged outside the image forming apparatus or assembling a controller into the image forming apparatus.

Conventionally, the user selects, from various image forming apparatuses, an image forming apparatus which implements desired functions, performance, user friendliness, and the like. To obtain a function, performance, or the like which cannot be attained by the selected image forming apparatus, the user selects an apparatus arrangement so as to utilize the desired function, performance, or the like by combining the image forming apparatus with various exchangeable apparatuses, various units, various controllers, and the like.

A conventional image forming apparatus can perform various operations by executing a system operation in cooperation with various apparatuses, various units, various controllers, a host computer, and the like, and provides a user with various conveniences.

In general, a post-processing apparatus such as a finisher is controlled to determine its operation in accordance with the printout operation mode of an image forming apparatus. There is no image forming apparatus which controls the operations of at least two subsystems to execute a series of image output operations and a series of information processing operations for image information almost simultaneously or independently.

A conventional image forming apparatus poses various problems owing to the above arrangement.

Since the conventional image forming apparatus executes a system operation in cooperation with various apparatuses, various units, various controllers, a host computer, and the like, it only operates depending on its operation mode, function, and performance.

For example, when the image forming apparatus connects to a paper feed apparatus or finisher, the apparatus combination may limit their functions and performance associated with apparatus control under restrictions on functions and performance.

For example, the image forming apparatus and finisher exchange communication information, and the finisher determines its operation mode, performance, and functions and operates in accordance with the operation of the image forming apparatus. The arrangement of the image forming unit, paper feed unit, and paper conveyance unit in the image forming apparatus also determines the whole operation performance of the image forming apparatus.

Among various apparatus arrangements, there is no apparatus arrangement which can flexibly meet the user's need in terms of the operation of the entire system such as a print operation or a cooperative operation (e.g., a print operation or scan operation) with a host computer.

That is, when weighting operation specifications in order to cope with customization to apparatus operation specifications desired by a user, apparatus specifications implementable by exchanging a subunit cannot be fully enhanced unless operation specifications can be determined on the basis of association with control information.

It is necessary and important to maintain the image formation quality with a combination of subsystems different in performance in an image forming apparatus made up of a plurality of subsystems.

SUMMARY OF THE INVENTION

The present invention has been made to overcome the conventional drawbacks, and has as its object to provide an image forming technique which implements operation specifications desired by a user by a combination of subsystems.

It is another object of the present invention to provide an image forming technique capable of, even when a registration error occurs between subsystems upon exchanging or detaching a subsystem, correcting the registration error and maintaining the image formation quality.

It is still another object of the present invention to provide an image forming technique capable of, even when exchanging or detaching a subsystem, correcting a delay of the output time of the first recording material or a delay of the output time of recording materials in a continuous operation, thereby preventing a decrease in the throughput of an image forming apparatus.

According to the present invention, the foregoing object is attained by providing An image forming apparatus having a plurality of detachable units, the image forming apparatus permitting mounting image forming units which form an image on a recording medium and are different in performance, and recording medium conveyance units which convey the recording medium and are different in specification, the image forming apparatus comprising:

a detection unit which detects a positional relationship between the mounted image forming unit and the mounted recording medium conveyance unit; and a control unit which controls an operation of the image forming apparatus, wherein said control unit controls operation timings of the image forming unit and the recording medium conveyance unit on the basis of the positional relationship detected by said detection unit.

According to another aspect of the present invention, the foregoing object is attained by providing an image forming apparatus which detachably mounts and supports an exchangeable image forming subsystem having an image carrier, an exposure unit, a charging unit, and a developing unit, and an exchangeable recording medium conveyance subsystem which conveys a recording medium in the image forming apparatus, comprising:

a detection unit which detects a positional relationship between the mounted image forming subsystem and the mounted recording medium conveyance subsystem; and a control unit which controls an operation of the image forming apparatus, wherein the image forming apparatus permits mounting image forming subsystems different in performance and recording medium conveyance subsystems different in specification, and said control unit controls operation timings of the image forming subsystem and the recording medium conveyance subsystem on the basis of the positional relationship detected by said detection unit.

According to another aspect of the present invention, the foregoing object is attained by providing an image forming apparatus which includes, as a plurality of detachable units, at least an image forming unit which forms an image on a recording medium and a recording medium conveyance unit which conveys the recording medium, and executes image formation corresponding to a combination of the units, comprising:

a position detection unit which detects a registration error amount between the recording medium conveyance unit and the image forming unit positioned by a positioning unit, on the basis of reading of a reference pattern arranged on one of the recording medium conveyance unit and the image forming unit; and a control unit which calculates a correction amount on the basis of the registration error amount detected by said position detection unit and controls operation timings of the image forming unit and the recording medium conveyance unit in accordance with the correction amount.

According to another aspect of the present invention, the foregoing object is attained by providing an image forming apparatus which includes, as a plurality of detachable units having different functions, at least an image forming unit which forms an image on a recording medium and a recording medium conveyance unit which conveys the recording medium, and executes image formation corresponding to a combination of the units, comprising:

a calculation unit which calculates a registration error amount between the recording medium conveyance unit and the image forming unit positioned by a positioning unit, on the basis of a result of image formation on the recording medium; and a control unit which calculates a correction amount on the basis of the registration error amount calculated by said calculation unit and controls operation timings of the image forming unit and the recording medium conveyance unit in accordance with the correction amount.

According to another aspect of the present invention, the foregoing object is attained by providing a method of controlling an image forming apparatus which includes, as a plurality of detachable units having different functions, at least an image forming unit which forms an image on a recording medium and a recording medium conveyance unit which conveys the recording medium, and executes image formation corresponding to a combination of the units, comprising the steps of:

detecting a registration error amount between the recording medium conveyance unit and the image forming unit positioned by a positioning unit, on the basis of reading of a reference pattern arranged on one of the recording medium conveyance unit and the image forming unit; and calculating a correction amount on the basis of the registration error amount detected in the step of a detecting registration error amount, and controlling operation timings of the image forming unit and the recording medium conveyance unit in accordance with the correction amount.

According to another aspect of the present invention, the foregoing object is attained by providing a method of controlling an image forming apparatus which includes, as a plurality of detachable units having different functions, at least an image forming unit which forms an image on a recording medium and a recording medium feed conveyance unit which conveys the recording medium, and executes image formation corresponding to a combination of the units, comprising the steps of:

calculating a registration error amount between the recording medium feed conveyance unit and the image forming unit positioned by a positioning unit, on the basis of a result of image formation on the recording medium; and calculating a correction amount on the basis of the registration error amount calculated in the step of calculating a registration error amount, and controlling operation timings of the image forming unit and the recording medium feed conveyance unit in accordance with the correction amount.

The present invention can provide an image forming technique which implements operation specifications desired by a user by a combination of subsystems.

The present invention can provide an image forming technique capable of, even when a registration error occurs between subsystems upon exchanging or detaching a subsystem, correcting the registration error and maintaining the image formation quality.

The present invention can provide an image forming technique capable of, even when exchanging or detaching a subsystem, correcting a delay of the output time of the first recording material or a delay of the output time of recording materials in a continuous operation, thereby preventing a decrease in the throughput of an image forming apparatus.

Further features of the present invention will become apparent from the following description of exemplary embodiments (with reference to the attached drawings).

BRIEF DESCRIPTION OF THE DRAWINGS

FIGS. 17A and 17B are views showing parameters in configuration communication upon power-on;

FIGS. 18A and 18B are ladder charts for explaining a command sequence upon power-on;

FIG. 19 is a view showing parameters in communication between units;

DESCRIPTION OF THE EMBODIMENTS

Preferred embodiments of the present invention will be described in detail below with reference to the accompanying drawings. The following embodiments may not be construed to limit the scope of the present invention. Not all combinations of features described in the embodiments are indispensable for solving the present invention.

First Embodiment

<Overall Arrangement>

Figure 1:
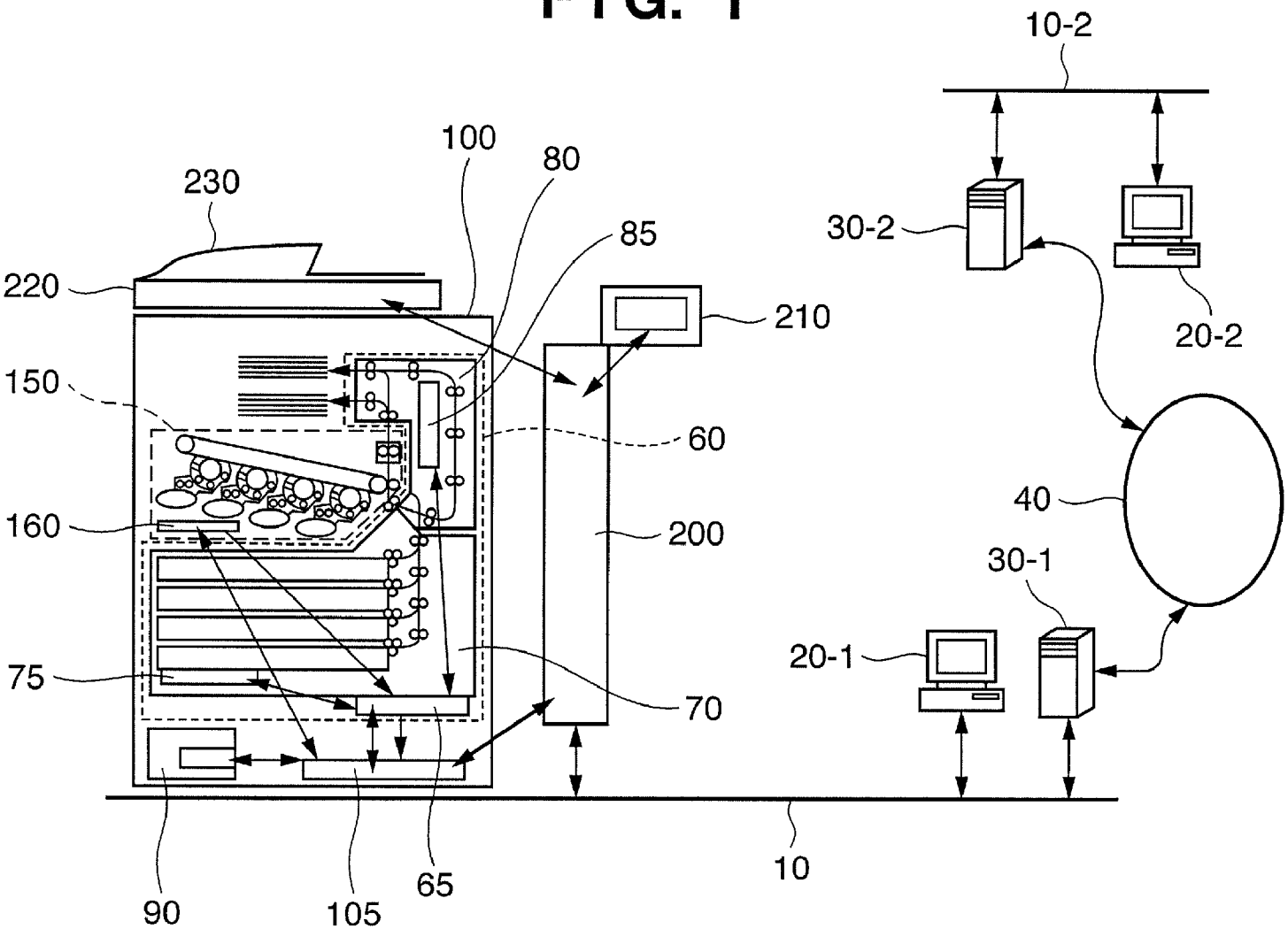
FIG. 1 is a view showing the overall arrangement of an image forming apparatus according to an embodiment of the present invention.

FIG. 1 is a view showing the overall arrangement of an image forming apparatus according to the first embodiment of the present invention.

The first embodiment will exemplify, as the image forming apparatus, a multi-functional peripheral (MFP) which comprises an electrophotographic image forming apparatus 100 and functions as a scanner, a facsimile, a copying machine, and a printer for receiving data from a PC and printing it. The image forming apparatus has a color printing function which adopts a photosensitive body and intermediate transfer method.

The user uses an operation unit 210 to designate a print mode, print count, or print condition, or the serviceman uses the operation unit 210 to make various operation settings in maintenance work. When the user presses a print start key (not shown) on the operation unit 210, a document scanning apparatus 220 and document paper feed apparatus 230 start scanning a document image, and the image forming apparatus starts a desired apparatus operation such as a print operation or document image transmission.

The image forming apparatus 100 or an image forming apparatus 101 or 102 converts a document image into image information and prints it out.

The image forming apparatus 100 incorporates a paper conveyance subsystem (to be referred to as a paper conveyance platform) 60 and an image forming subsystem 150. The paper conveyance platform incorporates a paper feed unit 70 and paper conveyance unit 80. The image forming apparatus 100 also incorporates a power unit 90.

The document paper feed apparatus 230 feeds a set document to the scan position of the document scanning apparatus 220. The document scanning apparatus 220 converts image data of the document fed to the scan position of the document scanning apparatus 220 into image information, and sends the image information to a controller 200.

The controller 200 performs a desired image process, and sends the image information of the document image scanned by the document scanning apparatus 220 to the image forming apparatus 100. The image forming apparatus 100 prints, implementing a function of copying a document image.

The document scanning apparatus 220 converts a document image into image information and sends the image information to the controller 200. Then, the controller 200 stores the image information in the storage device. (storage unit) of a server 30-1 via a network 10. The server 30-1 transmits the image information to a client PC 20-1 and stores the desired image information in the storage device (storage unit) of the client PC 20-1. The user can utilize the received image information.

By designating the destination address of email or the like as a transmission destination, the server 30-1 can transmit image information to a server 30-2 at the desired transmission destination via Internet 40. The partner server 30-2 transmits the stored image information to a partner client PC 20-2. The storage unit of the client PC 20-2 stores the image information to allow the user to utilize the image information from the partner client PC 20-2.

The client PCs 20-1 and 20-2 respectively connected to the network 10 and a network 10-2 can also transmit image information to the image forming apparatus 100 via the controller 200, and cause the image forming apparatus 100 to process the output image.

The first embodiment gives an exchangeable arrangement to the image forming subsystem 150 for mainly forming an image, and thereby provides various advantages to a user, serviceman, and the like.

<Example of Exchangeable Arrangement of Image Forming Subsystem>

The image forming apparatus according to the first embodiment of the present invention provides various advantages to a user, serviceman, and the like by exchangeably configuring the image forming subsystem 150 for mainly forming an image. The first embodiment will exemplify the arrangements of color and monochrome image forming apparatuses in which image forming subsystems are replaced.

Figure 3A:
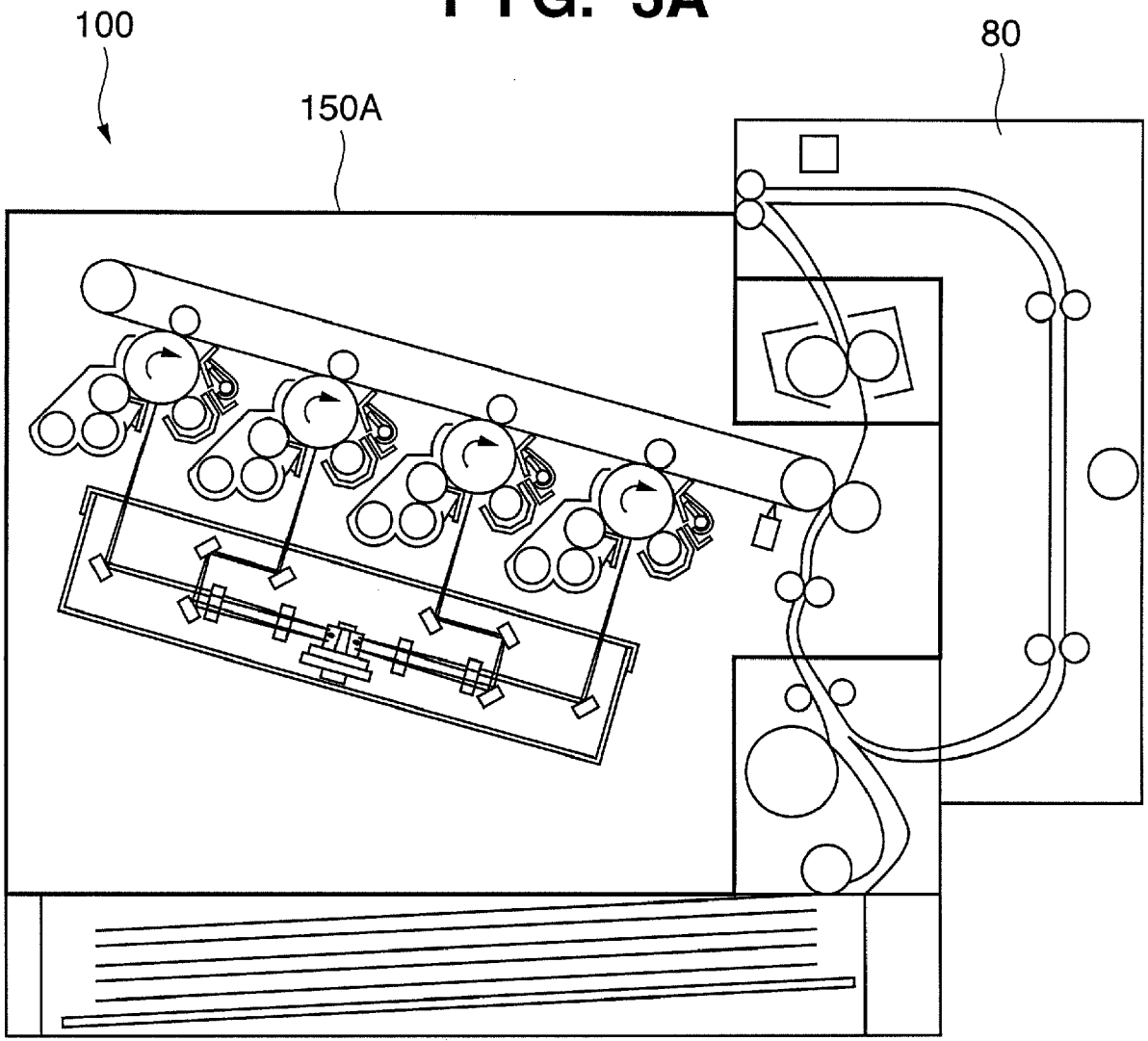
FIG. 3A is a sectional view showing an example of the arrangement of a color image forming apparatus when assembling a 4-drum type color image forming subsystem having four photosensitive drums as a forming subsystem.
Figure 3B:
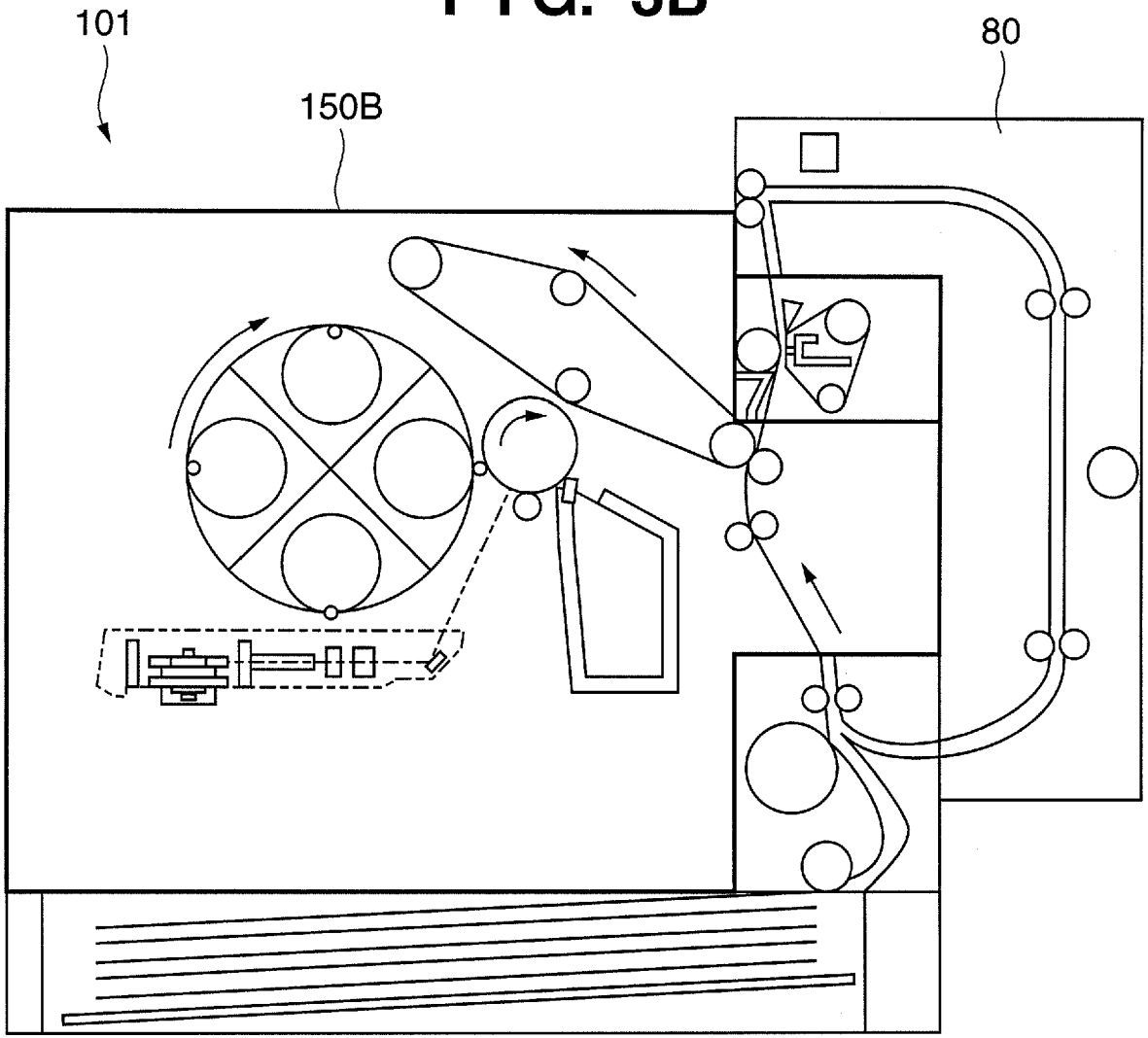
FIG. 3B is a sectional view showing an example of the arrangement of a color image forming apparatus when assembling a 1-drum type color image forming subsystem having one photosensitive drum as an image forming subsystem.
Figure 3C:
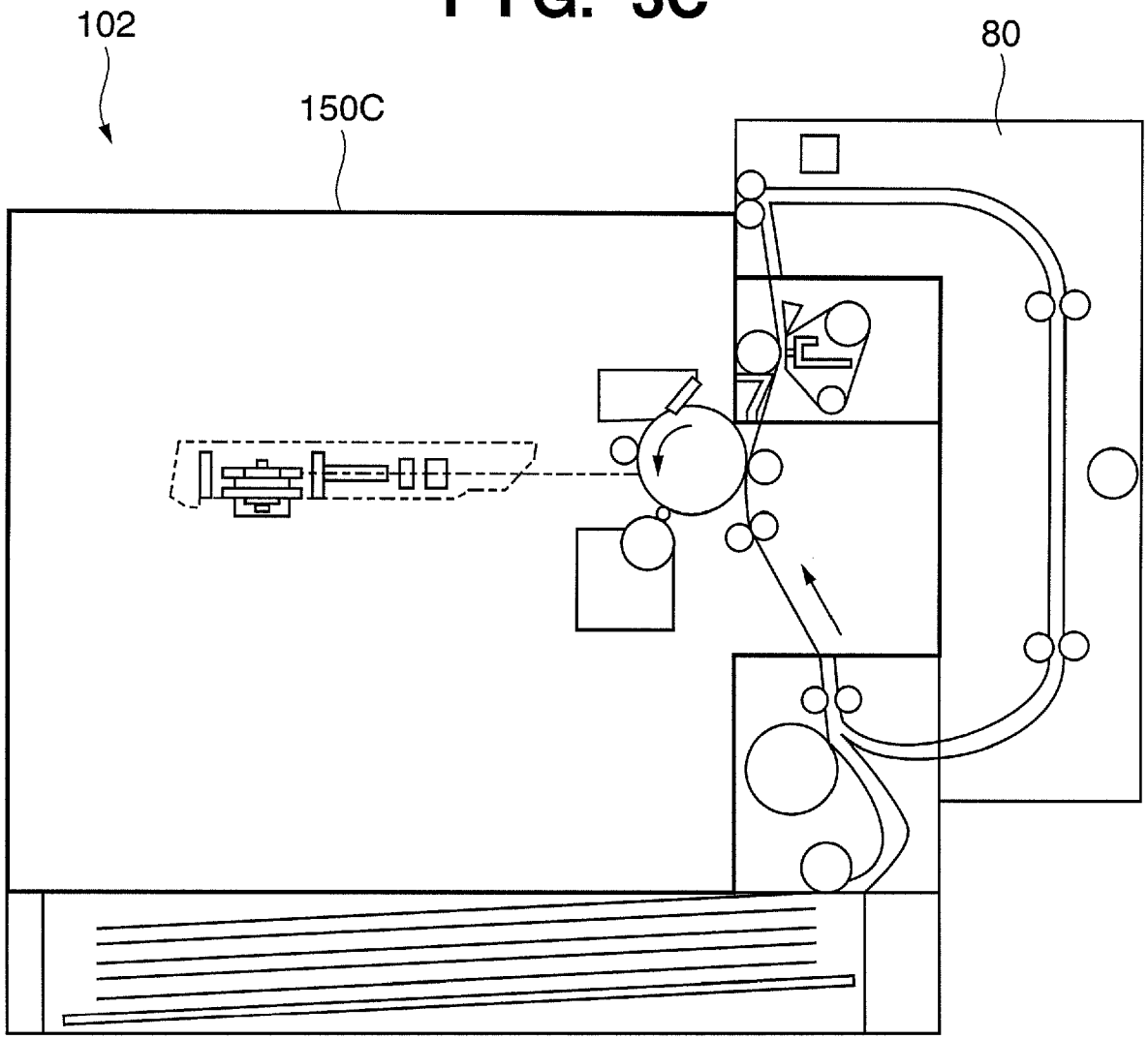
FIG. 3C is a sectional view showing an example of the arrangement of a monochrome image forming apparatus when assembling a 1-drum type monochrome image forming subsystem having one photosensitive drum as an image forming subsystem.

FIGS. 3A to 3C are sectional views showing examples of the arrangements of three types of image forming apparatuses. FIG. 3A is a sectional view showing an example of the arrangement of the color image forming apparatus 100 when assembling, as an image forming subsystem, a color image forming subsystem 150A of a 4-drum type (to be referred to as a 4D type hereinafter) containing an image creating unit 170A (FIG. 14) having four photosensitive drums. The color image forming subsystem 150A comprises four photosensitive drums serving as image carriers, an exposure unit, a charging unit, and a development unit. This arrangement is particularly suitable for high-productivity color image formation, and may target an office or near-print. As the image forming subsystem 150A, the image forming apparatus permits assembling various image forming subsystems in accordance with the user's request, such as an image forming subsystem having a productivity of 20 A4-size sheets/min in color printing, and an image forming subsystem having a productivity of 70 sheets/min in color printing.

FIG. 3B shows an example of the arrangement of the color image forming apparatus 101 when assembling, as an image forming subsystem, a 1D type color image forming subsystem 150B containing an image creating unit 170B having one photosensitive drum. The color image forming subsystem 150B comprises one photosensitive drum serving as an image carrier, an exposure unit, a charging unit, and a development unit.

The color image forming subsystem 150B is applicable to, e.g., an image forming subsystem having different print resolutions such as 400 dpi, 600 dpi, and 1,200 dpi. The image forming apparatus permits assembling various image forming subsystems compatible with many types of toners used to print and many types of printable transfer materials, in accordance with the user's request.

FIG. 3C is a sectional view showing an example of the arrangement of the monochrome image forming apparatus 102 when assembling, as an image forming subsystem, a 1D type monochrome image forming subsystem 150C containing an image creating unit 170C (FIG. 16) having one photosensitive drum. The monochrome image forming subsystem 150C comprises one photosensitive drum serving as an image carrier, an exposure unit, a charging unit, and a development unit. The image forming apparatus permits assembling image forming subsystems 150C of various performances and specifications in accordance with the user's request, such as an image forming subsystem having a productivity of 20 A4-size sheets/min in monochrome printing, and an image forming subsystem having a productivity of 100 sheets/min in monochrome printing.

An arrangement which makes it possible to exchange the paper conveyance unit 80 having a paper conveyance function with various paper conveyance units can further provide many product lineups.

<Example of Exchangeable Arrangement of Paper Conveyance Subsystem>

Figure 4A:
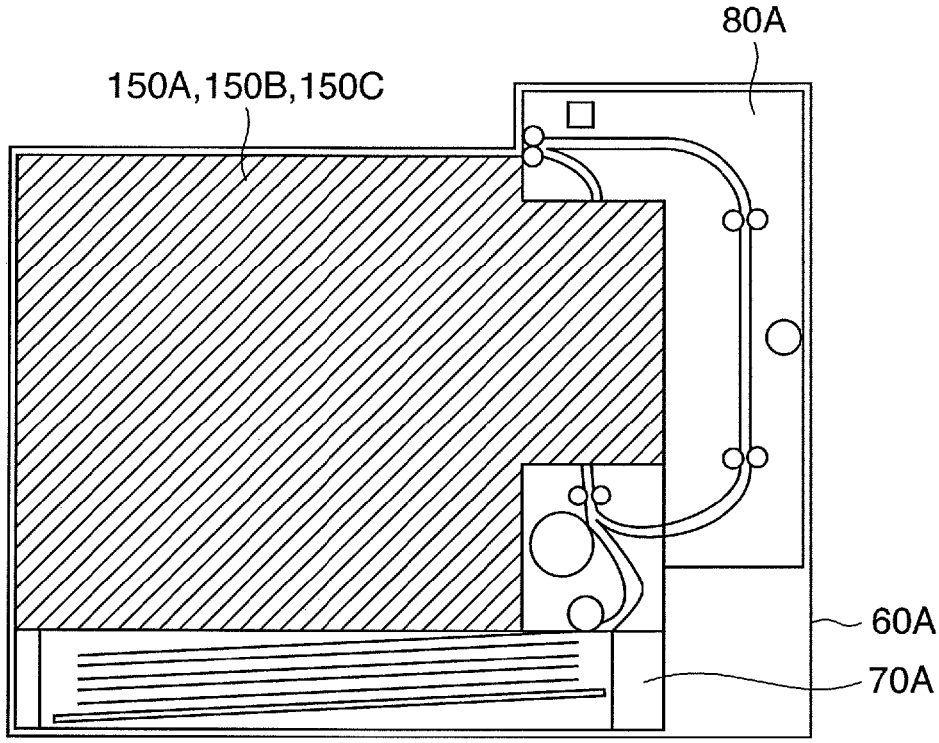
FIGS. 4A and 4B are views showing examples of the arrangements of two types of paper conveyance subsystems.
Figure 4B:
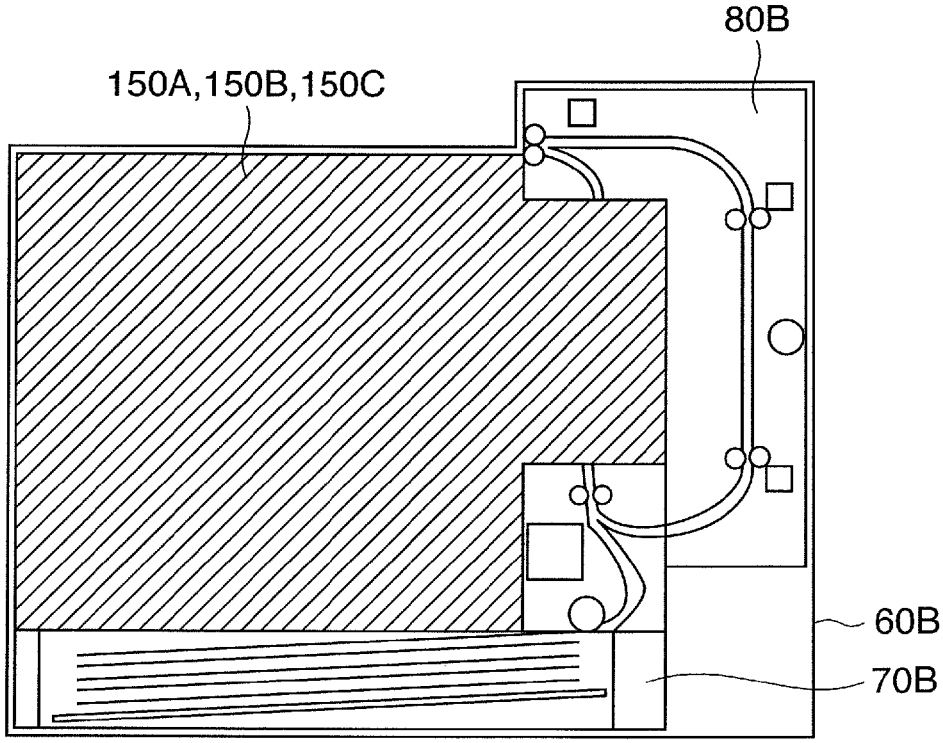

FIGS. 4A and 4B are views showing examples of the arrangements of two types of paper conveyance subsystems. FIG. 4A shows an example of a low-speed paper conveyance subsystem which incorporates a paper feed unit 70A and paper conveyance unit 80A.

FIG. 4B shows an example of a high-speed paper conveyance subsystem which incorporates a paper feed unit 70B and paper conveyance unit 80B. Either of the paper feed units 70A and 70B, either of the paper conveyance units 80A and 80B, and one of the image forming subsystems 150A, 150B, and 150C can be combined.

The paper feed unit 70A and paper conveyance unit 80A build a low-speed paper conveyance platform 60A (also called a paper conveyance subsystem 60A). The paper feed unit 70B and paper conveyance unit 80B build a high-speed paper conveyance platform 60B (also called a paper conveyance subsystem 60B). In selecting either the paper conveyance platform 60A or 60B, the user can select a paper conveyance platform in accordance with how the user uses the image forming apparatus, other than image formation factors such as paper conveyability, productivity, and durability. While comparing the image formation features of image forming subsystems, the user can combine image forming subsystems 150 appropriate for image quality desired by the user to selectively configure an image forming apparatus.

Figure 21:
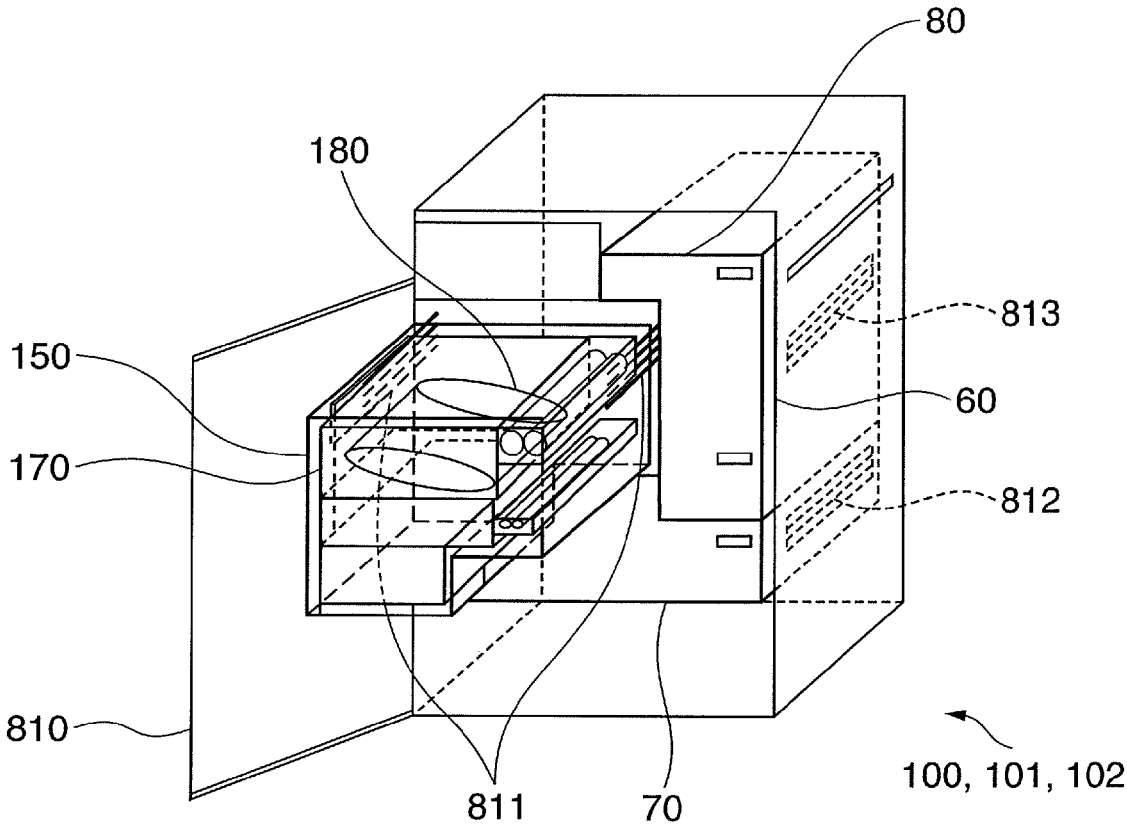
FIG. 21 is a perspective view showing a state of pulling out the image forming subsystem from the paper conveyance platform.

FIG. 21 is a perspective view showing a state of opening a cover 810 and pulling out the image forming subsystem 150 from the paper conveyance platform 60.

Two, right and left slide rails (slide mechanisms) 811 couple the image forming subsystem 150 to the paper conveyance platform 60, and permit pulling out and replaceable the image forming subsystem 150. When pulling out the image forming subsystem 150, an image creating unit 170 and fixing unit 180 mounted in the image forming subsystem 150 are pulled out together.

The paper feed unit 70 and paper conveyance unit 80 in the paper conveyance platform 60 will be explained. Similar to the image forming subsystem 150, two, right and left slide rails 812 couple the paper feed unit 70 to the paper conveyance platform and permit pulling out and replaceable the paper feed unit 70. Also similar to the paper feed unit 70, two, right and left slide rails 813 couple the paper conveyance unit 80 to the paper conveyance platform 60 and permit to pulling out and replaceable the paper conveyance unit 80.

(Positioning of Subsystem)

Figure 2A:
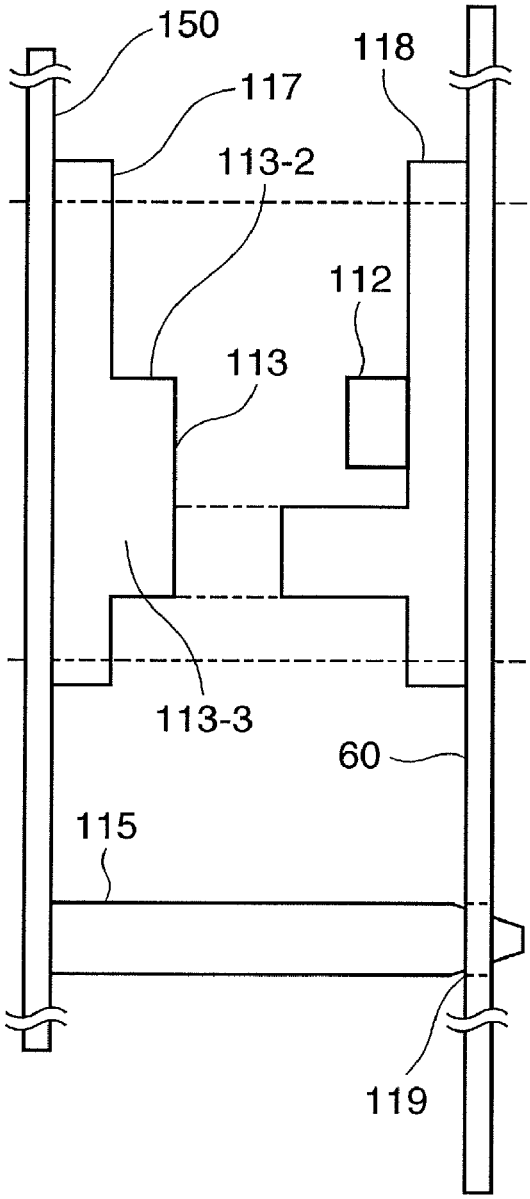
FIGS. 2A and 2B are views for explaining the positioning mechanism of a subsystem assembled into the image forming apparatus.
Figure 2B:
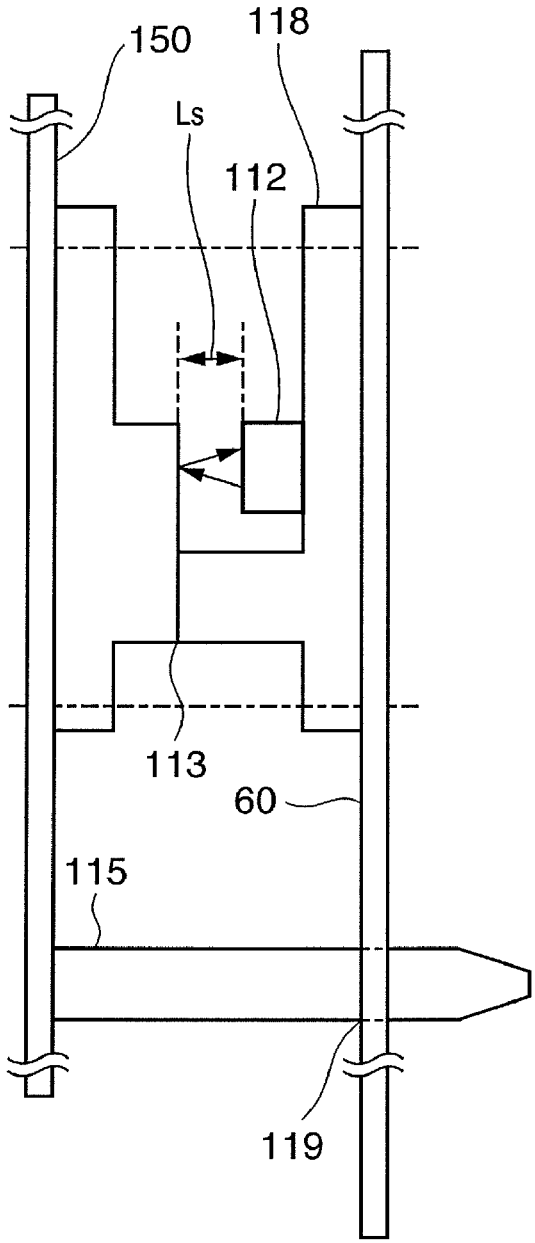

FIGS. 2A and 2B are views for explaining the positioning mechanism (positioning unit) of a subsystem assembled into the image forming apparatus. FIG. 2A shows a state before fitting the image forming subsystem 150 to the paper conveyance platform 60. FIG. 2B shows a state after fitting. Reference numeral 150 denoting an image forming subsystem will typify the above-described image forming subsystems 150A, 150B, and 150C. It is important to meet precision and cost requirements and achieve user-friendly attachment/detachment on the assumption of insertion and removal of the image forming subsystem 150. For this purpose, the arrangement of the attaching/detaching mechanism, the method and arrangement of the positioning mechanism, and the like are important.

An example of an arrangement will be explained which satisfies the positioning precision requirement while improving user operability by a positioning pin 115, the hole shape of a positioning hole 119, an attaching/detaching knob, and the like.

The shapes of the positioning pin 115 and hole 119 are optimally designed in accordance with the dimensional relationship (dimensional tolerance of a fitting system or the like) between the shaft and the hole for the purpose of smooth positioning.

(Design of Shapes of Positioning Pin and Positioning Hole)

The positioning pin 115 is used for an application purpose requiring positioning precision, and the positioning pin shape is determined in consideration of the precision requirement, reliability improvement, user operability, and the like. The positioning precision requirement and the precision levels of components (high-precision components, components greatly varying in precision, or the like) which form the positioning pin 115 and positioning hole 119 determine the shape precision and component attachment precision of components for use.

For example, the length of the contact surface between the positioning pin 115 of the image forming subsystem 150 (e.g., image forming subsystem 150A, 150B, or 150C) and the positioning hole 119 in the paper conveyance platform (paper conveyance subsystem) 60 is determined in consideration of operability, workability, and the like.

The hole diameter and hole position of the positioning hole 119 are determined with sufficient precision in consideration of the tolerance of the positioning precision requirement with the image forming subsystem 150. If necessary, it is also effective to improve the squareness precision of the positioning hole 119 with respect to the positioning pin 115. The reference plane of the outer shape of the positioning pin 115 inserted into the positioning hole is so determined as to relatively position the hole and pin surface at high precision. In this manner, fitting of the positioning pin 115 in the positioning hole 119 is designed under proper conditions. The relative positions of the paper conveyance platform (paper conveyance subsystem) 60 and image forming subsystem 150 can fall within the precision requirement.

Considering operability, it is desirable to chamfer the fitting inlet port large for smooth insertion or shape it for easy removal. The shaft diameter of the positioning pin 115, the shape of its distal end, and the like are determined in consideration of the length of the tapered portion of the positioning pin 115 and the degree of a shift between the centers of the positioning pin 115 and positioning hole 119 in positioning insertion.

It is also preferable to determine the length of the positioning guide and the like in terms of improvement of operability and apparatus reliability. In FIGS. 2A and 2B, the shape of the distal end of the positioning pin 115 is tapered slightly thin, easily guiding the positioning pin 115 into the positioning hole 119 in insertion.

Especially, the image forming subsystem 150 is assumed to have a relatively heavy structure which incorporates various components necessary to implement an image forming function. For example, the image forming subsystems 150A and 150B which form a color image desirably achieve operability considering various users.

As for the image forming subsystem 150C which forms a monochrome image, a high-speed monochrome image arrangement with high-productivity is assumed to be equal to or heavier than a color one. A middle-speed arrangement is assumed to be equal to or lighter than a color one.

As described above, it is desirable to design an arrangement which provides good user operability while achieving desired safety, durability, reliability, and high precision regardless of which of various image forming subsystems 150 is connected.

When the image forming subsystem 150 connectable to the paper conveyance platform (paper conveyance subsystem) 60 is lightweight or the positioning precision requirement can relax, an attaching/detaching mechanism 110 and positioning arrangement 120 can change to low-cost arrangements, expecting cost reduction.

(Positioning Detector)

As shown in FIG. 21, the image forming apparatus 100, 101, or 102 incorporates the slide mechanism (built by the slide rails 811, 812, and 813) so as to pull out the image forming subsystem 150. The arrangement which permits attaching/detaching the image forming subsystem 150 requires registration between a transfer material and a toner image to be transferred onto the transfer material.

For this purpose, the image forming apparatus 100 has a position detector 112 which detects the relative positions of the image forming subsystem 150 and paper conveyance platform (paper conveyance subsystem) 60 (see FIGS. 2A and 2B) when the image forming apparatus 100 incorporates the image forming subsystem 150.

As a position detection sensor used for the position detector 112, a compact, low-cost optical displacement sensor and the like are put into practice use. Examples of the sensor suitable for the application purpose of the present invention are a micro displacement sensor available from OMRON and an area image sensor. Note that the use of these sensors does not limit the gist of the present invention, and the present invention can also adopt a sensor other than an optical one.

When exemplifying the micro displacement sensor available from Omron, a micro displacement sensor Z4D-B02 has a detectable distance of 9.5 mm±3 mm and a detection resolution of ±50 μm.

Since one dot (one pixel) is 25.4 mm/400 dots=63.5 μm in a 400-dpi image forming subsystem, the detection resolution of the micro displacement sensor is smaller than one dot (one pixel). One dot is 25.4 mm/600 dots=42.3 μm at a resolution of 600 dpi, and the detection resolution corresponds to 1.18 dots. One dot is 25.4 mm/1,200 dots=21.2 μm at a resolution of 1,200 dpi, and the detection resolution corresponds to 2.36 dots.

The relative positions of the image forming subsystem 150 and paper conveyance subsystem 60 are detected on the basis of the relative positions of an image to be printed and a transfer material (transfer sheet) to be printed. In other words, the resolution of about 50 μm suffices.

Assuming that the margin size is 2.5 mm, the resolution "±50 μm" of the micro displacement sensor of the position detector corresponds to 1/50 of the margin, and the micro displacement sensor has a detection precision enough for a normal print operation. To further increase the position detection resolution of the position detector 112, the use of a micro displacement sensor Z4D-B01 also available from Omron can increase the detection resolution from the previous resolution "±50 μm" to ±10 μm. That is, the detector resolution increases five times.

In the use of the micro displacement sensor for the position detector 112, a result detected by the micro displacement sensor is an analog output which linearly decreases a voltage output from the micro displacement sensor as the distance between the detection target and the micro displacement sensor becomes longer. Position information from the sensor of the position detector 112 is used to control an image formation position so as to print an image at a proper position on a transfer material.

The user operates the attaching/detaching knob to push and horizontally slide the image forming subsystem 150 into the image forming apparatus 100. A subsystem reference surface 113 which serves as the reference position of the image forming subsystem 150 and is formed on an abutment member 117 contacts an abutment member 118 of the paper conveyance platform 60 that opposes the reference surface 113, positioning the image forming subsystem 150. The abutment member 118 has the position detector 112. The positioning pin 115 of the image forming subsystem 150 is inserted into the positioning hole 119 of the image forming apparatus, and the image forming apparatus 100 accommodates the image forming subsystem 150 at a desired positioning precision. At this time, the position detector 112 measures the mechanical positions of the paper conveyance platform 60 and image forming subsystem 150. Position detection sensor light emitted from the position detector 112 irradiates the subsystem reference surface 113, and the position detector 112 receives light reflected by the subsystem reference surface 113. The position detector 112 detects the position Ls of the image forming subsystem 150 on the basis of reception of light reflected by the reference surface 113. The position detector 112 sends position information (position detection information) detected as the position Ls to a platform controller 65 (see FIG. 1) of the paper conveyance platform 60.

The contents of concrete measurement by the position detector 112 will be explained later with reference to FIG. 22, and a detailed description thereof will be omitted.

The platform controller 65 sends position control information to an image forming controller 160 so as to control the image formation position to an optimal position on the basis of position detection information.

Note that the paper conveyance platform 60 may have a reference surface, and the image forming subsystem 150 may have the position detector 112 and send position detection information to the image forming controller 160 (see FIG. 1).

The reference surface 113 has been exemplified as the reference surface of the abutment member of the image forming subsystem 150, but the method or detection portion may be added or changed. In other words, the arrangement suffices to be able to reflect light emitted from the position detector 112.

For example, it is also possible to increase the number of position detectors 112 or change the layout position of the position detector 112 so as to detect reference surfaces 113-2 and 113-3 as other reference surfaces of the abutment member 117. For example, it is possible to detect the registration errors of the reference surfaces 113, 113-2, and 113-3 in three directions, detect the 3-dimensional registration error of the image forming subsystem 150 at higher precision, and apply the 3-dimensional registration error to image position correction control.

The positioning arrangement is effectively arranged near a mechanism of transferring a toner image onto a transfer material. This layout can more effectively increase the positional precisions of the transfer roller and a fed transfer material.

The paper conveyance platform 60, paper feed unit 70, and paper conveyance unit 80 will be explained.

(Paper Feed Unit)

Figure 11A:
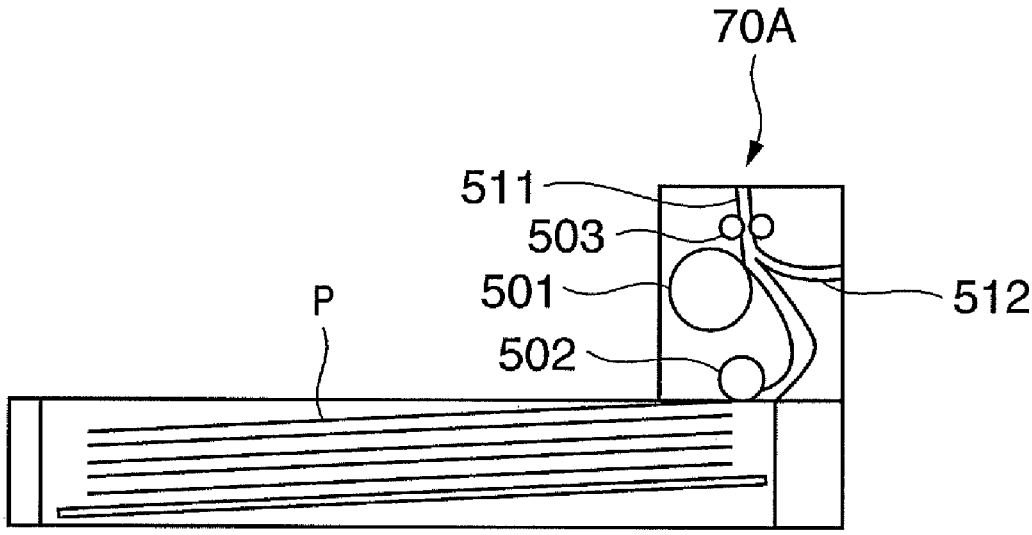
FIGS. 11A and 11B are sectional views showing the schematic structure of a paper feed unit.
Figure 11B:
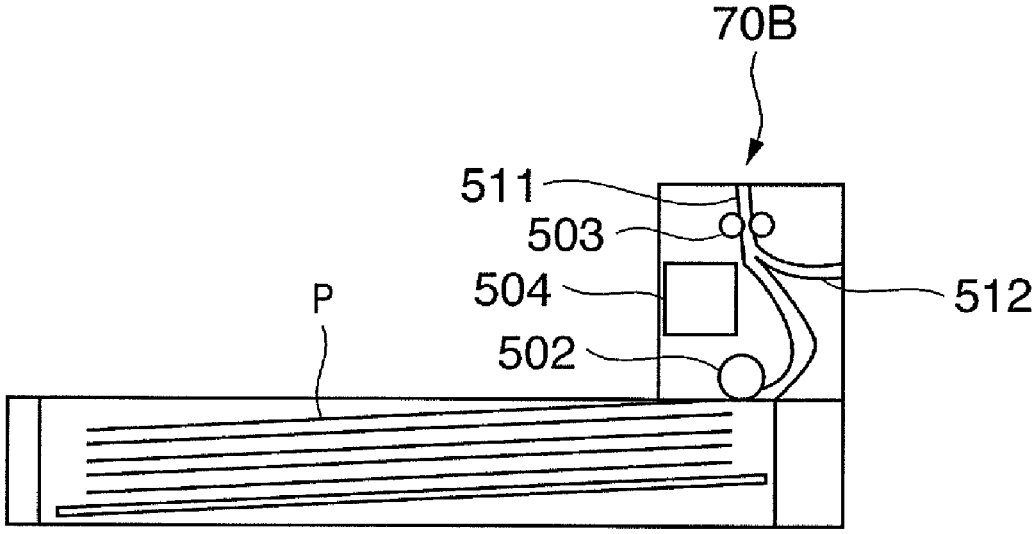

FIGS. 11A and 11B are sectional views showing the schematic structure of the paper feed unit 70. A plurality of paper feed units 70A and 70B different in performance exchangeably connect to the paper conveyance platform 60.

As paper feed units different in performance, the first embodiment will explain the paper feed unit 70A for low-speed paper feed and the paper feed unit 70B for high-speed paper feed. Each paper feed unit exchangeably connects to the paper conveyance platform 60.

In the paper feed unit 70A for low-speed paper feed, reference symbol P denotes a transfer material. Reference numeral 501 denotes a DC brushless motor; 502, a pickup roller driven to rotate by the DC brushless motor 501; 503, paper conveyance rollers driven to rotate by the DC brushless motor 501; 511, a paper feed path; and 512, a paper refeed path.

The platform controller 65 or a paper feed unit controller (not shown) in the paper feed unit controls the paper feed unit 70A. The DC brushless motor 501 rotates at a predetermined speed. In a paper feed operation, a solenoid (not shown) or the like controls abutment/separation of the pickup roller 502 against/from the transfer material P at a predetermined timing. The pickup roller 502 driven by the DC brushless motor 501 abuts and picks up the transfer material P, and feeds it to the paper feed path 511. The paper conveyance rollers 503 on the paper feed path 511 convey the transfer material P to the image forming subsystem 150 at a predetermined speed. The transfer material P fed again from the paper conveyance unit (to be described later) passes through the paper refeed path 512, and is conveyed to the image forming subsystem 150 by the paper conveyance rollers 503 on the paper feed path 511.

In the paper feed unit 70B for high-speed paper feed, reference numeral 504 denotes a stepping motor which drives the pickup roller 502 and paper conveyance rollers 503. The platform controller 65 or a paper feed unit controller (not shown) in the paper feed unit controls the paper feed unit 70B. The stepping motor 504 at a variably controlled speed. In a paper feed operation, a solenoid (not shown) or the like controls abutment/separation of the pickup roller 502 against/from the transfer material P at a predetermined timing. The pickup roller 502 driven by the stepping motor 50.4 abuts and picks up the transfer material P, and feeds it to the paper feed path 511. The paper conveyance rollers 503 on the paper feed path 511 convey the transfer material P to the image forming subsystem 150 at a predetermined speed. The transfer material P fed again from the paper conveyance unit (to be described later) passes through the paper refeed path 512, and is conveyed to the image forming subsystem 150 by the paper conveyance rollers 503 on the paper feed path 511. At this time, the paper conveyance speed of the transfer material P changes in accordance with the variably controlled rotational speed of the stepping motor 504. This makes it possible to control the conveyance speed of a transfer material and the interval between successively fed transfer materials at multiple levels in a wide range.

The paper feed unit 70 has been described by exemplifying an arrangement having one paper feed stage. However, the paper feed unit 70 is not limited to this arrangement, and includes, e.g., a conventionally well-known arrangement which couples or connects a plurality of paper feed stages to feed transfer materials of a plurality of types and a plurality of sizes.

(Paper Conveyance Unit)

Figure 12A:
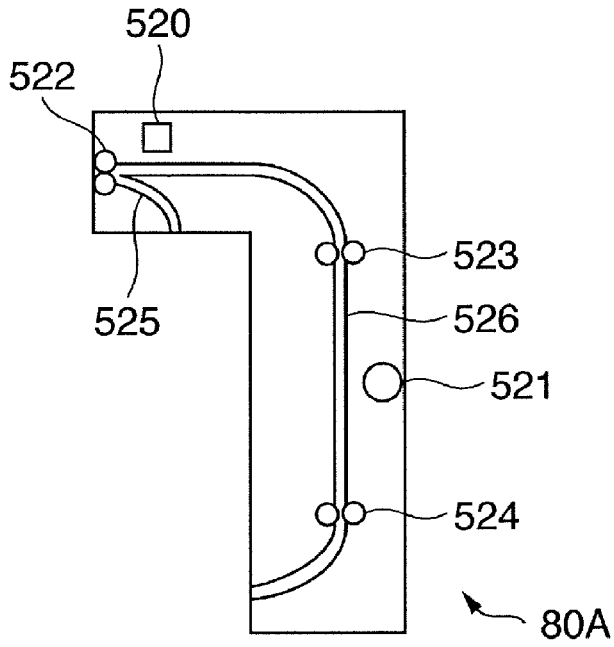
FIGS. 12A and 12B are sectional views showing the schematic structure of a paper conveyance unit.
Figure 12B:
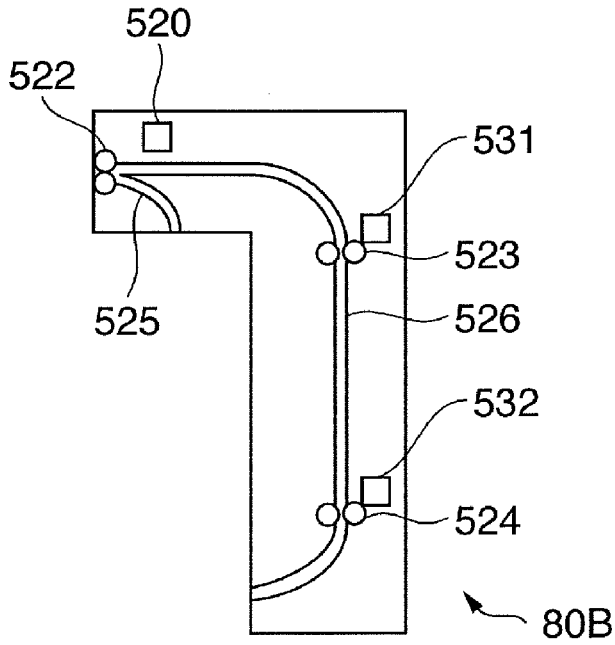

FIGS. 12A and 12B show the schematic structure of the paper conveyance unit 80. A plurality of paper conveyance units different in performance exchangeably connect to the paper conveyance platform 60. As paper conveyance units different in performance, the first embodiment will explain the paper conveyance unit 80A for low-speed paper conveyance and the paper conveyance unit 80B for high-speed paper conveyance.

In the paper conveyance unit 80A for low-speed paper conveyance, reference numeral 520 denotes a stepping motor; 521, a DC brushless motor; 522, paper discharge rollers driven to rotate forward and backward by the stepping motor 520; 523 and 524, paper conveyance rollers driven by the DC brushless motor 521; 525, a paper discharge path; and 526, a paper conveyance path. The platform controller 65 or a paper conveyance unit controller (not shown) in the paper conveyance unit controls the paper conveyance unit 80A. The stepping motor 520 is driven to rotate forward and backward in accordance with the operation mode. The DC brushless motor 521 rotates at a predetermined speed. In a paper conveyance operation, the transfer material P conveyed from the fixing unit 180 of the image forming subsystem 150 is fed to the paper discharge path 525.

In paper discharge, the paper discharge rollers 522 rotate in a direction in which the transfer material is discharged outside the apparatus, and thereby discharge the transfer material P outside the apparatus. In reversal for double-sided formation, the paper discharge rollers 522 rotate in a direction in which the transfer material P is discharged. While the paper discharge rollers 522 pinch the trailing edge of the transfer material P, the stepping motor 520 stops and rotates backward. The paper discharge rollers 522 stop and rotate backward to convey the transfer material P to the paper conveyance path 526. The paper conveyance rollers 523 and 524 driven to rotate by the DC brushless motor 521 rotating at a predetermined speed convey the transfer material P to the paper conveyance path 526, feeding the transfer material P to the paper refeed path 512 of the paper feed unit 70.

In the paper conveyance unit 80B for high-speed paper conveyance, reference numerals 531 and 532 denote stepping motors. The stepping motor 531 drives and rotates the paper conveyance rollers 523, whereas the stepping motor 532 drives and rotates the paper conveyance rollers 524. The platform controller 65 or a paper conveyance unit controller (not shown) in the paper conveyance unit controls the paper conveyance unit 80B. The stepping motors 520, 531, and 532 rotate at a variably controlled speed. In a paper conveyance operation, the transfer material P conveyed from the fixing unit 180 of the image forming subsystem 150 is fed to the paper discharge path 525. In paper discharge, the paper discharge rollers 522 rotate in a direction in which the transfer material is discharged outside the apparatus, and thereby discharge the transfer material P outside the apparatus. In reversal for double-sided formation, the paper discharge rollers 522 rotate in a direction in which the transfer material P is discharged. While the paper discharge rollers 522 pinch the trailing edge of the transfer material P, the stepping motor 520 stops and rotates backward. The paper discharge rollers 522 stop and rotate backward to convey the transfer material P to the paper conveyance path 526. The transfer material P is conveyed to the paper conveyance path 526 by the paper conveyance rollers 523 driven to rotate by the stepping motor 531 whose speed is variably controlled, and by the paper conveyance rollers 524 driven to rotate by the stepping motor 532. The transfer material P is fed to the paper refeed path 512 of the paper feed unit 70. At this time, the paper conveyance speed of the transfer material P changes in accordance with the variably controlled rotational speeds of the stepping motors 531 and 532. This makes it possible to control the paper conveyance speed of a transfer material and the interval between successively conveyed transfer materials at multiple levels in a wide range.

(Description of Arrangement of Assembling Paper Feed Unit and Paper Conveyance Unit into Paper Conveyance Platform)

Figure 13A:
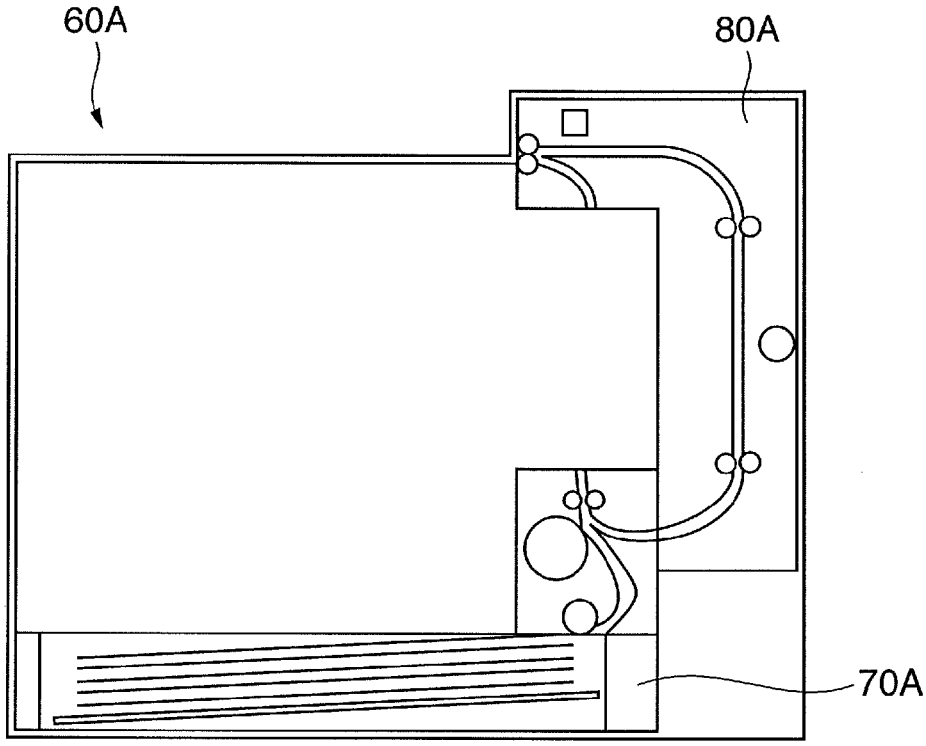
FIGS. 13A and 13B are sectional views showing a structure of assembling the paper feed unit and paper conveyance unit into a paper conveyance platform.
Figure 13B:
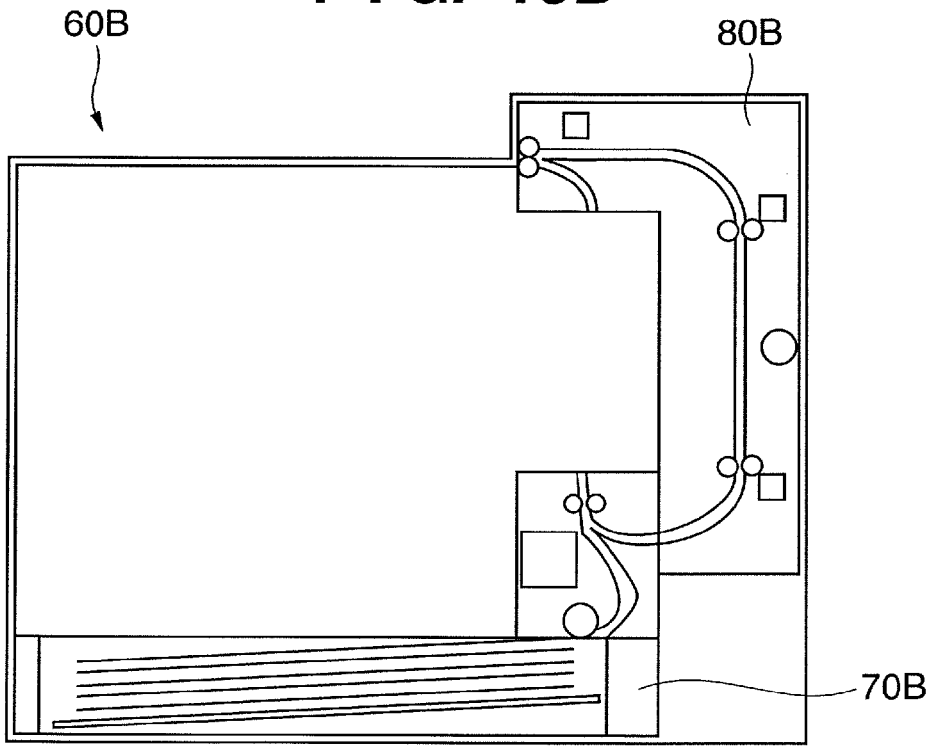

FIGS. 13A and 13B are sectional views showing structures of assembling the paper feed units 70A and 70B and the paper conveyance units 80A and 80B into the paper conveyance platform 60. FIGS. 13A and 13B show examples of combinations with the paper conveyance platforms 60A and 60B, but a combination of units is not limited to them. For example, the paper feed units 70A and 70B and the paper conveyance units 80A and 80B are properly combined and assembled into the paper conveyance platforms 60A and 60B in accordance with the application purpose and specifications. The platform controller 65 (FIG. 1) identifies or communicates with each assembled unit to collect control information corresponding to the assembled unit. The platform controller 65 communicates control information corresponding to the assembled unit with a printer engine controller 105. The platform controller 65 comprehensively controls the paper conveyance platform 60 on the basis of control specifications determined by the printer engine controller 105.

(Description of Image Forming Subsystem 150)

The image forming subsystem 150 will be explained.

Figure 14:
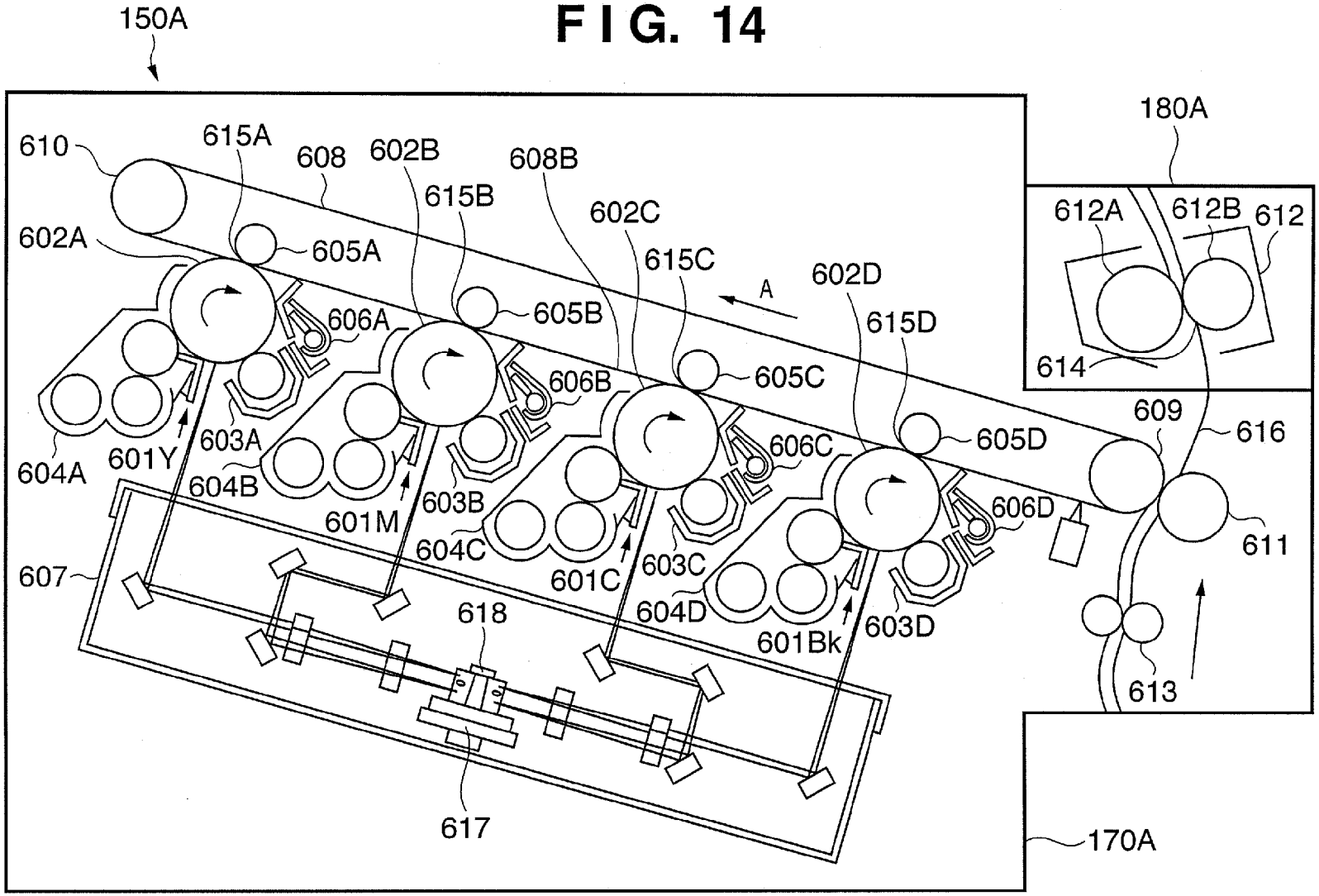
FIG. 14 is a sectional view of an image forming subsystem for a full-color printer.

FIG. 14 is a sectional view of the image forming subsystem 150A for a full-color printer (4-drum type). The image creating unit 170A has four photosensitive drums. A fixing unit 180A is exchangeable with another unit of the same function, and is physically separable from the image creating unit 170A.

Details of the image creating unit 170A will be explained.

The image creating unit 170A comprises an image forming portion 601Y which forms an yellow image, an image forming portion 601M which forms a magenta image, an image forming portion 601C which forms a cyan image, and an image forming portion 601Bk which forms a black image. The four image forming portions 601Y, 601M, 601C, and 601Bk align in a line at predetermined intervals.

The image forming portions 601Y, 601M, 601C, and 601Bk comprise drum type electrophotographic photosensitive bodies (to be referred to as photosensitive drums hereinafter) 602A, 602B, 602C, and 602D serving as image carriers, respectively. Primary chargers 603A to 603D, developing devices 604A to 604D, transfer rollers 605A to 605D serving as transfer units, and drum cleaners 606A to 606D surround the photosensitive drums 602A to 602D, respectively. A laser exposure device 607 is arranged below the primary chargers 603A, 603B, 603C, and 603D and the developing devices 604A, 604B, 604C, and 604D.

The developing devices 604A, 604B, 604C, and 604D store yellow, cyan, magenta, and black toners, respectively.

The photosensitive drums 602A, 602B, 602C, and 602D are negatively charged OPC photosensitive bodies having photoconductive layers on aluminum drum bases, respectively. Driving devices (not shown) drive and rotate the photosensitive drums 602A, 602B, 602C, and 602D clockwise at predetermined process speeds in FIG. 14.

The primary chargers 603A, 603B, 603C, and 603D serving as primary charging units uniformly charge the surfaces of the photosensitive drums 602A, 602B, 602C, and 602D to predetermined negative potentials by charging biases applied from a charging bias supply (not shown).

The developing devices 604A, 604B, 604C, and 604D store toners, and apply toners of respective colors to electrostatic latent images respectively formed on the photosensitive drums 602A, 602B, 602C, and 602D, developing (visualizing) the electrostatic latent images as toner images.

The transfer rollers 605A, 605B, 605C, and 605D serving as primary transfer units can abut the photosensitive drums 602A, 602B, 602C, and 602D via an intermediate transfer belt 608 at primary transfer portions 615A, 615B, 615C, and 615D.

The drum cleaners 606A, 606B, 606C, and 606D have, e.g., cleaning blades for removing, from the photosensitive drums 602A, 602B, 602C, and 602D, transfer toner remaining on the photosensitive drums 602A, 602B, 602C, and 602D after primary transfer.

The intermediate transfer belt 608 is arranged above the photosensitive drums 602A to 602D, and looped between a secondary transfer counter roller 609 and a tension roller 610. At a secondary transfer portion 616, the secondary transfer counter roller 609 can abut a secondary transfer roller 611 via the intermediate transfer belt 608. The intermediate transfer belt 608 is formed from a dielectric resin such as a polycarbonate resin film, polyethylene terephthalate resin film, or polyvinylidene fluoride resin film.

A primary transfer surface 608B of the intermediate transfer belt 608 on a side opposing the photosensitive drums 602A, 602B, 602C, and 602D inclines to the secondary transfer roller 611.

The laser exposure device 607 comprises, e.g., a polygon mirror 618, a scanner motor 617, a reflection mirror, and a laser emitting unit (not shown) for emitting light corresponding to time series electrical digital pixel signals of supplied image information. The laser exposure device 607 exposes the photosensitive drums 602A, 602B, 602C, and 602D to form electrostatic latent images of respective colors corresponding to image information on the surfaces of the photosensitive drums 602A, 602B, 602C, and 602D charged by the primary chargers 603A, 603B, 603C, and 603D. At the same time, a beam detection signal (BD) generation circuit (not shown) in the laser exposure device 607 detects a laser beam in the main scanning direction polarized by the polygon mirror.

The image creating unit 170A further comprises an image creating unit controller (not shown) for controlling the operations of these elements. The image creating unit controller controls the process speed of the image creating unit and tint/density adjustment.

The fixing unit 180A will be explained.

The fixing unit 150A is arranged downstream of the secondary transfer portion 616 of the image creating unit 170A in the recording paper conveyance direction. A fixing device 612 having a fixing roller 612A which incorporates a heat source such as a halogen heater and a press roller 612B is installed along a vertical path. A driving device (not shown) drives and rotates the fixing roller 612A and press roller 612B. The surface temperature of the fixing roller is controlled by controlling power of the halogen heater in the fixing roller 612A. Further, the fixing unit 180A comprises a fixing unit controller (not shown) for controlling these elements. The fixing unit controller controls the rotational speed of each roller, the temperature of the fixing roller, and a process upon occurrence of an abnormality.

The image forming subsystem 150A for a full-color printer comprises the image forming controller 160 (FIG. 1). The image forming controller 160 communicates with the image creating unit controller and fixing unit controller, receives pieces of unit information from the respective controllers, and transmits unit control information to the respective controllers. Also, the image forming controller 160 exchanges image signals with the controller 200, and exchanges pieces of control information with the printer engine controller 105 and platform controller 65.

In the above description, the image creating unit and fixing unit have controllers, respectively. However, the image creating unit and fixing unit can operate without any controller. In this case, the image forming controller 160 (FIG. 1) controls elements in the image creating unit and fixing unit.

Figure 15:
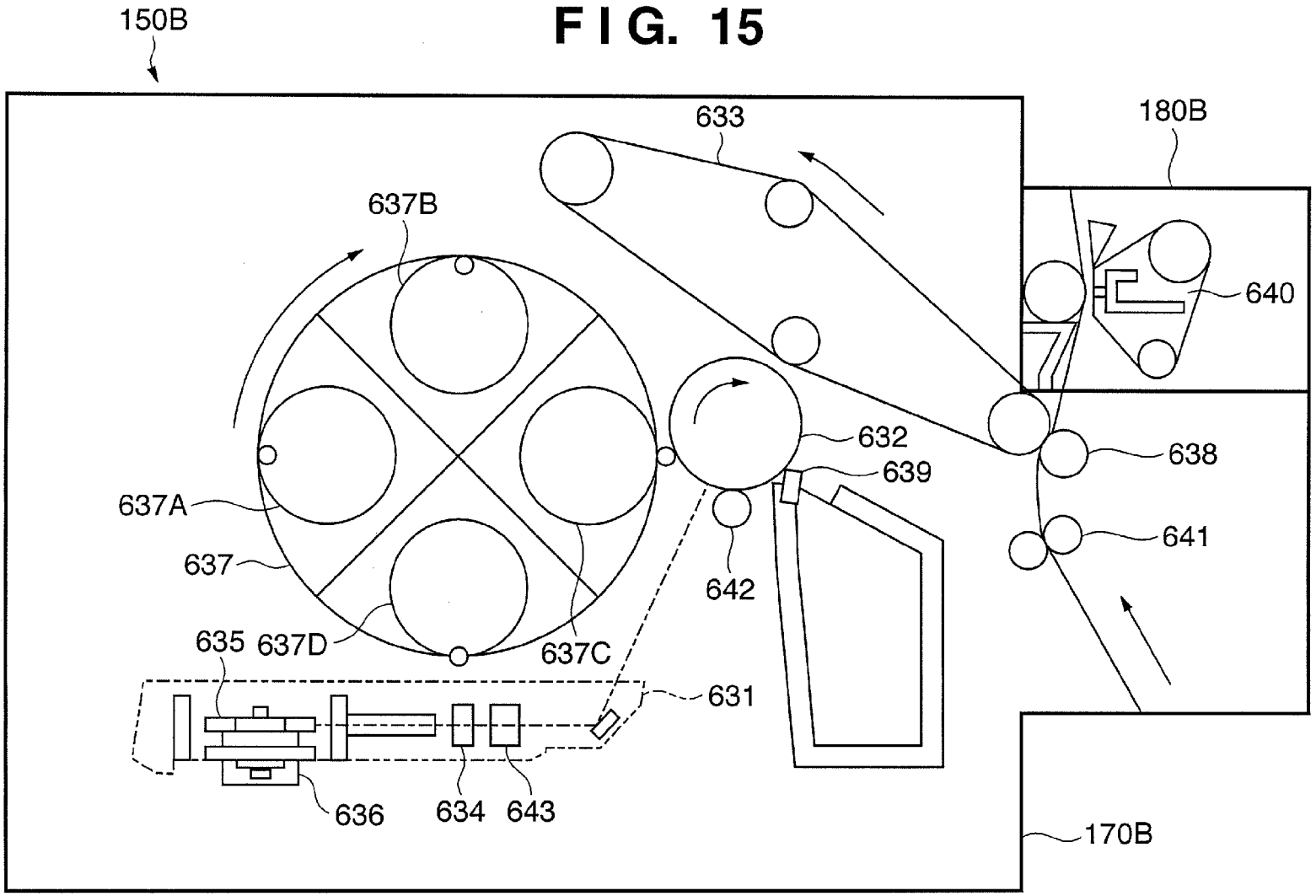
FIG. 15 is a sectional view of another image forming subsystem for a full-color printer.

FIG. 15 is a sectional view of the image forming subsystem 150B for a full-color printer (1-drum type). Similar to the above-described color image forming subsystem 150A, the image creating unit 170B has one photosensitive drum. A fixing unit 180B is exchangeable with another unit of the same function, and is physically separable from the image creating unit 170B.

Details of the image creating unit 170B will be explained.

A scanner unit 631 comprises a laser unit 634, polygon mirror 635, scanner motor 636, and beam detection signal (BD signal) generation circuit 643.

The image creating unit 170B comprises the scanner unit 631, a photosensitive drum 632, an intermediate transfer belt 633, a developing rotary unit 637, a primary transfer roller, a secondary transfer roller 638, and a cleaning blade 639. The developing rotary unit 637 incorporates developing substance units 637A to 637D for respective colors.

The photosensitive drum 632 is an OPC photosensitive body having a photoconductive layer on an aluminum drum base. A driving device (not shown) drives and rotates the photosensitive drum 632 clockwise in FIG. 15 at a predetermined process speed.

A primary charger 642 serving as a primary charging unit uniformly charges the surface of the photosensitive drum 632 to a predetermined potential by a charging bias applied from a charging bias supply (not shown).

In the scanner unit 631, the laser unit 634 emits a laser beam modulated on the basis of time series electrical digital pixel signals of supplied image information. The polygon mirror 635 is a rotary polygon mirror which deflects a laser beam emitted by the laser unit 634 to scan the surface of the photosensitive drum 632 and form an electrostatic latent image on the photosensitive drum 632. The scanner motor 636 drives and rotates the polygon-mirror 635. The beam detection signal (BD signal) generation circuit 643 detects a laser beam in the main scanning direction deflected by the polygon mirror 635.

The developing rotary unit 637 uses the developing substance units 637A, 637B, 637C, and 637D for yellow (Y), magenta (M), cyan (C), and black (B) to develop an electrostatic latent image formed on the photosensitive drum 632. Similar to the above-mentioned vertical-path 4D color image creating unit, the photosensitive drum 632 applies a primary transfer bias to the primary transfer roller, and primarily transfers, to the intermediate transfer belt 633, a developing substance supplied from the developing rotary unit 637 onto the photosensitive drum 632. The secondary transfer roller 638 abuts the intermediate transfer belt 633, and secondarily transfers the developing substance on the intermediate transfer belt 633 to a recording medium such as a recording sheet.

The cleaning blade 639 is always in contact with the photosensitive drum 632, and cleans it by scraping toner remaining on the surface of the photosensitive drum 632.

Similar to the above-mentioned color image creating unit (FIG. 14), the image creating unit 170B comprises an image creating unit controller (not shown) for controlling the operations of these elements. The image creating unit controller controls the process speed of the image creating unit and tint/density adjustment.

The fixing unit 180B will be explained.

The fixing unit 180B is arranged downstream of the secondary transfer roller 638 of the image creating unit 170B in the recording paper conveyance direction. Similar to the above-described color image creating unit (FIG. 14), a fixing device 640 performs a fixing operation of heating, pressing, and thereby fixing a toner image transferred on a recording medium. A driving device (not shown) drives and rotates the roller of the fixing unit. The surface temperature of the fixing roller is controlled by controlling power of the halogen heater in the fixing device 640.

In addition, the fixing unit 180B comprises a fixing unit controller (not shown) for controlling the above elements. The fixing unit controller controls the rotational speed of each roller, the temperature of the fixing roller, and a process upon occurrence of an abnormality.

The image forming subsystem 150B comprises the image forming controller 160 (FIG. 1). The image forming controller 160 communicates with the image creating unit controller and fixing unit controller, receives pieces of unit information from the respective controllers, and transmits unit control information to the respective controllers. Also, the image forming controller 160 communicates image signals with the controller 200, and communicates pieces of control information with the printer engine controller 105 and platform controller 65.

In the above description, the image creating unit and fixing unit have controllers, respectively. However, the image creating unit and fixing unit can operate without any controller. In this case, the image forming controller 160 (FIG. 1) controls elements in the image creating unit and fixing unit.

Figure 16:
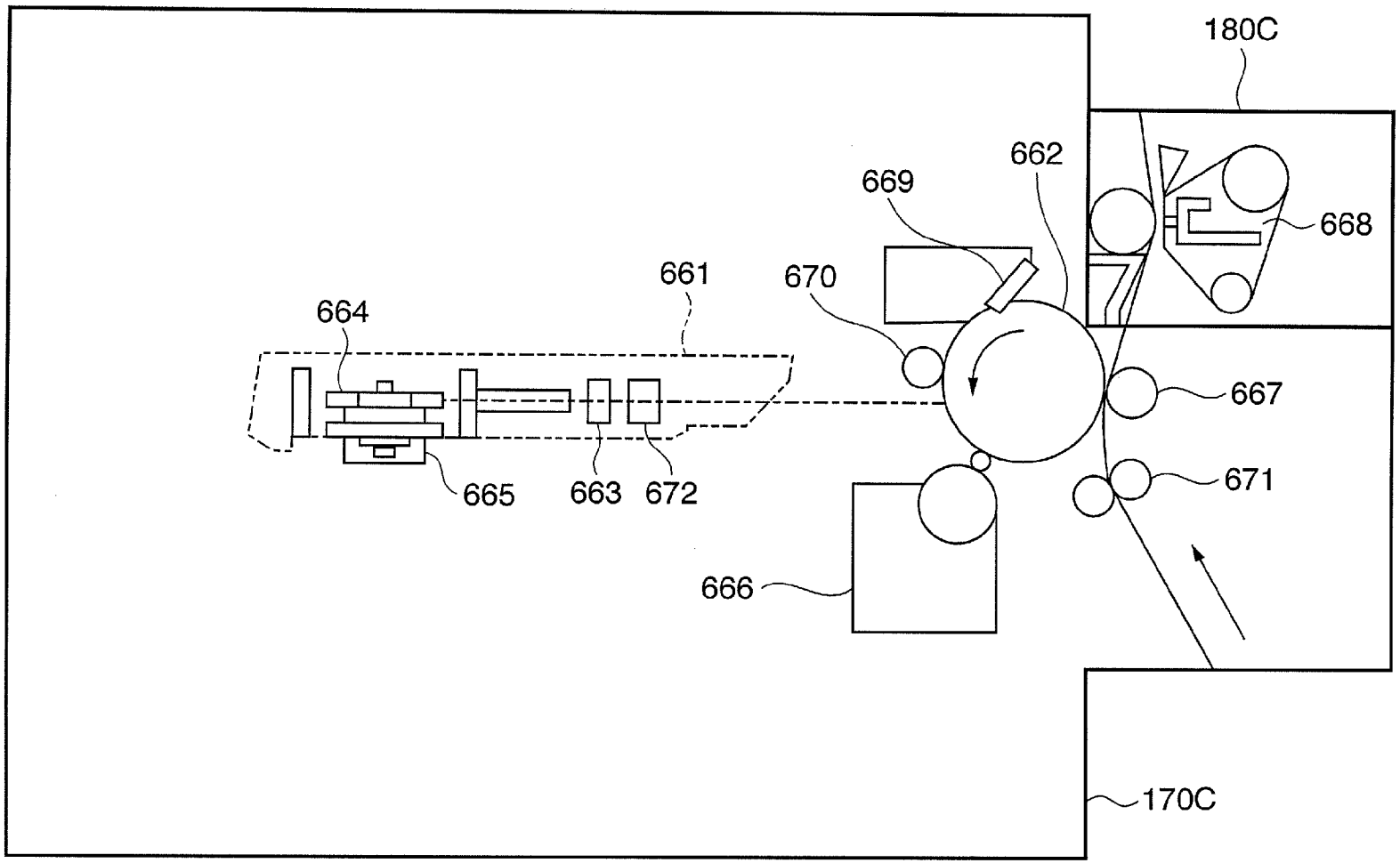
FIG. 16 is a sectional view of a monochrome image forming subsystem.

FIG. 16 is a sectional view of the monochrome image forming subsystem 150C. Each of the image creating unit 170C and a fixing unit 180C is exchangeable with another unit of the same function, and is physically separable.

Details of the image creating unit 170C will be explained.

The image creating unit 170C comprises a scanner unit 661, photosensitive drum 662, developing unit 666, and transfer roller 667. The scanner unit 661 comprises a laser unit 663, polygon mirror 664, scanner motor 665, and beam detection signal (BD signal) generation circuit 672.

The photosensitive drum 662 is an OPC photosensitive body having a photoconductive layer on an aluminum drum base. A driving device (not shown) drives and rotates the photosensitive drum 662 counterclockwise in FIG. 16 at a predetermined process speed.

A primary charger 670 serving as a primary charging unit uniformly charges the surface of the photosensitive drum 662 to a predetermined potential by a charging bias applied from a charging bias supply (not shown).

In the scanner unit 661, the laser unit 663 emits a laser beam modulated on the basis of time series electrical digital pixel signals of supplied image information. The polygon mirror 664 is a rotary polygon mirror which deflects a laser beam emitted by the laser unit 663 to scan the surface of the photosensitive drum 662 and form an electrostatic latent image on the photosensitive drum 662. The scanner motor 665 drives and rotates the polygon mirror 664. The beam detection signal (BD signal) generation circuit 672 detects a laser beam in the main scanning direction deflected by the polygon mirror 664.

The developing unit 666 develops an electrostatic latent image formed on the photosensitive drum 662 with a black (B) developing substance. The transfer roller 667 abuts the photosensitive drum 662 and transfers the developing substance on the photosensitive drum 662 to a recording medium such as a recording sheet.

A cleaning blade 669 is always in contact with the photosensitive drum 662, and cleans it by scraping toner remaining on the surface of the photosensitive drum 662.

The image creating unit 170C further comprises an image creating unit controller (not shown) for controlling the operations of these elements. The image creating unit controller controls the process speed of the image creating unit and tint/density adjustment.

The fixing unit 180C will be explained.

The fixing unit 180C is arranged downstream of the transfer roller 667 of the image creating unit 170C in the transfer material conveyance direction. A fixing device 668 performs a fixing operation of heating, pressing, and thereby fixing a toner image transferred on a recording sheet. A driving device (not shown) drives and rotates the roller of the fixing unit. The surface temperature of the fixing roller is controlled by controlling power of the halogen heater in the fixing device 668. Further, the fixing unit 180C comprises a fixing unit controller (not shown) for controlling these elements. The fixing unit controller controls the rotational speed of each roller, the temperature of the fixing roller, and a process upon occurrence of an abnormality.

The image forming subsystem 150C comprises the image forming controller 160 (FIG. 1). The image forming controller 160 communicates with the image creating unit controller and fixing unit controller, receives pieces of unit information from the respective controllers, and transmits unit control information to the respective controllers. Further, the image forming controller 160 exchanges image signals with the controller 200, and exchanges pieces of control information with the printer engine controller 105 and platform controller 65.

In the above description, the image creating unit and fixing unit have controllers, respectively. However, the image creating unit and fixing unit can operate without any controller. In this case, the image forming controller 160 (FIG. 1) controls elements in the image creating unit and fixing unit.

The image forming subsystem in the image forming apparatus, and its image forming controller will be explained.

Figure 5:
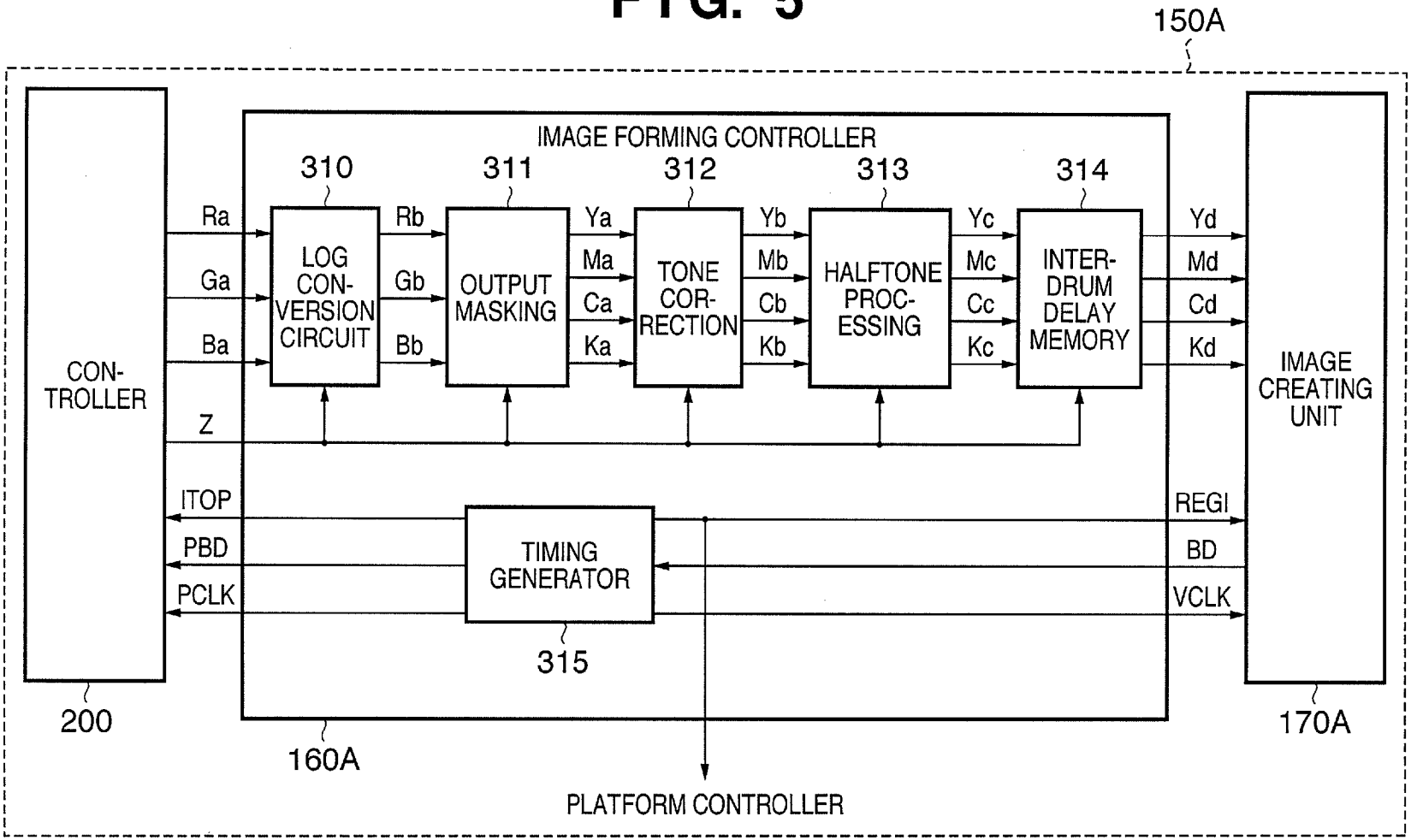
FIG. 5 is a block diagram of a full-color image forming subsystem.

FIG. 5 is a block diagram of the full-color image forming subsystem 150A. The full-color image forming subsystem 150A comprises an image forming controller 160A including an image processor, the image creating unit 170A, and the controller 200. The image forming controller 160A receives an image signal of the RGB color format from the controller 200, and executes the following process.

First, a LOG conversion circuit 310 converts the density of the image signal, and an output masking circuit 311 converts the image signal into YMCK data. The output masking circuit 311 converts an image signal so as to minimize the average color difference in the Lab space, and the coefficients of conversion depend on the hardware characteristic of the image creating unit 170A.

Then, a tone correction circuit 312 receives the YMCK data, and corrects the tone on the basis of a lookup table (to be referred to as a LUT hereinafter). The LUT is a synthesis of a table for correcting a hardware characteristic such as the individual difference of the image creating unit 170A or a change over time, a density adjustment table changed by user settings, and an image mode table for a text mode/photographic printing paper mode.

The LUT also changes depending on the following halftone process. Since a halftone processing circuit 313 parallel-executes a plurality of halftone processes, the tone correction circuit 312 has LUTs by the number of processes of the halftone processing circuit 313, and simultaneously processes and outputs all the LUTs.

The halftone processing circuit 313 receives the tone-corrected signal, and generates print data. The halftone processing circuit 313 simultaneously performs error diffusion and a plurality of screen processes, and outputs print data selected by a Z signal (to be described later).

An inter-drum delay memory 314 delays print data in accordance with the drum layout, and outputs the print data to the image creating unit 170A.

The controller 200 inputs a Z signal representing the feature of an image, simultaneously with an image signal. The Z signal synchronizes with an RGB signal, and is input to the LOG conversion circuit 310, output masking circuit 311, tone correction circuit 312, and halftone processing circuit 313.

The Z signal contains data representing the feature of each page and data representing the feature of each pixel. More specifically, the former data represents a copy image/PDL image, and the latter data represents a text/photo, BMP/object, or the like.

An ITOP image sync signal and PBD signal output from a timing generator 315 control the image output timing of the controller 200. The ITOP signal is a sync signal in the sub-scanning direction, and the PBD signal is a sync signal in the main scanning direction.

The controller 200 also receives an image clock PCLK, and outputs image data synchronized with PCLK.

The PBD signal is generated on the basis of a BD signal output from the image creating unit 170A. The timing generator 315 also generates an REGI signal for controlling the driving timing of a registration roller, and supplies the REGI signal to the image creating unit 170A containing the registration roller. The REGI signal is generated on the basis of the ITOP signal. The timing of the REGI signal is determined from the relationship between the image creation position, the transfer position, and the registration roller, and has a value unique to the image forming subsystem.

The REGI signal is also supplied to the platform controller in order to synchronize with the registration roller.

Figure 6:
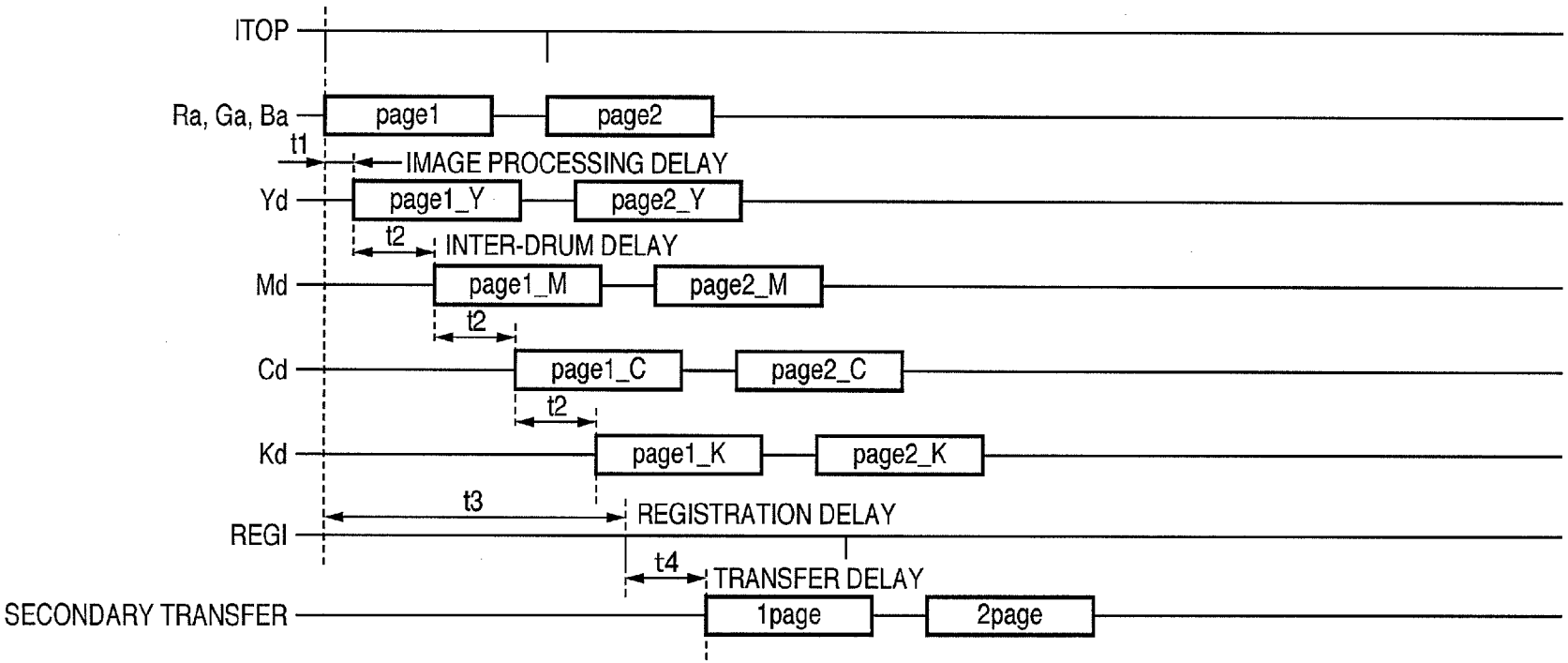
FIG. 6 is a timing chart showing the image formation timing of the full-color image forming subsystem.

FIG. 6 is a timing chart showing the image formation timing of the full-color image forming subsystem 150A. FIG. 6 shows a case of successively creating two images. The controller 200 outputs RGB images in accordance with the ITOP timing, and the image forming controller 160A sequentially outputs YMCK data to the image creating unit 170A after an image processing delay t1.

A phase difference of an inter-drum delay t2 exists between YMCK data, and the inter-drum delay memory 314 (FIG. 5) performs the delay process.

An REGI signal is generated a registration delay t3 after ITOP generation. At this timing, the registration roller is driven to convey a sheet to the secondary transfer portion. Secondary transfer starts at a timing delayed by a transfer delay t4 after the REGI signal. A process for the second page starts during transfer of the first page. To process a larger number of pages, the same process is repeated.

Figure 7:
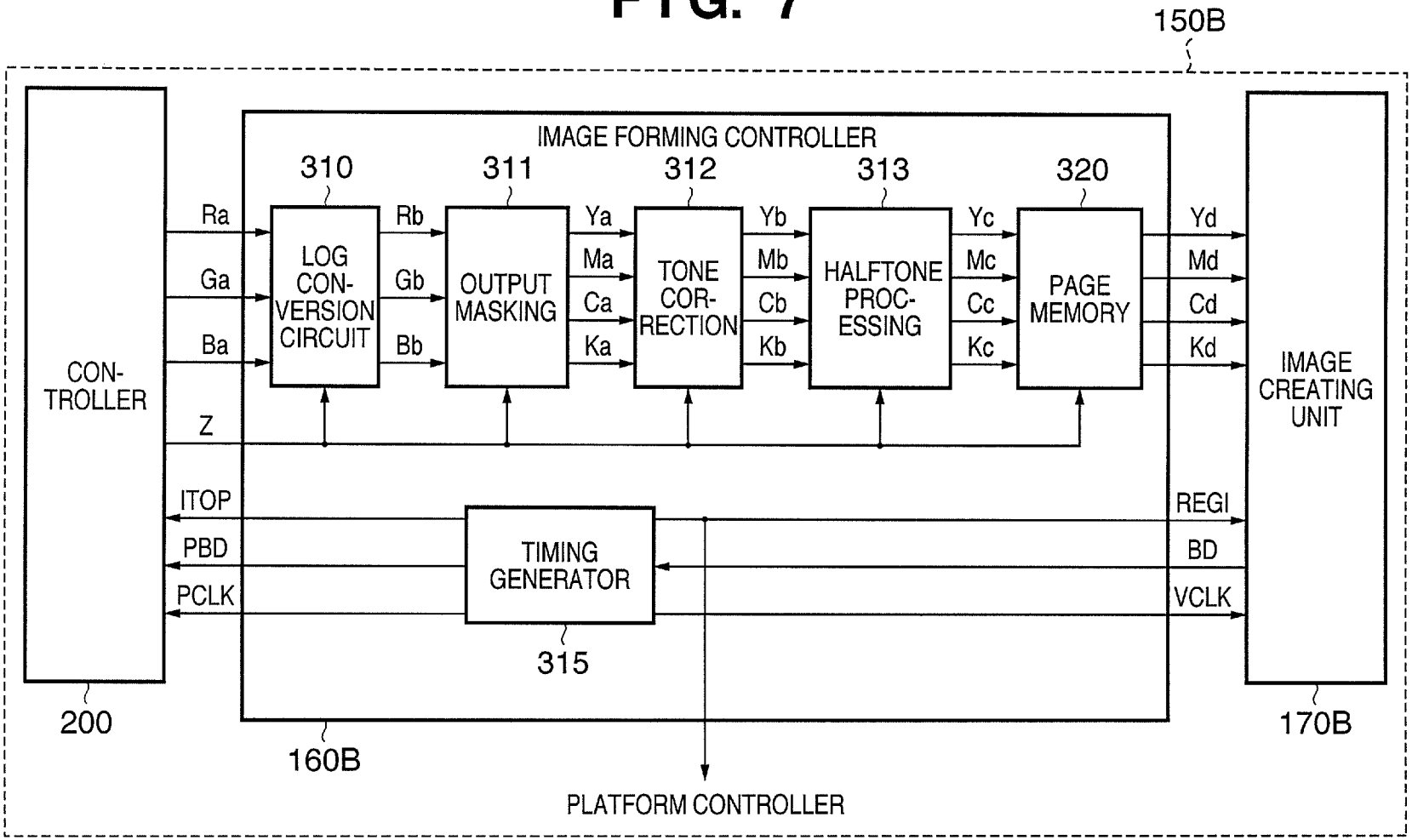
FIG. 7 is a block diagram of another full-color image forming subsystem.

FIG. 7 is a block diagram of the full-color image forming subsystem 150B. The full-color image forming subsystem 150B comprises an image forming controller 160B including an image processor, the image creating unit 170B, and the controller 200. The image forming controller 160B receives an image signal of the RGB color format from the controller 200, and executes the following process.

An image process by the color image forming subsystem 150B is different from the process by the image forming controller of the color image forming subsystem 150A in that a page memory 320 replaces the inter-drum delay memory 314.

The remaining blocks are the same as those of the color image forming subsystem 150A, and a description thereof will be omitted.

Figure 8:
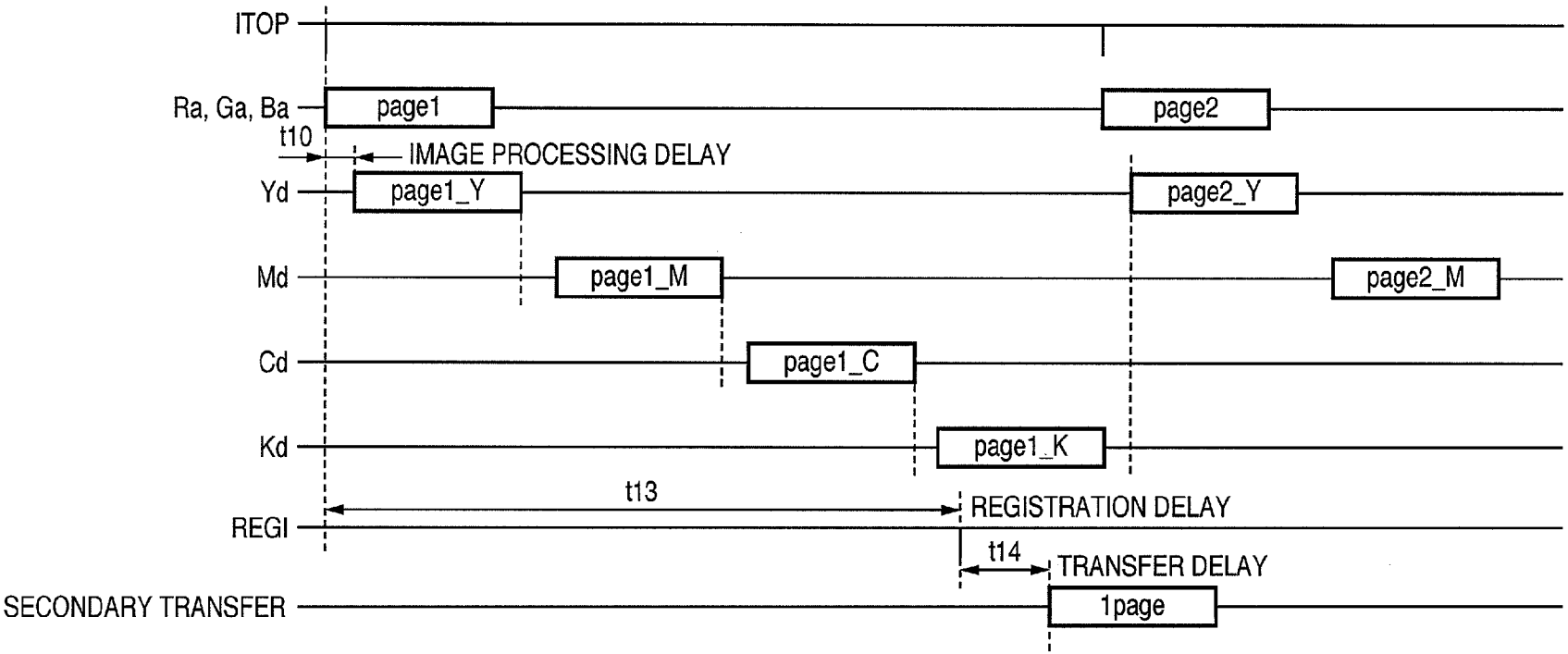
FIG. 8 is a timing chart showing the image formation timing of the full-color image forming subsystem.

FIG. 8 is a timing chart showing the image formation timing of the full-color image forming subsystem 150B. FIG. 8 shows a case of successively creating two images. The controller 200 outputs RGB signals in accordance with the ITOP timing. YMCK print data are saved in the page memory 320 after an image processing delay t10, and sequentially supplied to the image creating unit 170B. Since the image creating unit 170B creates images color by color due to its structure, the next print data is supplied upon completion of an image of each color.

The timing generator 315 generates an REGI signal a registration delay t13 after ITOP generation. At this timing, the registration roller is driven to convey a sheet to the secondary transfer portion. Secondary transfer starts at a timing delayed by a transfer delay t14 after the REGI signal. A process for the second page starts at such a timing as to prevent overlapping between an image creation process for the first page in the fourth color and an image creation process for the second page in the first color. To process a larger number of pages, the same process is repeated.

Figure 9:
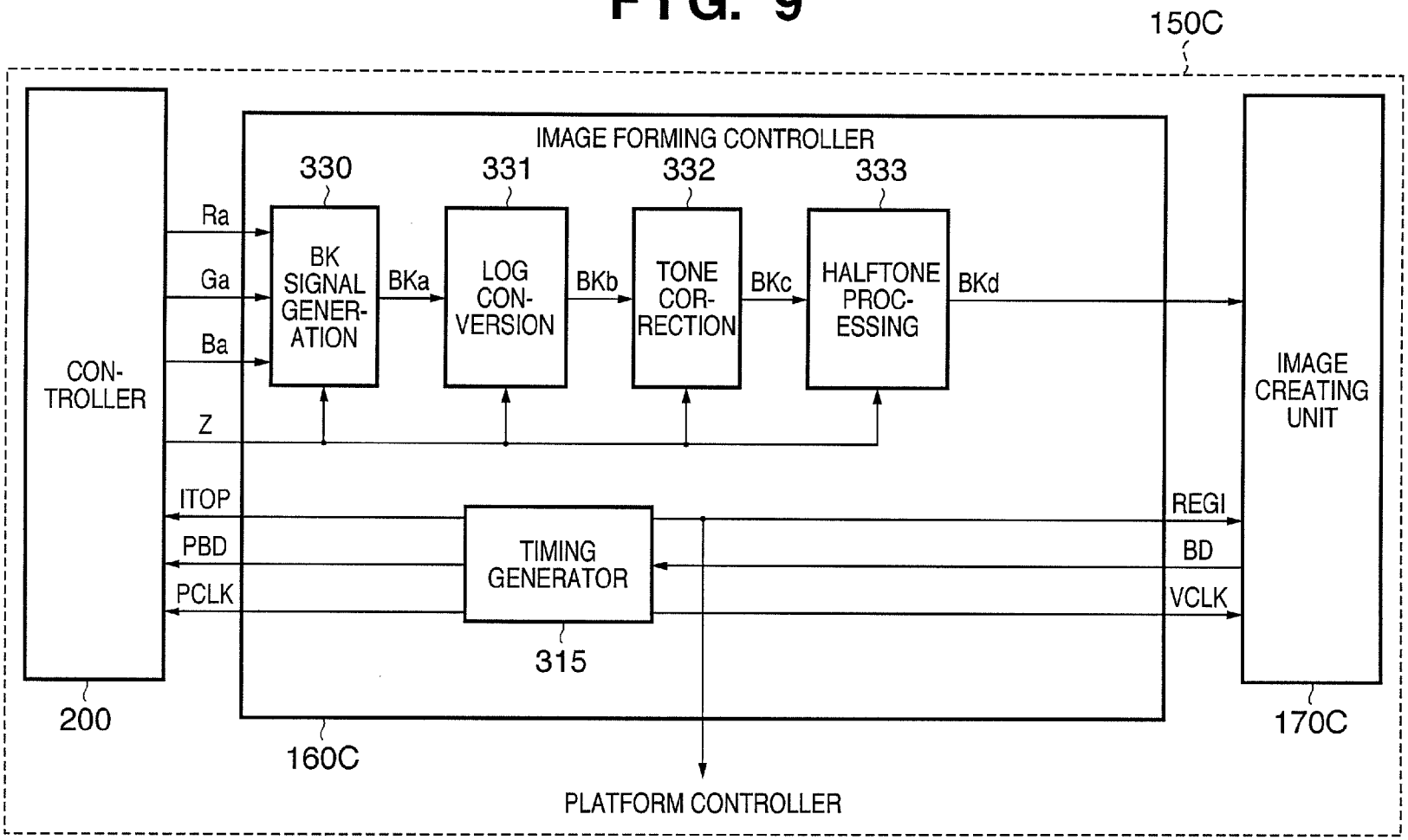
FIG. 9 is a block diagram of a monochrome image forming subsystem.

FIG. 9 is a block diagram of the monochrome image forming subsystem 150C. The monochrome image forming subsystem 150C comprises an image forming controller 160C including an image processor, the image creating unit 170C, and the controller 200.

An image signal supplied from the controller 200 has an RGB format, and the image forming controller 160C generates a Bk signal. First, a Bk signal generation circuit 330 converts an RGB signal into a Bk signal. Then, a LOG conversion circuit 331 converts the density of the Bk signal, a tone correction circuit 332 corrects the tone, and a halftone processing circuit 333 generates print data.

The LOG conversion circuit 331, tone correction circuit 332, and halftone processing circuit 333 have the same functions as those of the full-color system except that the number of channels is only one for Bk.

Figure 10:
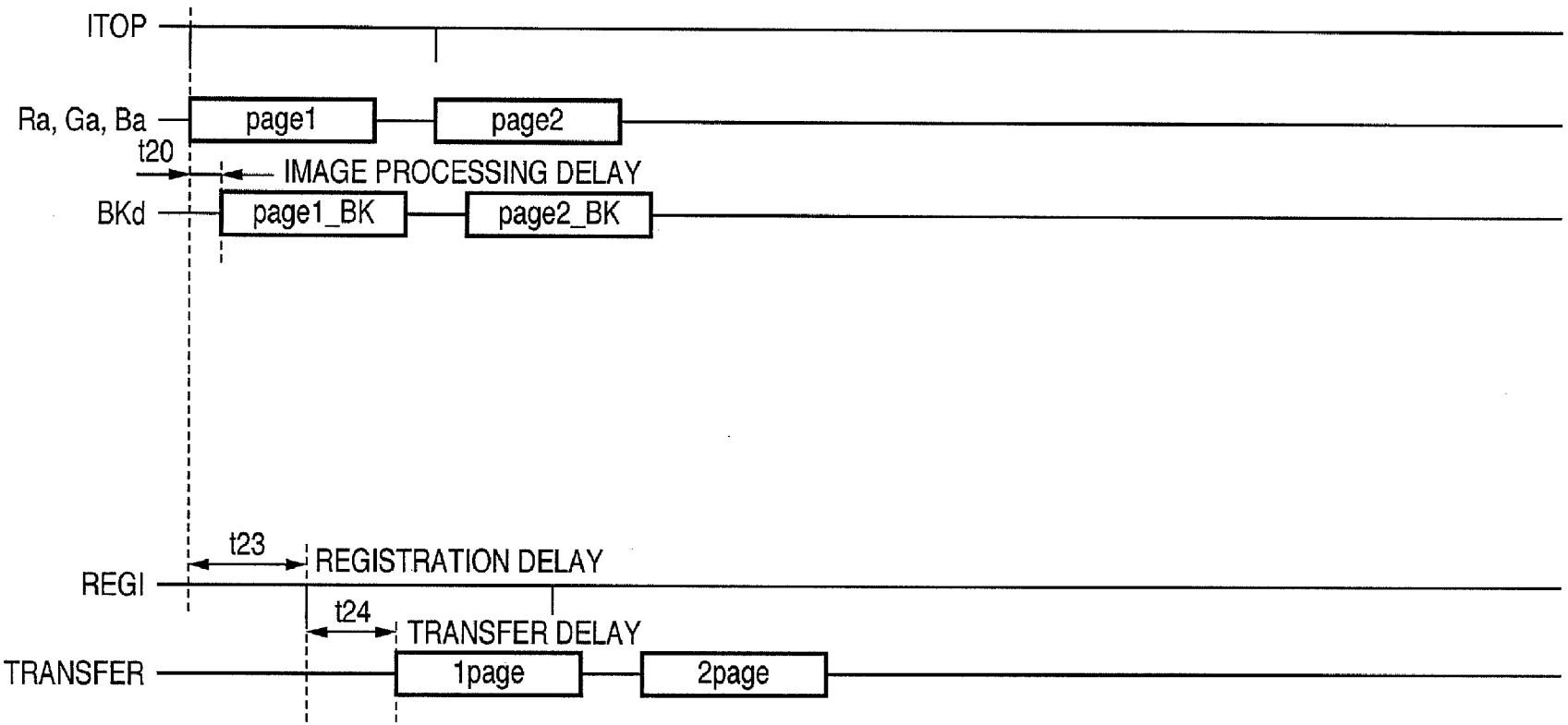
FIG. 10 is a timing chart showing the image formation timing of the monochrome image forming subsystem.

FIG. 10 is a timing chart showing the image formation timing of the monochrome image forming subsystem 150C. FIG. 10 shows a case of successively creating two images. The controller 200 outputs RGB signals in accordance with the ITOP timing, and the image forming controller 160C outputs Bk data (Bkd) to the image creating unit 170C after an image processing delay t20. An REGI signal is generated a registration delay t23 after ITOP generation. At this timing, the registration roller is driven to convey a sheet to the transfer portion. Transfer starts at a timing delayed by a transfer delay t24 after the REGI signal. A process for the second page starts during transfer of the first page. To process a larger number of pages, the same process is repeated.

(Description of Image Forming Operation) (Image Formation when Assembling Image Forming Subsystem 150A)

An image forming operation by the image forming apparatus 100 when mounting the image forming subsystem 150A corresponding to a high-speed color throughput on the paper conveyance platform 60 will be explained.

When receiving an image forming job start instruction from a user via the operation unit 210 (FIG. 1) of the image forming apparatus, the printer engine controller 105 transmits a paper feed request command to the platform controller 65.

In accordance with the paper feed request command, the paper conveyance unit 80 and paper feed unit 70 start operating. Similarly, when the printer engine controller 105 transmits an image formation request command to the image forming controller 160, the image creating unit 170A and fixing unit 150A start an image forming operation (FIG. 14). In the image creating unit 170A, the primary chargers 603A to 603D uniformly negatively charge the photosensitive drums 602A to 602D of the image forming portions 601Y to 601Bk driven to rotate at arbitrary process speeds by driving mechanisms (not shown).

In the laser exposure device 607, the laser beam emitting element emits a laser beam based on an externally input color-separated image signal to irradiate the polygon mirror 618 driven to rotate by the scanner motor 617. The laser exposure device 607 forms electrostatic latent images of the respective colors on the photosensitive drums 602A, 602B, 602C, and 602D via a reflecting mirror or the like.

The developing device 604A, which receives a developing bias of the same polarity as the charging polarity (negative polarity) of the photosensitive drum 602A, applies yellow toner to the electrostatic latent image formed on the photosensitive drum 602A, visualizing the latent image as a toner image. The transfer roller 605A, which receives a primary transfer bias (of a polarity (positive polarity) opposite to that of toner), primarily transfers the yellow toner image onto the driven intermediate transfer belt 608 at the primary transfer portion 615A between the photosensitive drum 602A and the transfer roller 605A.

The intermediate transfer belt 608 bearing the yellow toner image moves to the image forming portion 601M. Similarly at the primary transfer portion 615B, the image forming portion 601M transfers the magenta toner image formed on the photosensitive drum 602B over the yellow toner image on the intermediate transfer belt 608.

At this time, the cleaner blade of the drum cleaner device or the like scrapes and recovers toner remaining on the photosensitive drums 602A, 602B, 602C, and 602D after transfer.

At the primary transfer portions 615A to 615D, cyan and black toner images are sequentially superposed on the yellow and magenta toner images superposed and transferred on the intermediate transfer belt 608, forming a full-color toner image on the intermediate transfer belt 608.

A paper feed cassette in the paper feed unit 70A is selected at the timing when the leading edge of the full-color toner image on the intermediate transfer belt 608 moves to the secondary transfer portion 616 between the secondary transfer counter roller 609 and the secondary transfer roller 611. The pickup roller 502 is driven to pick up a top sheet among transfer materials (sheets) P stored in the paper feed cassette. Then, the picked-up transfer material (sheet) P is conveyed to the paper feed path 511.

The paper conveyance rollers 503 convey the conveyed transfer material P to registration rollers 613 of the image creating unit 170A. The registration rollers 613 of the image creating unit 170A convey the transfer material P to the secondary transfer portion 616. The secondary transfer roller 611, which receives a secondary transfer bias (of a polarity (positive polarity) opposite to that of toner), secondarily transfers the full-color toner image at once onto the transfer material P conveyed to the secondary transfer portion 616.

The transfer material P bearing the full-color toner image is conveyed to the fixing unit 180A. The full-color toner image is heated and pressed at a fixing nip portion 614 between the fixing roller 612A and the press roller 612B, and thermally fixed onto the surface of the transfer material P. After that, the transfer material P is conveyed to the paper conveyance unit 80A (FIG. 12A). The transfer material P passes through the paper discharge path 525 of the paper conveyance unit 80A, and is discharged by the paper discharge rollers 522 onto a paper discharge tray on the upper surface of the main body, ending a series of image forming operations.

The image forming operation in single-sided image formation has been described.

(Double-Sided Image Forming Operation)

A double-sided image forming operation by the image forming apparatus according to the present invention will be explained. This operation is the same as the single-sided image forming operation up to conveyance of a transfer material P to the fixing unit 180A. After the paper discharge rollers 522 discharge most of the transfer material P having passed through the paper discharge path 525 of the paper conveyance unit 80A (FIG. 12A) onto the paper discharge tray on the upper surface of the main body, they stop rotation. At this time, the discharge rollers 522 stop so that the trailing edge position of the transfer material P reaches a reversible position, i.e., the downstream side from the branch point between the paper discharge path 525 and the paper conveyance path 526.

Subsequently, the paper discharge rollers 522 rotate in a direction opposite to rotation in the single-sided image forming operation, in order to feed, to the paper conveyance path 526 having the paper conveyance rollers 523 and 524, the transfer material P which stops by stopping rotation of the paper discharge rollers 522. By reversely rotating the paper discharge rollers 522, the trailing edge of the transfer material P at the reversible position changes to the leading edge and reaches the paper conveyance rollers 523.

The paper conveyance rollers 523 convey the transfer material P to the paper conveyance rollers 524. The transfer material P is conveyed to the paper feed path 511 of the paper feed unit 70A (FIG. 11A).

The paper conveyance rollers 503 convey the conveyed transfer material P to the registration rollers 613 of the image creating unit 170A (FIG. 14). During this paper conveyance, the printer engine controller 105 transmits an image formation request command to the image forming controller 160. The registration rollers 613 move the transfer material P to the secondary transfer portion 616 at the timing when the leading edge of the full-color toner image on the intermediate transfer belt 608 moves to the secondary transfer portion 616 between the secondary transfer counter roller 609 and the secondary transfer roller 611.

At the secondary transfer portion 616, the leading edge of the toner image and that of the transfer material P match each other. After transferring the toner image, the fixing unit 180A fixes the image on the transfer material P, similar to the single-sided image forming operation. The transfer material P is conveyed again by the paper discharge rollers 522 of the paper conveyance unit 80A and finally discharged onto the paper discharge tray, ending a series of image forming operations.

(Image Formation when Assembling Image Forming Subsystem 150B)

An image forming operation by the image forming apparatus 101 when mounting the image forming subsystem 150B corresponding to a middle-speed color throughput on the paper conveyance platform 60 will be explained.

When receiving an image forming job start instruction from a user via the operation unit 210 (FIG. 1) of the image forming apparatus, the printer engine controller 105 transmits a paper feed request command to the platform controller 65.

In accordance with the paper feed request command, the paper conveyance unit 80 and paper feed unit 70 start operating. Similarly, when the printer engine controller 105 transmits an image formation request command to the image forming controller 160, the driving mechanism (not shown) of the image creating unit 170B drives and rotates the photosensitive drum 632 at an arbitrary process speed. The primary charger 642 uniformly negatively charges the photosensitive drum 632.

In the exposure device 631, the laser beam emitting element emits a laser beam based on an externally input color-separated image signal to irradiate the polygon mirror 635 driven to rotate by the scanner motor 636. The exposure device 631 forms an yellow (Y) electrostatic latent image on the photosensitive drum 632 via a reflecting mirror or the like. The latent image on the photosensitive drum 632 is visualized with an yellow (Y) developing substance at the position where the photosensitive drum 632 contacts the yellow (Y) developing substance unit 637A in the developing rotary unit 637.

The transfer roller, which receives a primary transfer bias (of a polarity (positive polarity) opposite to that of toner), primarily transfers the yellow (Y) developing substance on the photosensitive drum 632 onto the driven intermediate transfer belt 633 at the position where the photosensitive drum 632 contacts the intermediate transfer belt 633. At this time, the cleaning blade 639 of the drum cleaner device or the like scrapes toner remaining on the photosensitive drum 632 after transfer, and recovers the toner in a recovery vessel.

A driving unit (not shown) rotates the developing rotary unit 637 through about 90°, and the developing rotary unit 637 prepares for the next magenta (M) development. In image creation based on magenta (M) data, similar to image creation based on yellow (Y) data, a latent image of magenta (M) data is transferred onto the photosensitive drum 632.

Then, the developing mechanism rotates the photosensitive drum 632. The primary charger 642 uniformly negatively charges the photosensitive drum 632. In the exposure device, the laser beam emitting element emits a laser beam based on an externally input color-separated image signal to irradiate the polygon mirror 635 driven to rotate by the scanner motor 636. The exposure device forms a magenta (M) electrostatic latent image on the photosensitive drum 632 via the reflecting mirror or the like. The latent image on the photosensitive drum 632 is visualized with a magenta (M) developing substance at the same rotation position of the intermediate transfer belt 633 as the position for the yellow (Y) developing substance.

The transfer roller, which receives a primary transfer bias (of a polarity (positive polarity) opposite to that of toner), primarily transfers the magenta (M) developing substance on the photosensitive drum 632 onto the intermediate transfer belt 633 at the position where the rotating photosensitive drum 632 contacts the intermediate transfer belt 633.

Subsequently, cyan (C) and black (Bk) are also controlled by the same image forming process. After four, yellow (Y), magenta (M), cyan (C), and black (Bk) developing substances are superposed on the intermediate transfer belt 633, a paper feed cassette in the paper feed unit 70B is selected at a predetermined position. The pickup roller 502 is driven to pick up the top sheet among transfer materials (sheets) P stored in the paper feed cassette, and conveys the picked-up transfer material (sheet) P to the paper feed path 511. The paper conveyance rollers 503 (FIGS. 11A and 11B) convey the conveyed transfer material P to registration rollers 641 of the image creating unit 170B (FIG. 15).

The registration rollers 641 of the image creating unit 170B convey the transfer material P to the secondary transfer portion. The secondary transfer roller 638, which receives a secondary transfer bias (of a polarity (positive polarity) opposite to that of toner), secondarily transfers the full-color toner image at once onto the transfer material P conveyed to the secondary transfer portion.

The transfer material P bearing the full-color toner image is conveyed to the fixing unit 180B. The fixing device 640 heats and presses the full-color toner image, and thereby thermally fixes it onto the surface of the transfer material P. Then, the transfer material P is conveyed to the paper conveyance unit 80B. The transfer material P passes through the paper discharge path 525 of the paper conveyance unit 80B, and is discharged by the paper discharge rollers 522 onto the paper discharge tray on the upper surface of the main body, ending a series of image forming operations.

Similar to the image forming subsystem 150A, a double-sided image forming operation by the color image forming subsystem 150B can be executed by controlling conveyance of the transfer material P in accordance with a combination of the paper conveyance unit and paper feed unit.

(Image Formation when Assembling Image Forming Subsystem 150C)

An image forming operation by the image forming apparatus 102 when mounting the image forming subsystem 150C on the paper conveyance platform 60 will be explained. When receiving an image forming job start instruction from a user via the operation unit 210 of the image forming apparatus, the printer engine controller 105 transmits a paper feed request command to the platform controller 65.

On the basis of the transmitted paper feed request command, the paper conveyance unit 80 and paper feed unit 70 start operating. Similarly, when the printer engine controller 105 transmits an image formation request command to the image forming controller 160, the driving mechanism (not shown) of the image creating unit 170C drives and rotates the photosensitive drum 662 at an arbitrary process speed. The primary charger 670 uniformly negatively charges the photosensitive drum 662. In the exposure device 661, the laser beam emitting element emits a laser beam based on an externally input image signal to irradiate the polygon mirror 664 driven to rotate by the scanner motor 665. The exposure device 661 forms an electrostatic latent image on the photosensitive drum 662 via a reflecting mirror or the like.

The latent image on the photosensitive drum 662 is visualized with a developing substance at the position where the photosensitive drum 662 contacts the developing substance unit 666. A paper feed cassette in the paper feed unit 70A is selected. The pickup roller 502 is driven to pick up the top sheet among transfer materials (sheets) P stored in the paper feed cassette, and conveys the picked-up transfer material (sheet) P to the paper feed path 511 (FIGS. 11A and 11B). The paper conveyance rollers 503 convey the conveyed transfer material P to registration rollers 671 of the image creating unit 170C (FIG. 16). The transfer roller 667, which receives a transfer bias (of a polarity (positive polarity) opposite to that of toner), transfers the toner image onto the transfer material P conveyed to the transfer portion. The transfer material P bearing the toner image is conveyed to the fixing unit 180C. The fixing device 668 heats and presses the toner image, and thereby thermally fixes it onto the surface of the transfer material P. Then, the transfer material P is conveyed to the paper conveyance unit 80A. The transfer material P passes through the paper discharge path 525 of the paper conveyance unit 80A, and is discharged by the paper discharge rollers 522 onto the paper discharge tray on the upper surface of the main body, ending a series of image forming operations. The cleaning blade 669 of the drum cleaner device or the like scrapes and recovers toner remaining on the photosensitive drum 662 after transfer.

Similar to the image forming subsystem 150A, a double-sided image forming operation by the image forming subsystem 150C can be executed by controlling conveyance of the transfer material P in accordance with a combination of the paper conveyance unit and paper feed unit.

(Command Sequence in Image Forming Operation)

Communication data of the printer engine controller 105, the image forming controller 160 in the image forming subsystem 150, the platform controller 65 in the paper conveyance platform 60, and the power unit 90, and the timings of the communication data will be explained.

Figure 18A:
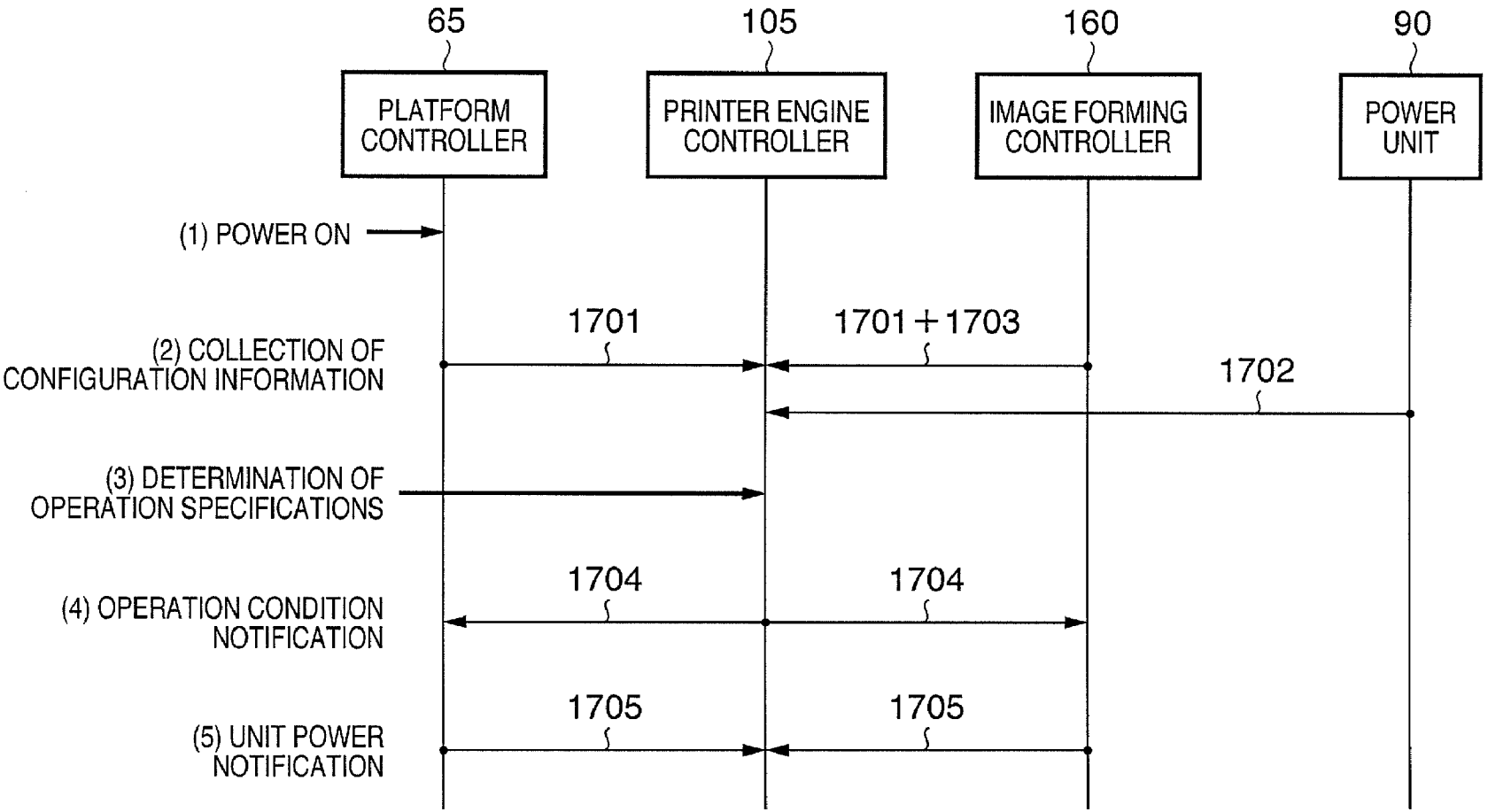
Figure 18B:
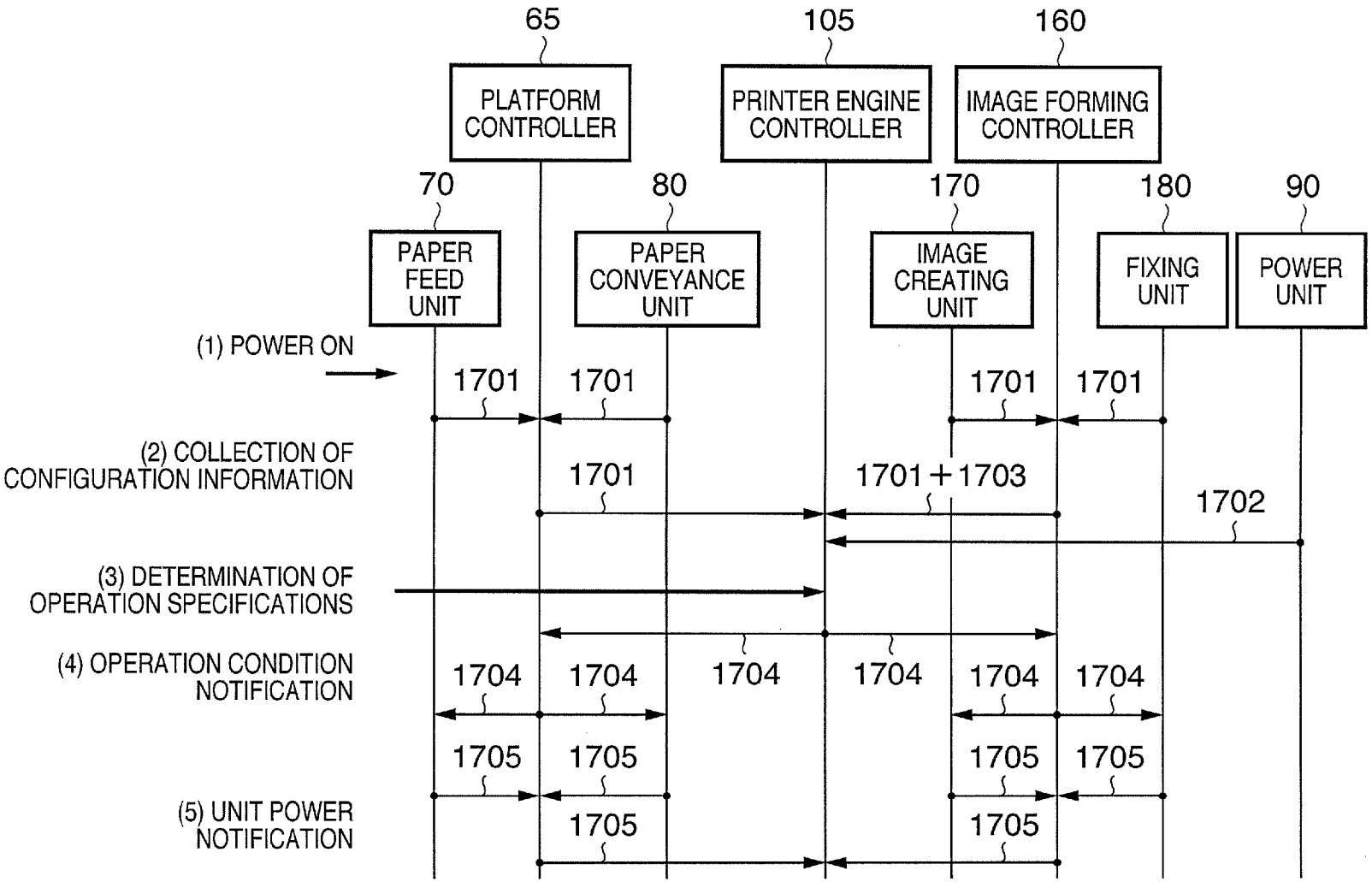

FIGS. 17A and 17B are views showing parameters in configuration communication upon power-on immediately after the image forming apparatus 100, 101, or 102 receives power from the power unit 90 (FIG. 1). FIGS. 18A and 18B are ladder charts for explaining a command sequence upon power-on.

(A) Parameters in Configuration Communication upon Power-ON

In FIG. 17A, a data structure 1701 is configuration information which is shared between units and transmitted to the printer engine controller 105 upon power-on. The printer engine controller 105, platform controller 65, and image forming controller 160 start processing in response to power supply from the power unit 90. At this time, the platform controller 65 transmits data to the printer engine controller 105, and the image forming controller 160 similarly transmits data to the printer engine controller 105. The transmitted data contents notify the printer engine controller 105 of abilities of the platform controller 65 and image forming controller 160 serving as a subsystem and platform, respectively.

For example, the contents include a unit ID for determining a unit which transmits information. The contents may include information such as the process speed at which the unit can operate.

The process speed at which fixing is possible may change between the full-color mode and the monochrome mode even with the same transfer material depending on fixing conditions, transfer conditions, and the like when the image forming subsystem 150 can print in color. In order to accurately notify the printer engine controller 105 of the ability of the image forming subsystem, the printer engine controller 105 must be notified of a set of the value of a process speed in the full-color mode, that of a process speed in the monochrome mode, and the current color mode.

To the contrary, the paper conveyance platform hardly changes in transfer material conveyance ability between the full-color mode and the monochrome mode. In this case, the printer engine controller 105 is notified together with the process speed value that conditions are shared between the full-color and monochrome modes.

When the type of transfer material changes, fixing conditions and transfer conditions often change between, e.g., thick paper and plain paper. The printer engine controller 105 must be notified of a set of material conditions and a process speed for each type of transfer material. The fixing heater temperature for ensuring the fixing property also changes depending on the difference in color mode, material conditions, or the like. Thus, the printer engine controller 105 must be notified of data on an electric energy consumed by the unit under conditions, together with data on the color mode, material conditions, and the like.

Considering these requirements, configuration data has the data structure 1701 which notifies the printer engine controller 105 of information containing a set of a process speed, a prerequisite color mode, an electric energy consumption amount, and material conditions. For example, the data structure 1701 notifies the printer engine controller 105 of three process speeds. When a unit has one process speed, the data structure 1701 notifies the printer engine controller 105 of only this process speed.

The interval between transfer materials, i.e., the distance between sheets may also change between units depending on the sensor response time serving as a paper conveyance condition, the fixing condition, or the like. Thus, the data structure 1701 contains the distance between sheets as data to be notified.

In FIG. 17A, reference numeral 1702 denotes a data structure representing suppliable power data of which the power unit 90 notifies the printer engine controller 105. The image forming apparatus according to the present invention adopts the configuration of the paper conveyance platform 60 and the image forming subsystem 150 having an arbitrary ability. Configuration data on the total electric energy suppliable from the power unit 90 and the power system is important in determining whether to enable operationg the apparatus. The printer engine controller 105 is notified of the data structure 1702 upon power-on, similar to the data 1701.

In FIG. 17A, a data structure 1703 describes data to be notified as ability data of the image forming subsystem 150 by the image forming controller 160, other than data notified by the configuration data structure 1701. More specifically, the data structure 1703 describes configuration information, i.e., "4D" of the image forming subsystem 150A. For the color image forming subsystem 150A or 150B, ITOP signals for four colors must be generated at proper time intervals in order to develop and transfer images of the four colors. For this purpose, the data structure 1703 describes data "ITOP interval".

In registration with a transfer material, the color image forming subsystem sometimes requires the time until it develops and transfers images of the four colors and the leading edge of image data reaches the secondary transfer portion after generating an ITOP signal for controlling color image data. If necessary, the data structure 1703 must describe data on the required time as one of its data.

In FIG. 17B, reference numeral 1704 denotes operation condition information determined by the printer engine controller 105 for the image forming apparatus. For example, the printer engine controller 105 can derive, from the data structures 1701 to 1703, operation conditions under which all units can operate normally and the image forming apparatus 100, 101, or 102 can obtain stable performance.

The printer engine controller 105 can also hold several operation conditions as specified values in advance, and select operation conditions which match data collected from respective units. The operation condition information 1704 describes three process speeds and three PPMs (Print Per Minutes) in respective color modes under respective material conditions. If necessary, it is also possible to notify the printer engine controller 105 of a combination of an incompatible color mode and material.

In FIG. 17B, reference numeral 1705 denotes a data structure used when the printer engine controller 105 notifies the image forming controller 160 and platform controller 65 of operation conditions, and then the image forming controller 160 and platform controller 65 determine an electric energy consumption amount again under the notified conditions and notify the printer engine controller 105 of the electric energy consumption amount. The printer engine controller 105 can use this data when comparing a suppliable electric energy received from the power unit 90 by the data structure 1702 with the total electric energy consumed by respective units under determined conditions, and determining whether to permit or inhibit the operation or correcting conditions.

Parameters in configuration communication upon power-on have been described.

In the above description, control of units accessory to the paper conveyance platform 60 and image forming subsystem 150 assumes units having no their own control units, like CPUs. When accessory units have their own control units, they may notify the platform controller 65 and image forming controller 160 of the configuration data structure 1701, and the platform controller 65 and image forming controller 160 may communicate with the printer engine controller on the basis of the notification.

(B) Command Sequence of Configuration Information upon Power-ON

FIGS. 18A and 18B are ladder charts showing details of the command sequence of configuration information upon power-on. Reference numerals 1701 to 1705 shown in FIGS. 1SA and 18B correspond to pieces of information described with reference to FIGS. 17A and 17B. FIG. 18A shows a sequence when the paper conveyance platform 60 and image forming subsystem 150 form a system for storing and controlling ability information of units accessory to them.

After a power SW (not shown) is turned on and the power unit supplies power to each unit, the platform controller 65 and image forming controller 160 transmit ability information of the data structure 1701 to the printer engine controller 105. At this time, the image forming controller 160 also adds the data 1703 to the data 1701. Almost simultaneously with data communication, the power unit 90 transmits suppliable electric energy data based on the data structure 1702 to the printer engine controller 105.

The printer engine controller 105 determines operation conditions (e.g., process speeds and PPMs in respective color modes for respective materials) of the image forming apparatus on the basis of the received configuration data.

Then, the printer engine controller 105 transmits the determined operation conditions 1704 of the data structure shown in FIG. 17B to the platform controller 65 and image forming controller 160.

The platform controller 65 and image forming controller 160 recognize that units operate with the operation condition data 1704. The platform controller 65 and image forming controller 160 prepare for an image forming operation such as generation of operation parameters, and at the same time calculate again electric energy consumption amounts under the received operation conditions. The platform controller 65 and image forming controller 160 transmit the results to the printer engine controller on the basis of the data structure 1705.

By the above command sequence, a series of configuration communication processes upon power-on end.

FIG. 18B shows a sequence when units accessory to the paper conveyance platform 60 and image forming subsystem 150 have their own control units.

After the power SW (not shown) is turned on and the power unit supplies power to each unit, the paper feed unit 70 and paper conveyance unit 80 accessory to the platform controller 65 transmit ability information based on the data structure 1701 to the platform controller 65. Similarly, the fixing unit 180 accessory to the image forming controller 160 transmits ability information based on the data structure 1701 to the image forming controller 160. The image creating unit 170 also transmits the data 1701 to the image forming controller 160.

The platform controller 65 determines its ability information on the basis of the ability information transmitted from the paper feed unit 70 and paper conveyance unit 80.

The image forming controller 160 performs the same operation. Thereafter, the platform controller 65 transmits ability information based on the data structure 1701 to the printer engine controller 105. The image forming controller 160 transmits ability information based on the data structure 1703 in addition to the data structure 1701 to the printer engine controller 105. Almost simultaneously with data communication, the power unit 90 transmits suppliable electric energy data based on the data structure 1702 to the printer engine controller 105.

The printer engine controller 105 determines operation conditions (e.g., process speeds and PPMs in respective color modes for respective materials) of the image forming apparatus on the basis of the received configuration data.

Then, the printer engine controller 105 transmits the determined operation conditions 1704 of the data structure shown in FIG. 17B to the platform controller 65 and image forming controller 160.

The platform controller 65 and image forming controller 160 recognize that units operate with the operation condition data 1704. The platform controller 65 and image forming controller 160 transmit the information to the paper feed unit 70 and paper conveyance unit 80 accessory to the platform controller 65 and the image creating unit 170 and fixing unit 180 accessory to the image forming controller 160, respectively.

The paper feed unit 70, paper conveyance unit 80, image creating unit 170, and fixing unit 180 recognize that they operate under the received operation conditions. They prepare for an image forming operation such as generation of operation parameters, and calculate again electric energy consumption amounts under the received operation conditions. The paper feed unit 70, paper conveyance unit 80, image creating unit 170, and fixing unit 180 transmit the results to the platform controller 65 and image forming controller 160 on the basis of the data structure 1705, respectively.

The platform controller 65 and image forming controller 160 calculate total electric energy consumption amounts on the basis of the power consumption data transmitted from their accessory units.

The platform controller 65 and image forming controller 160 transmit the results to the printer engine controller on the basis of the data structure 1705. By the above command sequence, a series of configuration communication processes upon power-on end.

Figure 20A:
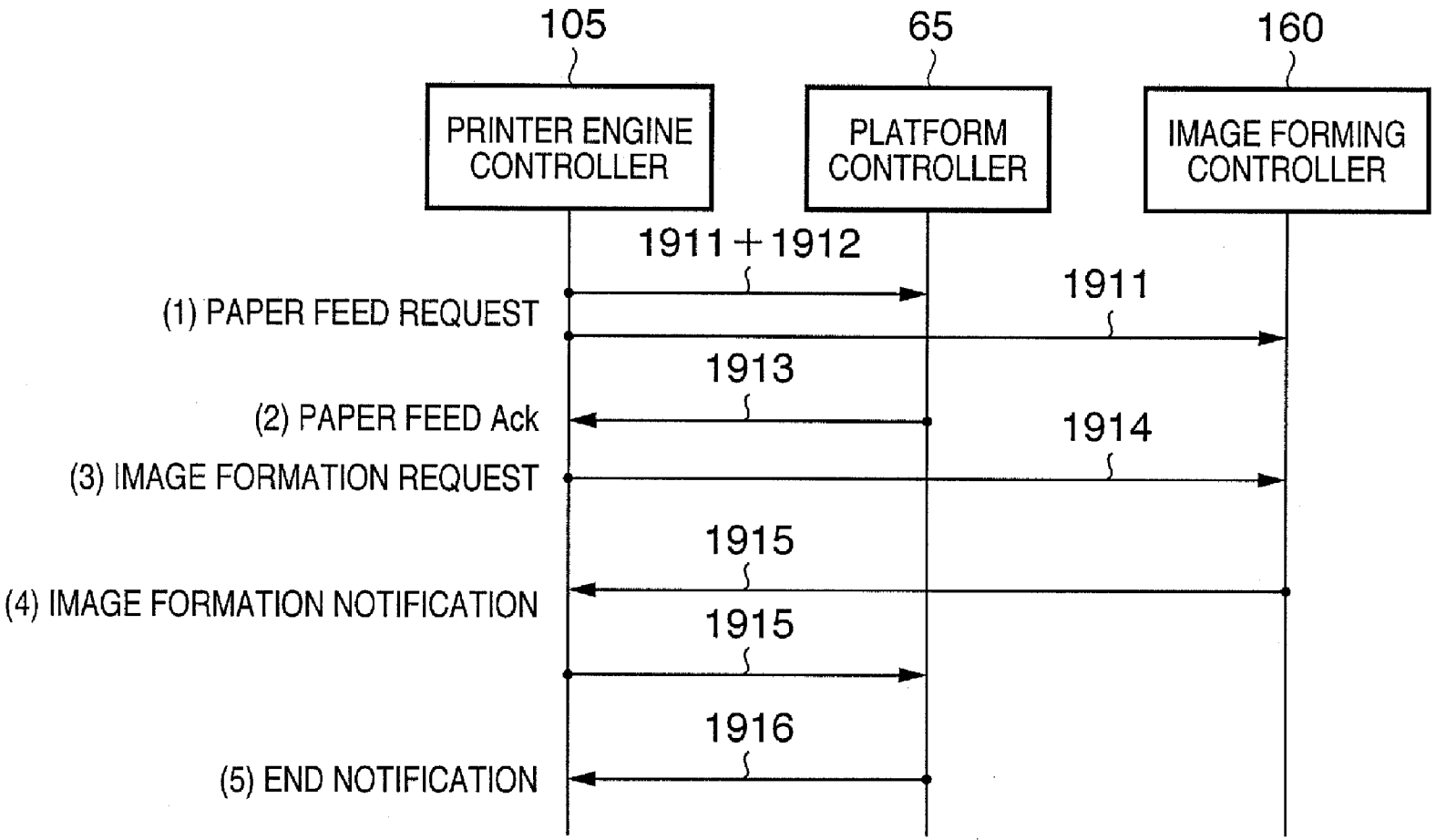
FIGS. 20A and 20B are ladder charts for explaining a command sequence in communication between units when the image forming apparatus forms an image.
Figure 20B:
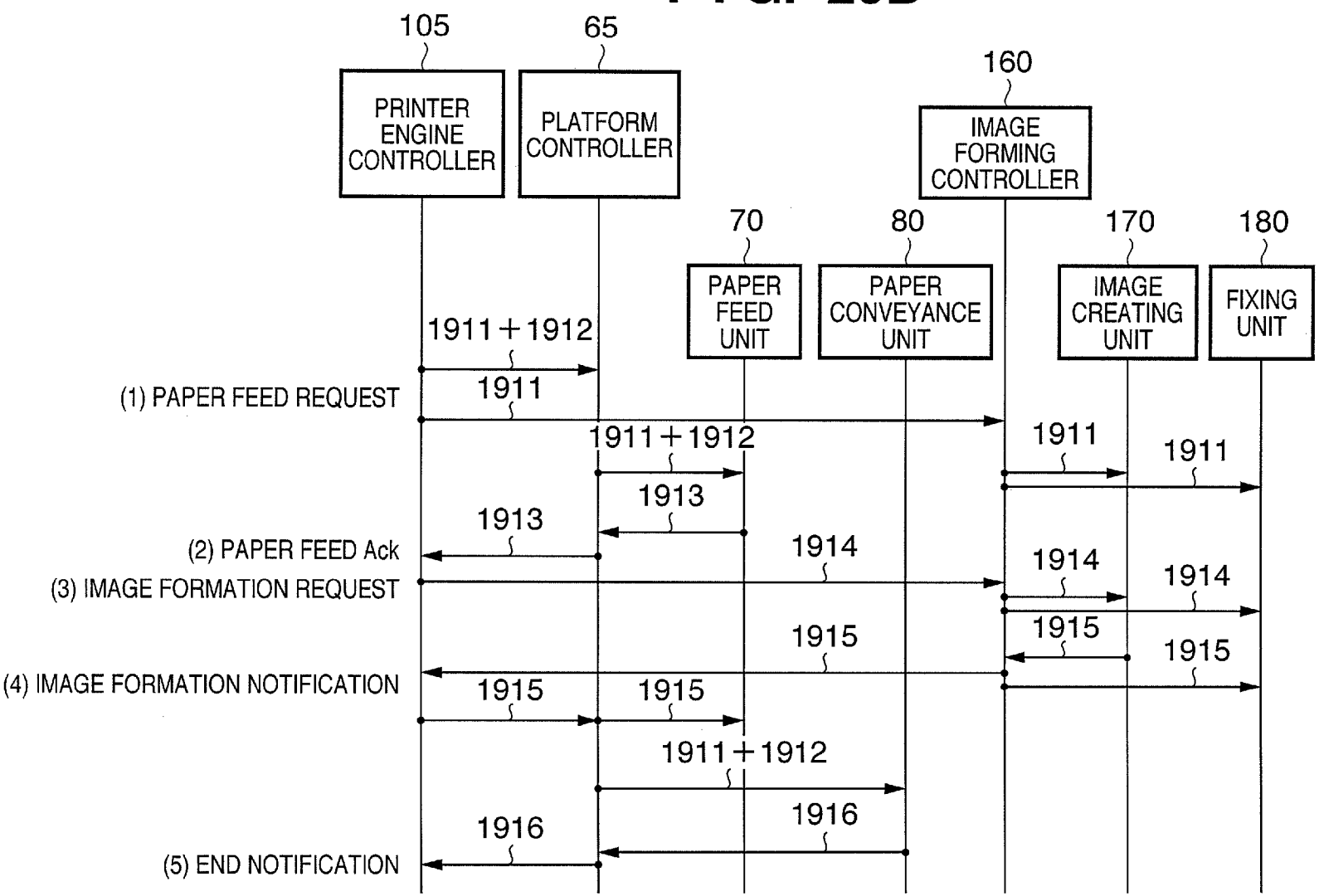

FIG. 19 is a view showing parameters in communication between units. FIGS. 20A and 20B are ladder charts for explaining a command sequence in communication between units when the image forming apparatus 100, 101, or 102 forms an image. Reference numerals 1911 to 1916 shown in FIGS. 20A and 20B correspond to pieces of information to be described with reference to FIG. 19.

In FIG. 19, the data structure 1911 is common information of paper feed request commands and parameters transmitted from the printer engine controller 105 to the platform controller 65 and image forming controller 160 in order to start conveying a transfer material in an image forming operation.

The data 1911 is a paper feed request, and can be transmitted to only the platform controller 65 or to the image forming controller 160, too, in order to reserve an image forming operation. In the first embodiment, the data 1911 is transmitted to the image forming controller 160, too, in order to reserve an image forming job.

As an example of data necessary for a paper feed start request, the data 1911 describes data such as a command ID representing a paper feed start request command, a page ID corresponding to image data to be requested, a color mode, a paper size, material information, and a print side (e.g., single-sided, double-sided upper surface, or double-sided lower surface).

The command data 1912 need not be notified as image forming operation reservation information to the image forming controller 160, but is necessary to control actual conveyance of a transfer material by the platform controller 65, and is not described in the command data 1911. More specifically, the command data 1912 describes paper feed stage information for starting paper feed, and a paper discharge direction necessary for paper conveyance by the paper conveyance unit.

The paper feed request ACK command data 1913 notifies the printer engine controller 105 of the result of determining the start of a paper feed operation by the platform controller 65 on the basis of the command data 1911 and 1912. Examples of parameters of the paper feed request ACK command data 1913 are a page ID, paper feed stage information, paper feed status information representing whether paper feed starts normally or is to start, and NG factor information when paper status information is NG representing that no paper feed starts. Examples of the NG factor are the absence of paper, an error, and a jam. In the first embodiment, the timing when the platform controller 65 transmits the paper feed request ACK command 1913 means the timing when an image forming operation can start.

When the platform controller 65 notifies the printer engine controller 105 of the start of paper feed by the paper feed request ACK command data 1913, the printer engine controller 105 transmits the image formation request command data 1914 to the image forming controller 160. The printer engine controller 105 issues this command when it becomes ready for image formation. Examples of parameters of the image formation request command data 1914 are a page ID and color mode.

After receiving the image formation request 1914, the image forming controller 160 notifies the printer engine controller by the image forming operation start notification command data 1915 that the image forming operation actually starts. The image forming controller 160 generates an ITOP signal serving as a trigger to start an image forming operation, and at the same time issues the command 1915 in accordance with the arrangement of the image forming controller 160. Upon reception of the command 1915, the printer engine controller 105 also transmits it to the platform controller 65 in order to control conveyance of a transfer material. An example of parameters of the command 1915 is a page ID.

The image formation/paper conveyance end notification command data 1916 notifies the printer engine controller 105 of the result of detecting that all the image forming operation and paper conveyance operation end. From this command, the printer engine controller 105 recognizes whether the image forming operation of an image (page) normally ends. Examples of parameters of the image formation/paper conveyance end notification command data 1916 are an end status notifying the printer engine controller 105 whether the operation normally ends, and an NG factor representing a factor in failing to end normally. Examples of the NG factor are an error and jam.

Details of parameters of command data communicated between the printer engine controller 105, the platform controller 65, and the image forming controller 160 along with an image forming operation have been described.

In the above description, control of units accessory to the paper conveyance platform 60 and image forming subsystem 150 assumes units having no their own control units, like CPUs.

When accessory units have their own control units, the platform controller 65 and image forming controller 160 can also transmit received command data to their accessory units at appropriate timings. Accessory units can also control part of an image forming operation, and if necessary, the platform controller 65 and image forming controller 160 can cause their accessory units to transmit the control results, collect them, and communicate with the printer engine controller.

FIGS. 20A and 20B are ladder charts showing details of a command sequence in an image forming operation.

The first embodiment will explain a case where a typical 1-page image forming operation starts and ends normally.

FIG. 20A is a ladder chart showing a sequence when the paper conveyance platform 60 and image forming subsystem 150 control their accessory units.

At the start of an image forming operation, the printer engine controller 105 transmits a paper feed request command to the platform controller 65 and image forming controller 160. The printer engine controller 105 transmits the data 1912 to the platform controller 65 in addition to the data 1911. The printer engine controller 105 transmits the data 1911 to the image forming controller 160.

Upon reception of the paper feed request command, the platform controller 65 determines whether paper feed can start, and transmits the determination result to the printer engine controller 105 by the data structure of the paper feed request ACK command 1913. The condition to determine that paper feed can start is, e.g., a condition that a transfer material is present or a condition that no fed transfer material jams.

The printer engine controller 105 receives the paper feed request ACK command 1913, and if it recognizes that the platform controller 65 determines that paper feed can start, transmits the image formation start request 1914 of the data structure shown in FIG. 19 to the image forming controller 160.

Upon reception of the image formation start request 1914, the image forming controller 160 determines whether the time of an image forming interval obtained from a PPM set value has elapsed after image formation. If the image forming controller 160 determines that image formation is possible, it generates an ITOP signal, starts an image forming operation, and transmits the image forming operation start notification 1915 of the data structure shown in FIG. 19 to the printer engine controller 105.

The printer engine controller 105 receives the image forming operation start notification 1915, recognizes that image formation starts normally, and also transmits the data 1915 to the platform controller 65 in order to control conveyance of a transfer material.

Upon reception of the data 1915, the platform controller 65 recognizes that the registration rollers control conveyance of a transfer material so as to control transfer at the secondary transfer portion.

The image forming controller 160 operates the registration rollers a predetermined time after the generated ITOP signal by controlling the timing to make the position of a developed image coincide with that of a transfer material. At the same time, the image forming controller 160 transmits a registration signal to the platform controller 65, and notifies it that conveyance of the transfer material actually starts. Upon reception of this notification, the platform controller 65 starts driving the load on the upstream side of the registration rollers for the transfer material.

After the platform controller 65 and image forming controller 160 control image formation and paper conveyance, the transfer material moves from the image forming subsystem 150 to the paper conveyance platform 60. When the platform controller 65 recognizes that the paper conveyance platform 60 discharges the transfer material outside the apparatus, it issues the image formation/paper conveyance end notification command 1916 of the data structure shown in FIG. 19 to the printer engine controller 105.

Upon reception of the image formation/paper conveyance end notification command 1916, the printer engine controller 105 recognizes the end of a series of image forming operations for the target image on the transfer material.

Details of the command sequence from the start to end of a 1-page image forming operation when the paper conveyance platform 60 and image forming subsystem 150 control their accessory units have been described.

FIG. 20B shows a sequence when units accessory to the paper conveyance platform 60 and image forming subsystem 150 have their own control units.

At the start of an image forming operation, the printer engine controller 105 transmits a paper feed request command to the platform controller 65 and image forming controller 160. The printer engine controller 105 transmits the data 1912 to the platform controller 65 in addition to the data 1911. The printer engine controller 105 transmits the data 1911 to the image forming controller 160.

Upon reception of the paper feed request command, the platform controller 65 directly transmits the data 1912 to the paper feed unit 70 in addition to the received paper feed request command 1911.

The image forming controller 160 directly transmits the received paper feed request command 1911 to the image creating unit 170 and fixing unit 180.

Upon reception of the paper feed request command, the paper feed unit 70 determines whether paper feed can start, and transmits the determination result to the platform controller 65 by the data structure of the paper feed request ACK command 1913. The condition to determine that paper feed can start is, e.g., a condition that a transfer material is present or a condition that no fed transfer material jams.

In accordance with the paper feed request ACK command received from the paper feed unit 70, the platform controller 65 similarly transmits, to the printer engine controller 105, the paper feed request ACK command 1913 of the data structure shown in FIG. 19 representing the same the determination result.

The printer engine controller 105 receives the paper feed request ACK command 1913, and if it recognizes that the platform controller 65 determines that paper feed can start, transmits the image formation start request 1914 of the data structure shown in FIG. 19 to the image forming controller 160.

The image forming controller 160 directly transmits the received image formation start request command to the image creating unit 170 and fixing unit 180.

Upon reception of the image formation start request 1914, the image creating unit 170 determines whether the time of an image forming interval obtained from a PPM set value has elapsed after image formation. If the image creating unit 170 determines that image formation is possible, it generates an ITOP signal, starts an image forming operation, and transmits the image forming operation start notification 1915 of the data structure shown in FIG. 19 to the image forming controller 160.

The image forming controller 160 transmits, to the printer engine controller 105, the same contents as the image forming operation start notification 1915 transmitted from the image creating unit 170. Since the image creating unit 170 starts forming an image, the image forming controller 160 similarly transmits the image forming operation start notification 1915 to the fixing unit 180 so as to notify it that a transfer material is to be conveyed. The printer engine controller 105 receives the image forming operation start notification 1915, recognizes that image formation starts normally, and also transmits the data 1915 to the platform controller 65 in order to control conveyance of a transfer material.

Upon reception of the data 1915, the platform controller 65 directly transmits the same data as the received image forming operation start notification 1915 to the paper feed unit 70.

Upon reception of the data 1915, the platform controller 65 and paper feed unit 70 recognize that the registration rollers control conveyance of a transfer material so as to control transfer at the secondary transfer portion. The image creating unit 170 operates the registration rollers a predetermined time after the ITOP signal by controlling the timing so as to make the position of a developed image coincide with that of a transfer material. At the same time, the image creating unit 170 transmits a registration signal to the platform controller 65 via the image forming controller 160, and notifies the platform controller 65 that conveyance of the transfer material actually starts. Upon reception of this notification, the platform controller 65 also transfers the notification to the paper feed unit 70 without any delay. The paper feed unit 70 starts driving the load on the upstream side of the registration rollers for the transfer material.

The platform controller 65 transmits a paper feed start request command to the paper conveyance unit 80 a predetermined time after the timing when the platform controller 65 receives the image forming operation start notification 1915. By this command, the platform controller 65 causes the paper conveyance unit to prepare for reception of the transfer material.

The paper conveyance unit 80 receives and conveys the transfer material, and when recognizing that the transfer material is finally discharged outside the apparatus, issues the image formation/paper conveyance end notification command 1916 of the data structure shown in FIG. 19 to the platform controller 65.

Upon reception of the image formation/paper conveyance end notification command 1916 from the paper conveyance unit 80, the platform controller 65 transmits the notification 1916 of the same contents to the printer engine controller 105.

Upon reception of the image formation/paper conveyance end notification command 1916, the printer engine controller 105 recognizes the end of a series of image forming operations on the transfer material.

Details of the command sequence from the start to end of a 1-page image forming operation when units accessory to the paper conveyance platform 60 and image forming subsystem 150 have their own control units have been described.

(Image Registration Operation when Exchanging Image Forming Subsystem)

An image registration operation when exchanging the image forming subsystem 150 in the above-described arrangement will be described.

Figure 30:
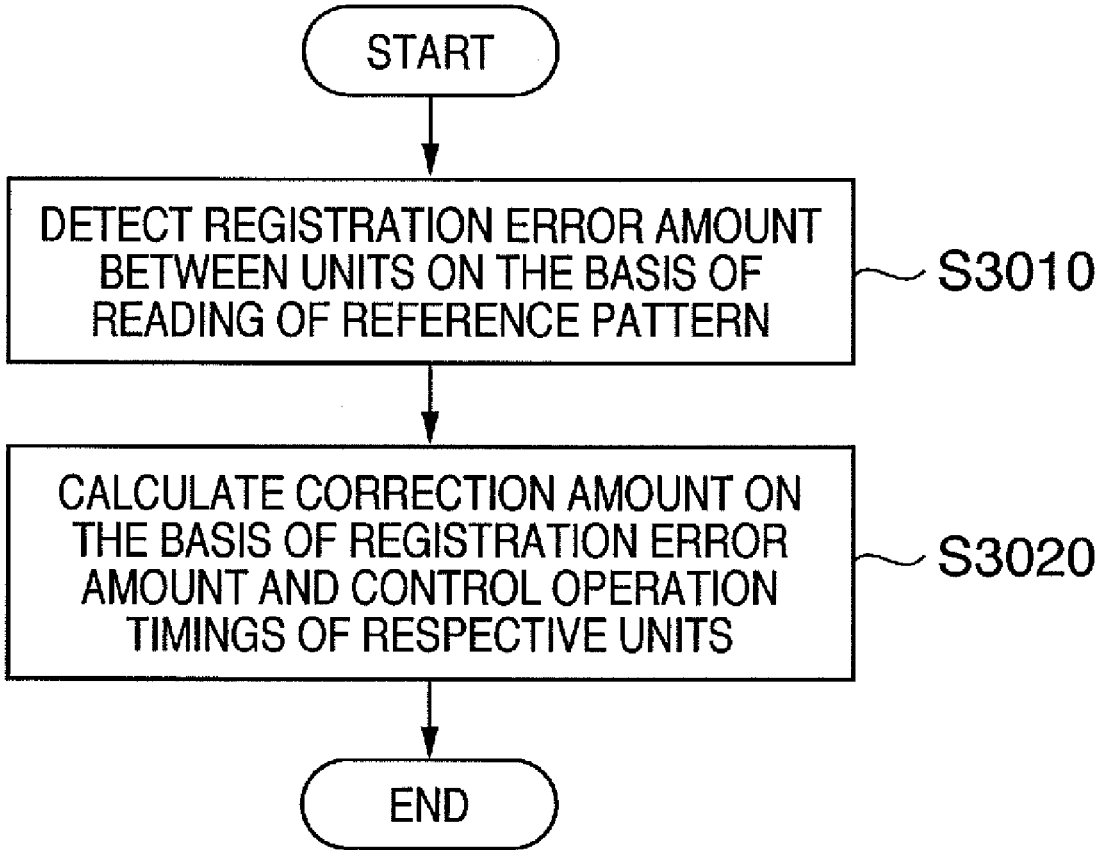
FIG. 30 is a flowchart for explaining the sequence of an image forming apparatus control method according to the first embodiment.

A flowchart shown in FIG. 30 is executed as an image forming apparatus control method according to the first embodiment.

A registration error amount between the positioned image forming unit (image forming subsystem 150) and the paper feed conveyance unit (paper conveyance platform 60) is detected on the basis of reading of a reference pattern 1000 (S3010).

The correction amount is calculated on the basis of the registration error amount detected in the process of step S3010. The operation timings of the image forming unit and paper feed conveyance unit are controlled in accordance with the correction amount (S3020).

Concrete contents of the above control method will be explained.

Figure 22:
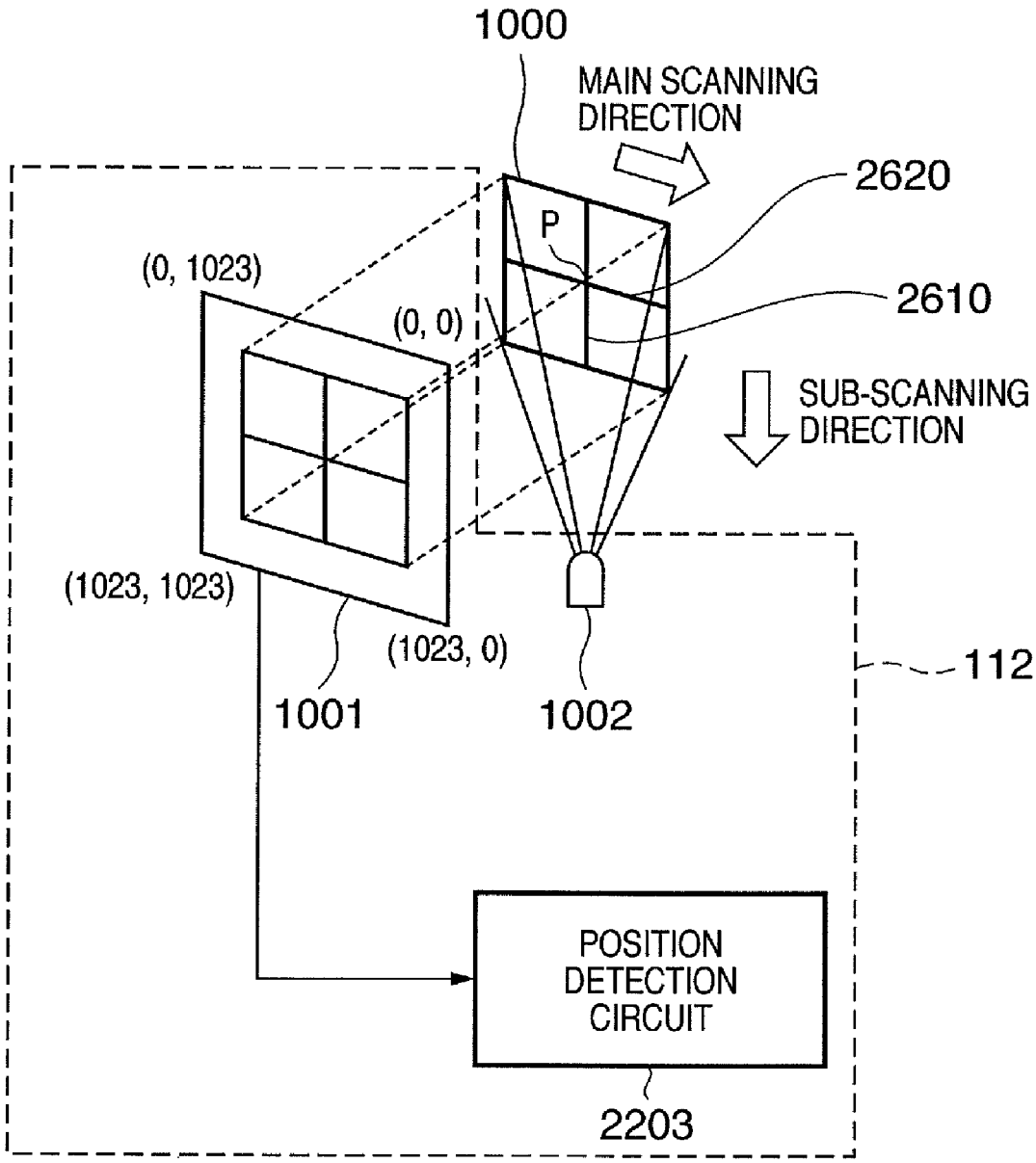
FIG. 22 is a view showing the arrangement of a position detector arranged near the fitting portion between the paper conveyance platform and the image forming subsystem.

FIG. 22 is a view showing the arrangement of the position detector 112 arranged near the fitting portion between the paper conveyance platform 60 and the image forming subsystem 150 (see FIGS. 4A and 4B for the fitting state). The position detector 112 comprises an LED 1002, area sensor 1001, and position detection circuit 2203.

The reference surface 113 of the image forming subsystem 150 has the reference pattern 1000 of a 2×2 matrix. The LED 1002 of the position detector 112 arranged on the paper conveyance platform 60 illuminates the reference pattern 1000. The area sensor 1001 reads light reflected by the reference pattern 1000. From the read signal from the area sensor 1001, the position detection circuit 2203 detects registration errors of the reference pattern from a reference position in the main scanning and sub-scanning directions.

A vertical center line 2610 of the reference pattern 1000 represents the image center position (image reference position) of the image forming subsystem 150, whereas a horizontal center line 2620 represents the paper conveyance reference position of the image forming subsystem 150. The position detection circuit 2203 can detect registration errors of the reference pattern from reference positions (image reference position and paper conveyance reference position) on the basis of the differences between the image reference position and paper conveyance reference position and the measurement results of the area sensor 1001.

The area sensor 1001 is an image sensor of 1,024×1,024 pixels, and its optical magnification is so adjusted as to set one pixel to 42.3 μm. The area sensor 1001 makes its center pixel (512,512) coincide with the image center (center in the main scanning direction) of the image forming subsystem 150 and the paper conveyance reference (center in the paper conveyance direction) of the paper conveyance platform 60.

Pixel numbers are assigned such that (0,0) represents an upper right pixel, (0,1023) represents an upper left pixel, (1023,0) represents a lower right pixel, and (1023,1023) represents a lower left pixel. When the paper conveyance platform 60 and image forming subsystem 150 are ideally coupled, the center intersection P of the reference pattern 1000 is imaged at the coordinates (512,512) of the area sensor 1001.

The position detection circuit 2203 receives an output from the area sensor 1001, converts it into digital data, and detects the projection position of the reference pattern 1000. The position detection circuit 2203 extracts the edge of the data output from the area sensor 1001, detects the two edges of the center line segment of the reference pattern 1000 in the main scanning and sub-scanning directions, and determines the center position of the reference pattern 1000.

Determination of the center position is based on the average value of a plurality of points in the main scanning and sub-scanning directions in order to prevent a decrease in determination precision due to contamination of the reference pattern 1000 and area sensor 1001.

Figure 23:
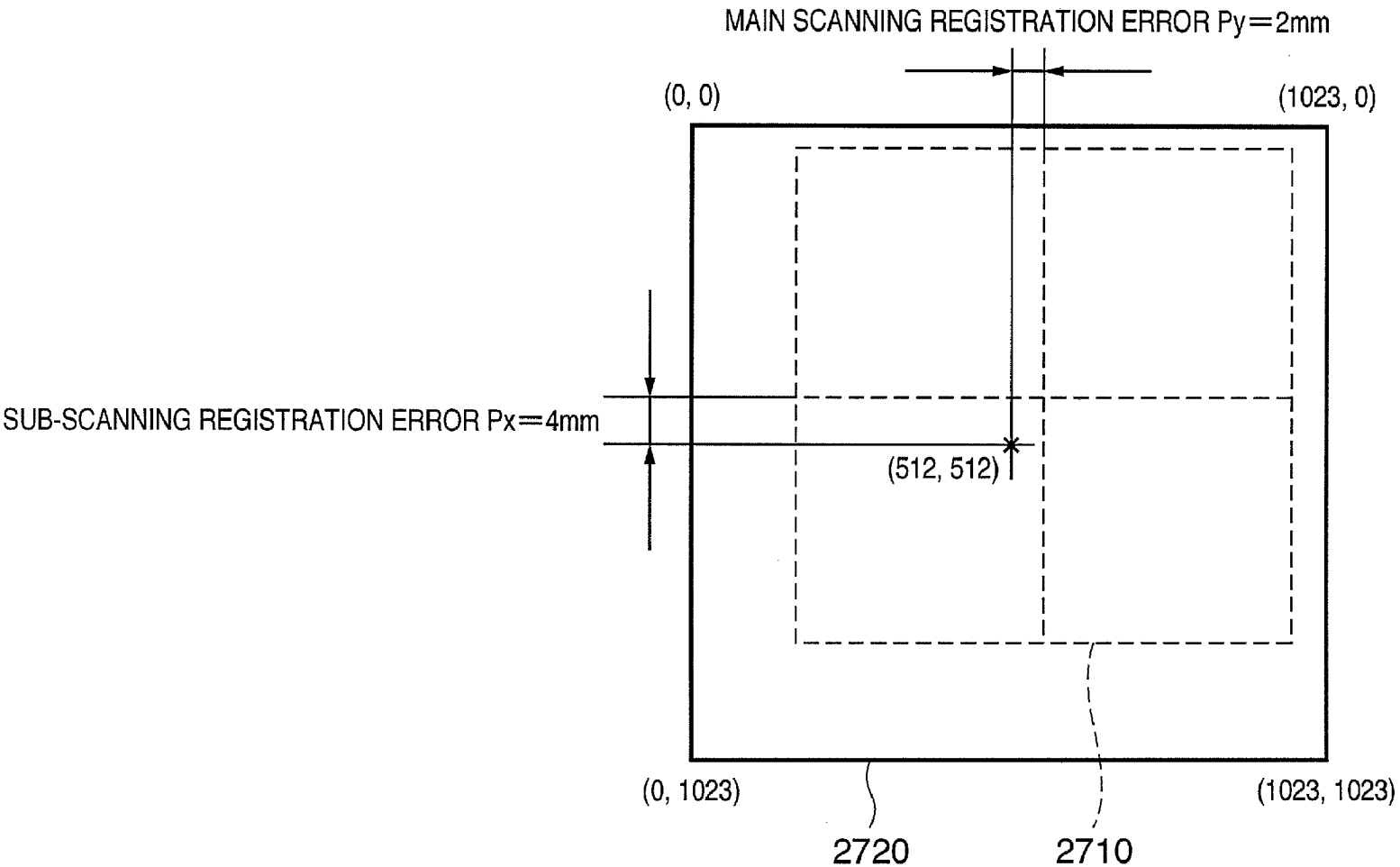
FIG. 23 is a view showing the relationship between the detection position and the reference position.

FIG. 23 is a view showing the relationship between a detection position 2710 and a reference position 2720. FIG. 23 shows that the center coordinates in the area sensor 1001 and the projection pattern at the detection position 2710 shift from each other by 2 mm in the main scanning direction and 4 mm in the sub-scanning direction. The position detection circuit 2203 detects the registration errors (2 mm in the main scanning direction and 4 mm in the sub-scanning direction), and notifies the platform controller 65 of them. The platform controller 65 manages the registration error amounts as Py (mm) in the main scanning direction and Px (mm) in the sub-scanning direction.

The registration error amount is detected when turning on the image forming apparatus. The platform controller 65 notifies the printer engine controller 105 of the registration error amount as the above-mentioned configuration information upon power-on.

The printer engine controller 105 creates image formation position correction data and paper conveyance correction data on the basis of the registration error amount. The printer engine controller 105 notifies the image forming controller 160 of the image forming subsystem 150 of the image formation position correction data, and the platform controller 65 of the paper conveyance platform 60 of the paper conveyance correction data.

(Correction in Main Scanning Direction)

Image formation position correction data created by the printer engine controller 105 aims to correct a registration error amount in the main scanning direction by changing the start position of image formation. The registration error amount can be corrected by delaying generation from a BD signal input from the image creating unit to a PBD signal to be output to the controller 200 by the timing generator 315 of the image forming controller 160 (which typifies the image forming controllers 160A, 160B, and 160C).

Figure 24:
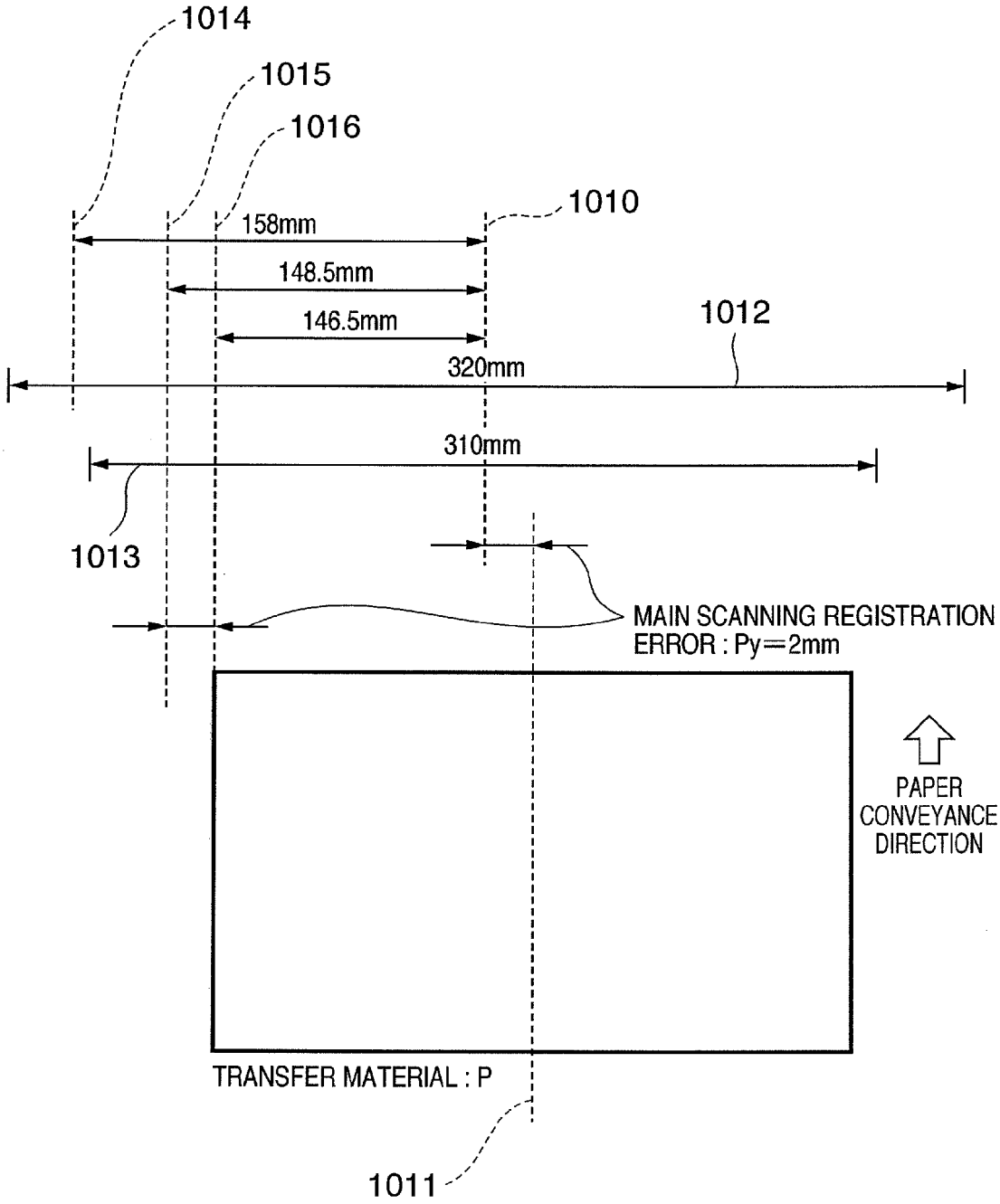
FIG. 24 is a view for explaining position correction in the main scanning direction.

FIG. 24 is a view for explaining position correction in the main scanning direction.

Reference numeral 1010 denotes a center of the image forming subsystem 150 in the main scanning direction; and 1011, a center of the paper conveyance platform 60 in the main scanning direction. In the example of FIG. 23, the difference between the centers 1010 and 1011 is the main scanning position error amount Py=(2 mm).

An exposable area 1012 represents an effective area which can be irradiated with a laser beam. The exposable area 1012 is 320 mm wide, i.e., 160 mm wide on either side of the center 1010 of the image forming subsystem in the main scanning direction.

An effective developing area 1013 represents an image formable area, and is 310 mm wide, i.e., 155 mm on either side of the center 1010 of the image forming subsystem in the main scanning direction. The effective developing area 1013 is generally determined by the effective area of the photosensitive drum.

Reference numeral 1014 denotes a position of a beam detection sensor (BD sensor) for detecting a laser beam in the main scanning direction. The BD sensor functions as a beam detection signal generation circuit, and can generate a beam detection signal upon detecting a laser beam. The BD sensor falls within the exposable area but outside the effective developing area, and is spaced apart by 158 mm from the center 1010 of the image forming subsystem 150 in the main scanning direction.

Reference numeral 1015 denotes an output position of a sync signal (PBD signal) output from the timing generator 315 in the main scanning direction before registration error correction. The position of the reference numeral 1015 represents a PBD signal position.

The timing generator 315 can control the PBD signal position denoted by the reference numeral 1015 before correction by the size of the transfer material P. When the transfer material P is an A4 material (210×297 mm), the timing generator 315 receives a BD signal, performs a delay process by 9.5 mm, and generates a PBD signal. As a result, the timing generator 315 outputs the PBD signal at a position of 148.5 mm (158 mm−9.5 mm) apart from the center 1010 of the image forming subsystem 150 in the main scanning direction.

In FIG. 24, the registration error in the main scanning direction is Py=2 mm. In order to correct this registration error amount, the timing generator 315 controls the timing to delay the output position of the PBD signal.

Reference numeral 1016 denotes a corrected PBD signal position. In order to correct the PBD signal position, the platform controller 65 notifies the printer engine controller 105 of the registration error amount Py in the main scanning direction=2 mm as configuration information upon power-on. The printer engine controller 105 creates image formation position correction data on the basis of the registration error amount in the main scanning direction, and notifies the image forming controller 160 of it. The timing generator 315 of the image forming controller 160 changes the PED signal delay amount from 9.5 mm to 11.5 mm on the basis of the notified image formation position correction data, and sets the corrected PBD signal position 1016.

The corrected PBD signal position 1016 is set to a position of 146.5 mm apart from the center 1010 of the image forming subsystem 150 in the main scanning direction. The end of the transfer material P matches the corrected PBD signal position 1016, as shown in FIG. 24. This procedure can correct a registration error generated in the main scanning direction.

(Correction in Sub-Scanning Direction)

Paper conveyance correction data created by the printer engine controller 105 aims to correct a registration error amount in the sub-scanning direction at the paper feed interval. The printer engine controller 105 notifies the platform controller 65 of data on a calculated process speed (recording material conveyance speed) and a paper conveyance path length as the paper conveyance correction data. Based on these data, the platform controller 65 adjusts the paper feed timing and paper feed interval, and thereby corrects a registration error amount in the sub-scanning direction.

Figure 25:
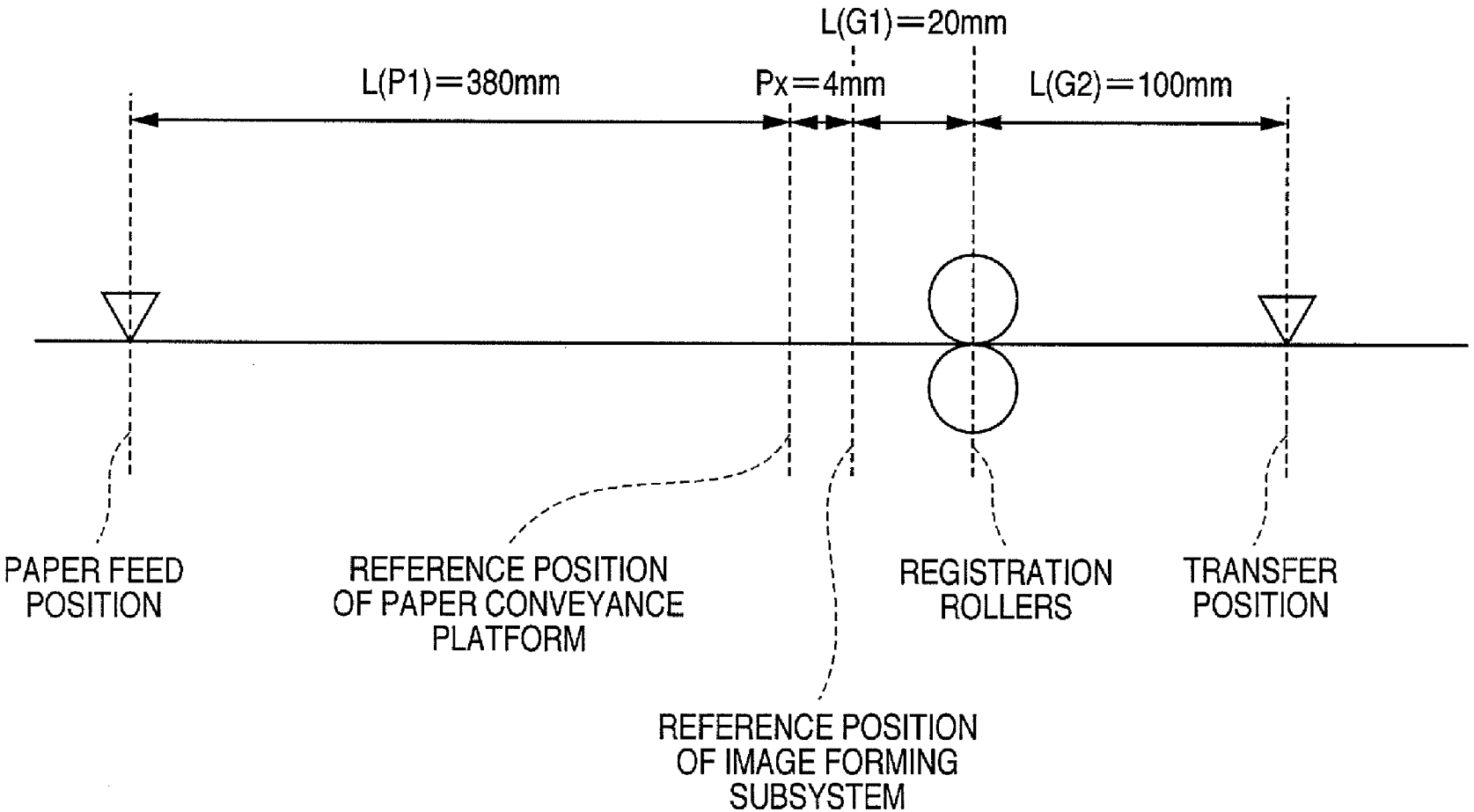
FIG. 25 is a view showing a concrete positional relationship between paper feed and transfer.

FIG. 25 is a view showing a concrete positional relationship between paper feed and transfer. The distance L(P1) from the paper feed position to the reference position of the paper conveyance platform 60 is 380 mm. The registration error amount Px in the sub-scanning direction is 4 mm. The distance L(G1) from the reference position of the image forming subsystem 150 to the registration roller in the image forming subsystem 150 is 20 mm. The distance L(G2) from the registration roller to the transfer position is 100 mm.

The total distance L(PG) from the paper feed position to the registration roller is 404 mm. The ideal value of the distance L(PG) is 404 mm—the registration error amount: 4 mm=400 mm, and is defined as L(PG0).

Letting L(ALL) be the total distance from the paper feed position to the transfer position, the respective distances meet the following relations (1) to (3):

$$L(PG) = L(P1) + Px + L(G1) \tag{1}$$

$$\begin{aligned} L(PG0) &= L(PG) - Px \\ &= L(P1) + F(G1) \end{aligned} \tag{2}$$

$$\begin{aligned} L(\mathrm{ALL}) &= L(P1) + Px + L(G1) + L(G2) \\ &= L(PG) + L(G2) \end{aligned} \tag{3}$$

From the relations (1) to (3), L(P1) is a value (constant value) guaranteed in the paper conveyance platform 60, and L(G1) and L(G2) are values (constant values) guaranteed in the image forming subsystem 150. Since the variable factor in coupling between the image forming subsystem and the platform is only the registration error amount Px in the sub-scanning direction, the paper conveyance distance L(PG) from the paper feed position to the registration roller is the variable factor.

When the paper conveyance speed Ps (mm/s) is 100 mm/s, the paper conveyance time from the paper feed position to the registration roller is given by the following equations (4) and (5).

The paper conveyance time (T(PG)) from paper feed to the registration roller is given by $$T(PG)=L(PG)/Ps=404/100=4.04\ \mathrm{s} \tag{4}$$

The ideal value (T(PG0)) of the paper conveyance time from paper feed to the registration roller is given by $$T(PG0)=L(PG0)/Ps=40/100=4\ \mathrm{s} \tag{5}$$

From equations (4) and (5), an extra paper conveyance time of 40 ms is necessary owing to the registration error in the sub-scanning direction.

The platform controller 65 calculates a time difference from the ideal value by the above equations on the basis of paper conveyance path length data containing a registration error amount and the recording material conveyance speed that are notified as configuration information from the printer engine controller 105. The platform controller 65 can adjust the paper feed timing and the paper time interval in order to maintain the image formation position, productivity in a continuous operation, and the output time of the first recording material.

Figure 26:
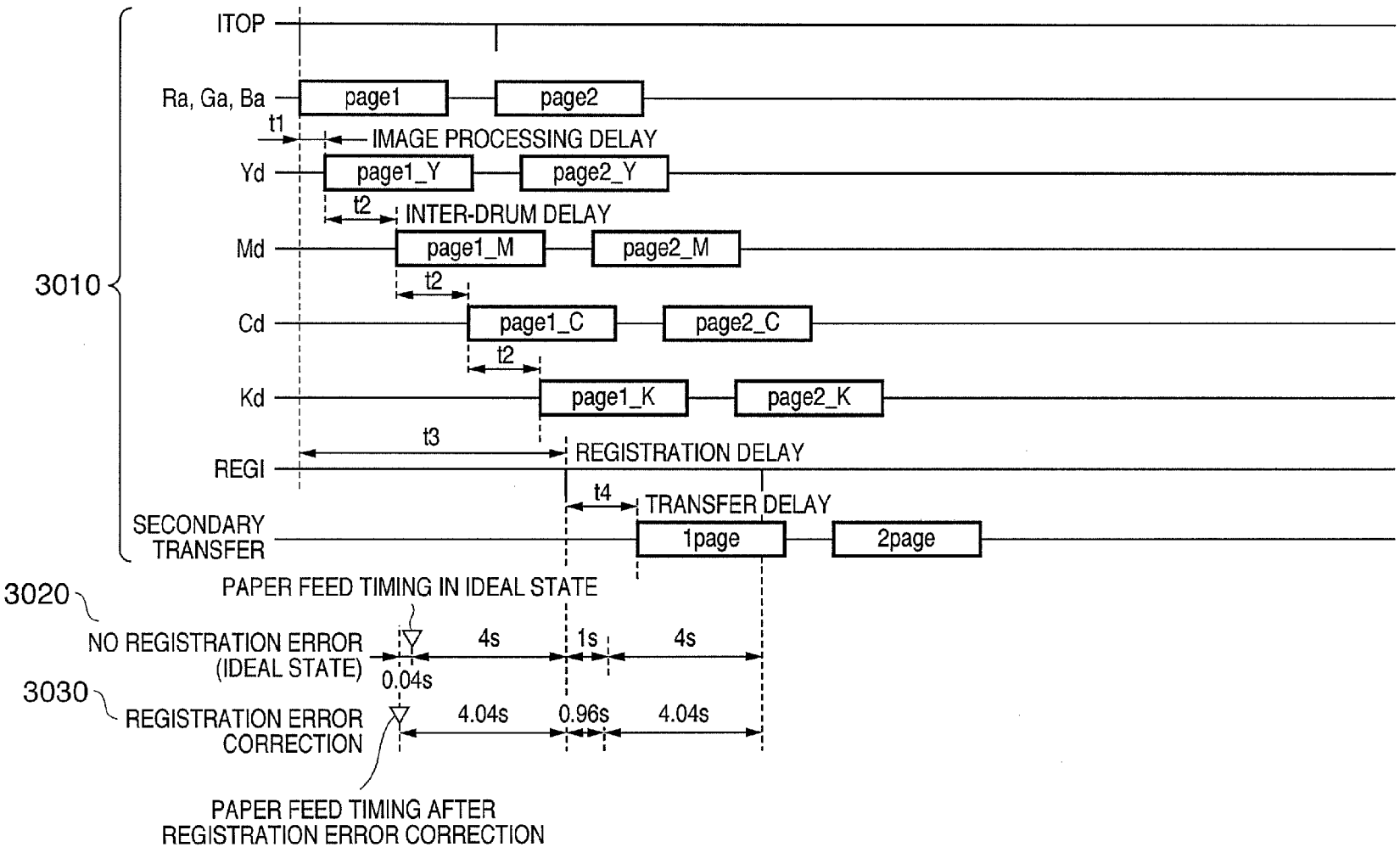
FIG. 26 is a timing chart for correcting a registration error in the sub-scanning direction (paper conveyance correction)

FIG. 26 is a timing chart for correcting a registration error in the sub-scanning direction (paper conveyance correction). This timing chart is obtained by adding paper feed/paper conveyance timings 3020 and 3030 to an image formation timing chart 3010 (corresponding to the timing chart in FIG. 6) of the full-color image forming subsystem 150A.

Note that the timing chart for explaining paper conveyance correction is described by exemplifying a combination of the paper conveyance platform 60 and full-color image forming subsystem 150A. However, the gist of the present invention is not limited to this combination. That is, paper conveyance correction can also apply to a combination of the paper conveyance platform 60 and the image forming subsystem 150B or 150C.

As described above, the REGI signal is a timing signal for starting driving the registration roller. The timing of the paper conveyance time T(PG) before the REGI signal of the first page is a paper feed timing adjusted by the platform controller 65.

In FIG. 26, reference numeral 3020 denotes a paper feed/paper conveyance timing in the absence of any registration error (ideal state); and 3030, a paper feed/paper conveyance timing when correcting a registration error amount of 4 mm. Since an extra, paper conveyance time of 40 ms is necessary owing to the registration error in the sub-scanning direction, the platform controller 65 starts feeding a recording material 0.04 (s) early from the ideal state.

The REGI signal interval—the paper conveyance time L(PG)=the paper time interval, which is 1 (s) ideally. In order to correct the registration error amount even at the paper feed time interval, the platform controller 65 shortens the paper time interval by 0.04 (s) to 0.96 (s), and controls the paper feed start timing of the next recording material. In order to correct the paper conveyance time which becomes longer due to the registration error in the sub-scanning direction, the platform controller 65 starts feeding a recording material earlier then the paper feed timing in the ideal state.

The paper feed interval must be maintained in order to maintain productivity without limiting processes by the image forming apparatus. The platform controller 65 hastens the paper feed start timing by the prolongation (40 ms) of the paper conveyance time owing to a registration error, shortens the paper feed time interval, and thereby corrects a registration error in the sub-scanning direction.

This process is done for the REGI signal generated by the timing generator 315 of the image forming controller 160. The same control method also applies to the color image forming subsystem 150B and monochrome image forming subsystem 150C.

The first embodiment can provide an image forming technique which implements operation specifications desired by a user by a combination of subsystems.

Even when a registration error occurs between subsystems upon exchanging or detaching a subsystem, the registration error can be corrected to form an image and maintain the image formation quality.

Even when exchanging or detaching a subsystem, a delay of the output time of the first recording material or a delay of the output time of recording materials in a continuous operation can be corrected, preventing a decrease in the throughput of the image forming apparatus.

Second Embodiment

The second embodiment of the present invention will describe registration error correction when a paper conveyance platform 60 comprises registration rollers.

Figure 27:
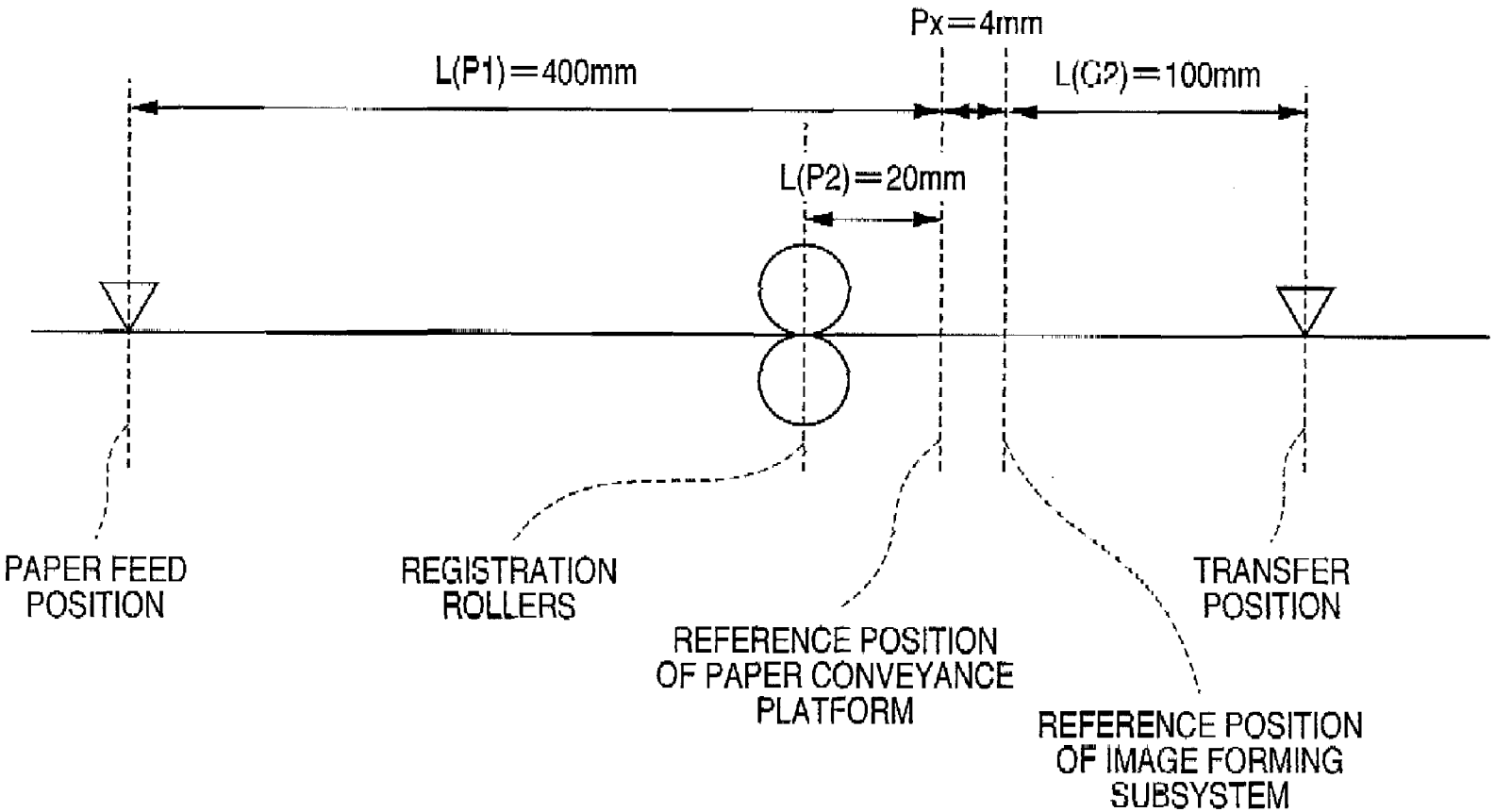
FIG. 27 is a view showing a concrete positional relationship between paper feed and transfer.

FIG. 27 is a view showing a concrete positional relationship between paper feed and transfer. This positional relationship is different from that shown in FIG. 25 in the first embodiment in that the registration error amount Px exists between the registration roller and the transfer position.

As a concrete distance, the distance L(P1) from the paper feed position to the reference position of the paper conveyance platform 60 is 400 mm. The distance L(P2) from the registration roller to the reference position of the paper conveyance platform 60 is 20 mm. The registration error amount Px is 4 mm. The distance L(G2) from the reference position of an image forming subsystem 150 to the transfer position is 100 mm.

The distance L(P1) from the paper feed position to the reference position of the paper conveyance platform is a value (constant value) guaranteed in the paper conveyance platform 60.

The total distance L(PG2) from the registration roller to the transfer position is 124 mm (=L(P2)+Px+L(G2)). The ideal value of the total distance from the registration roller to the transfer position is the total distance L(PG2)—the registration error amount Px in the sub-scanning direction=120 mm.

Hence, the total distance L(PG2) containing the registration error amount Px is a variable factor in coupling between the image forming subsystem and the platform.

When the paper conveyance speed is 100 mm/s, the paper conveyance time (T(PG2)) from the registration roller to the transfer position is given by $$T(PG2)=L(PG2)/100=1.24\text{ ms} \tag{6}$$

When the paper conveyance speed is 100 mm/s, the paper conveyance time (T(PG0)) in the ideal state free from any registration error amount Px in the sub-scanning direction is given by $$T(PG0)=120/100=1.2\text{ ms} \tag{7}$$

From equations (6) and (7), the paper conveyance time (T(PG2)) in the presence of the registration error amount is longer by an extra paper conveyance time of 40 ms than the paper conveyance time (T(PG0)) in the ideal state.

An image forming controller 160 calculates the time difference between the paper conveyance times (T(PG0) and T(PG2)) by the above equations on the basis of the paper conveyance path length containing a registration error amount and the paper conveyance speed that are notified as configuration information from a printer engine controller 105. A timing generator 315 adjusts an REGI signal generation timing on the basis of the time difference.

A platform controller 65 adjusts the paper feed timing in order to maintain the output time of the first recording material.

Figure 28:
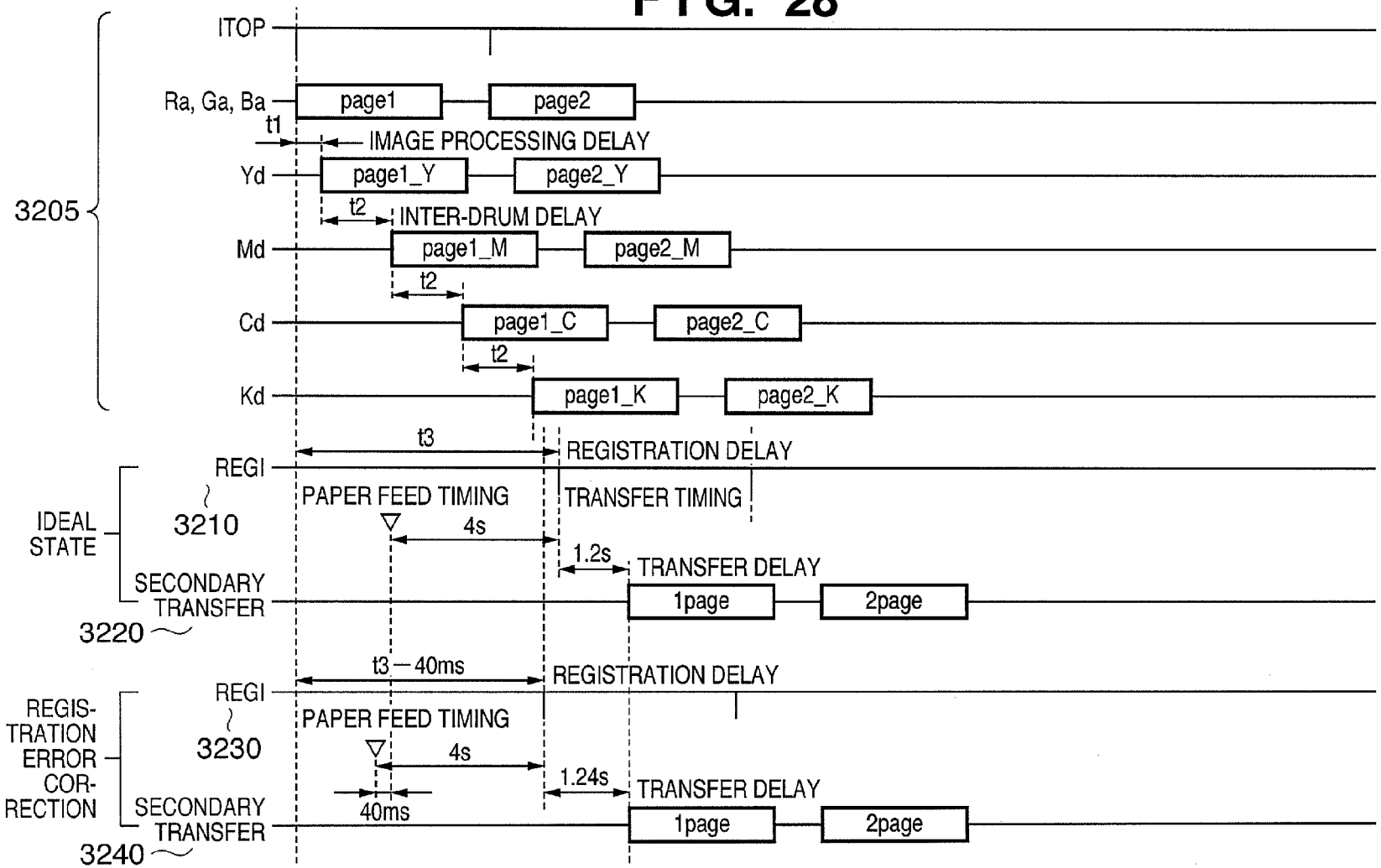
FIG. 28 is a timing chart for correcting a registration error (paper conveyance correction)

FIG. 28 is a timing chart for correcting a registration error (paper conveyance correction). This timing chart is obtained by adding REGI signal/secondary transfer timings 3210 to 3240 to an image formation timing chart 3250 (corresponding to ITOP to Ed in the timing chart in FIG. 6) of a full-color image forming subsystem 150A.

Note that the timing chart for explaining paper conveyance correction will be described by exemplifying a combination of the paper conveyance platform 60 and full-color image forming subsystem 150A. However, the gist of the present invention is not limited to this combination. That is, paper conveyance correction can also apply to a combination of the paper conveyance platform 60 and the image forming subsystem 150B or 150C.

The transfer timing is fixed on the basis of the image formation timing. In the ideal state free from any registration error, paper feed starts 4 (s) before the REGS signal at the time t3 after the ITOP signal, a transfer delay time of 1.2 (s) from the REGI signal is set, and transfer of the first page is executed.

For a registration error amount of 4 mm, an extra paper conveyance time of 40 ms is necessary in addition to the paper conveyance time in the ideal state.

The extra time of 40 ms from the registration roller to the transfer position due to the registration error is absorbed by adjusting the timing of the REGI signal. The REGI signal is a timing signal for starting driving the registration roller. To absorb the prolongation of the paper conveyance time caused by the registration error, the image forming controller 160 controls the timing to generate the REGI signal (t3−40 ms) after the ITOP signal.

To maintain the time (output time) until an image is formed on a transfer material and output, the platform controller 65 controls the paper feed timing so as to feed a recording material 40 ms earlier in synchronism with timing adjustment of the REGI signal. This process is performed for the REGI signal generated by the timing generator 315 of the image forming controller 160. The same control method also applies to a color image forming subsystem 150B and a monochrome image forming subsystem 150C.

According to the second embodiment, even when a registration error occurs between subsystems upon exchanging or detaching a subsystem, the registration error can be corrected to form an image and maintain the image formation quality.

Even when exchanging or detaching a subsystem, a delay of the output time of the first recording material or a delay of the output time of recording materials in a continuous operation can be corrected, preventing a decrease in the throughput of the image forming apparatus.

Third Embodiment

The third embodiment of the present invention will describe a registration error correction method using a selection unit. The basic arrangement of an image forming apparatus according to the third embodiment is the same as that described in the first embodiment except that an arrangement for calculating a registration error amount does not use the position detector 112.

Figure 31:
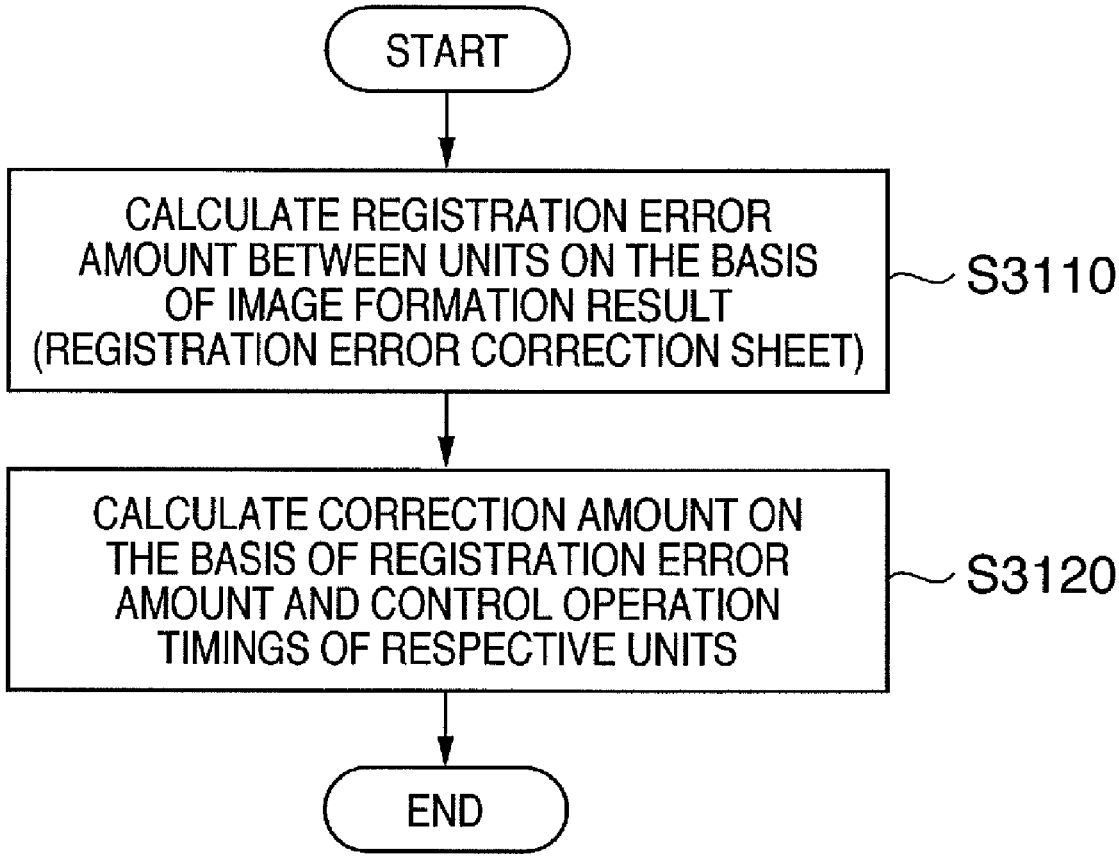
FIG. 31 is a flowchart for explaining the sequence of an image forming apparatus control method according to the third embodiment.

A flowchart shown in FIG. 31 is executed as an image forming apparatus control method according to the third embodiment.

A registration error amount between a positioned image forming unit (image forming subsystem 150) and a paper feed conveyance unit (paper conveyance platform 60) is calculated on the basis of the result of an image formed on a recording medium (print result on a registration error correction sheet 1025) (S3110).

The correction amount is calculated on the basis of the registration error amount calculated in the process of step S3110. The operation timings of the image forming unit and paper feed conveyance unit are controlled in accordance with the correction amount (S3120).

Concrete contents of the above control method will be explained.

Figure 29:
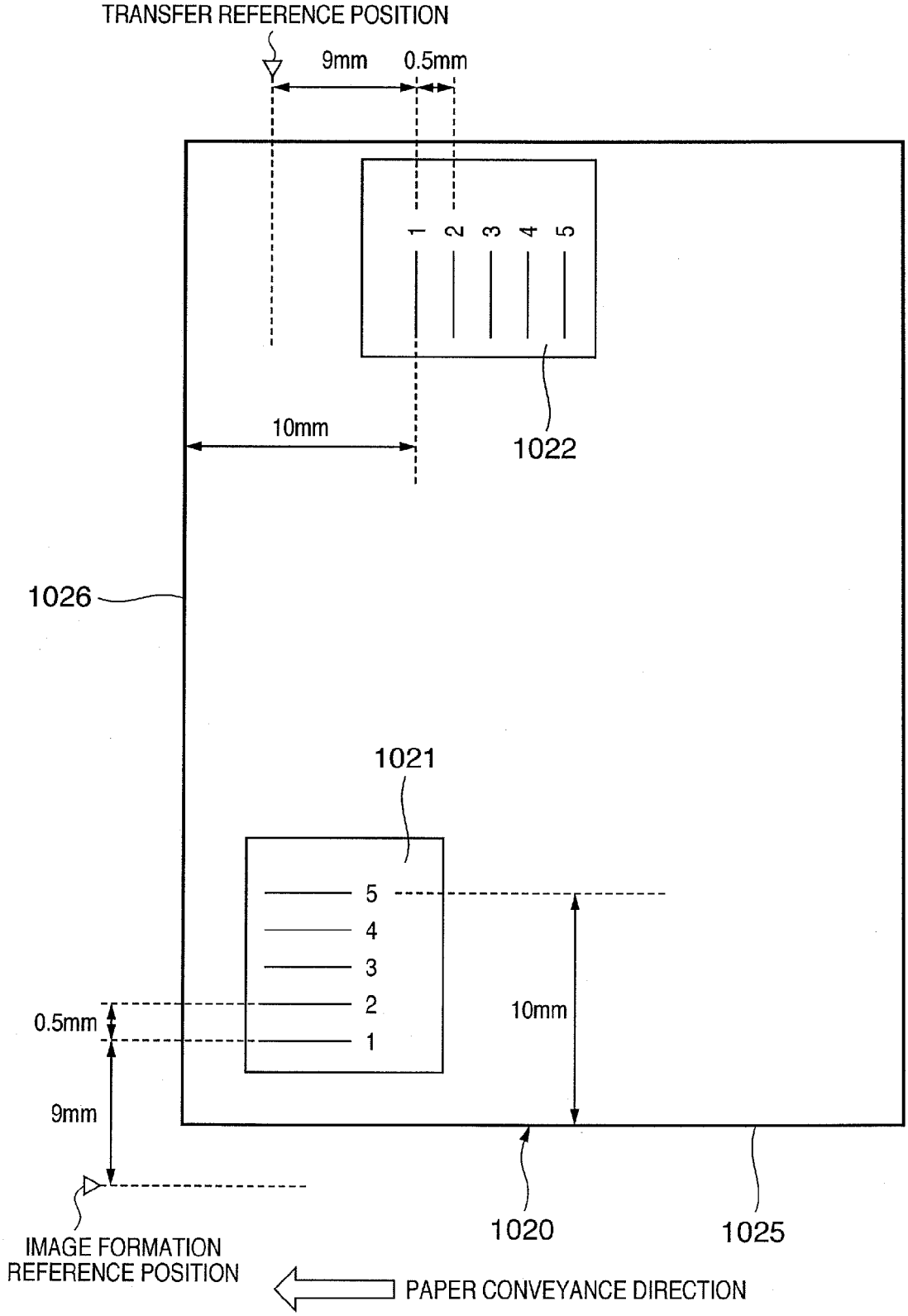
FIG. 29 is a view showing a registration error correction sheet for determining whether a registration error occurs upon exchanging a subsystem.

FIG. 29 is a view showing a registration error correction sheet 1020 for determining whether a registration error occurs upon exchanging a subsystem, and calculating a registration error amount. The registration error correction sheet 1020 has correction patterns 1021 and 1022 printed on a transfer material P.

The registration error correction sheet 1020 can be printed in accordance with a user's request, but may be printed out at a predetermined timing in synchronism with exchange of a subsystem.

The correction pattern 1021 is a main scanning correction pattern for correcting a registration error in the main scanning direction, while the correction pattern 1022 is a sub-scanning correction pattern for correcting a registration error in the sub-scanning direction.

The main scanning correction pattern 1021 has a plurality of lines laid out in a direction almost perpendicular to the paper conveyance direction. Five lines are drawn in steps of 0.5 mm from a position of 9 mm measured from the image formation reference position. The respective lines are numbered.

The sub-scanning correction pattern 1022 has a plurality of lines laid out almost parallel to the paper conveyance direction. Five lines are drawn in steps of 0.5 mm from a position of 9 mm measured from the transfer reference position. The respective lines are numbered, similar to the main scanning correction pattern.

The user reads the numbers of correction pattern lines corresponding to predetermined positions from a lower end 1025 and left end 1026 in order to determine whether registration errors occur in the main scanning and sub-scanning directions. For example, when the predetermined position is 10 mm, the user reads lines (the fifth line in the main scanning direction and the first line in the sub-scanning direction) at positions of 10 mm from the lower and left ends of the registration error correction sheet 1020, and inputs the read results from an operation unit 210.

A printer engine controller 105 receives the line numbers in the respective directions input by the user from the operation unit 210. The printer engine controller 105 calculates registration error amounts, and notifies a platform controller 65 and image forming controller 160 of them.

Although the original position of the line at 10 mm in the main scanning direction is, e.g., line number 3, the printer engine controller 105 receives line number 5, and thus calculates a registration error: $0.5\times(5-3)=1$ mm as a registration error amount in the main scanning direction.

The printer engine controller 105 notifies the image forming controller 160 of the registration error "1 mm" in the main scanning direction. The image forming controller 160 performs correction control for the timing generator to add 1 mm to the generation delay amount of the PBD signal serving as a sync signal in the main scanning direction.

This correction control shifts the main scanning image formation timing by 1 mm upward in FIG. 29, completing registration error correction in the main scanning direction.

Although the original position of the line at 10 mm in the sub-scanning direction is, e.g., line number 3, the printer engine controller 105 receives line number 1, and thus calculates a registration error: $0.5\times(1-3)=-1$ mm as a registration error amount in the sub-scanning direction. This means that the distance from paper feed to the transfer position is shorter by 1 mm than the ideal value, in other words, that the transfer material P reaches the transfer position earlier by 1 mm.

The registration error in the sub-scanning direction can be corrected by either the method of correcting the paper feed timing or paper feed interval or the method of correcting the REGI signal generation timing, which has been described in the first and second embodiments.

In accordance with the arrangement of an assembled subsystem, the printer engine controller 105 can determine whether to correct the paper feed timing or paper feed interval or whether to correct the REGI signal generation timing. By the correction method selected by determination of the printer engine controller 105, the registration error "−1 mm" is corrected, completing registration error correction in the sub-scanning direction.

The third embodiment makes it possible to quantify registration error amounts in the main scanning and sub-scanning directions by read and operation input by a user using the registration error correction sheet.

Since registration error amounts in the main scanning and sub-scanning directions can be quantified, the third embodiment can maintain the quality in a combination of a subsystem and platform at a lower cost without using any detection unit for measuring a registration error amount.

Other Embodiment

The objects of the present invention are also achieved by supplying a storage medium which records program codes of software that implements the functions of the above-described embodiments to the system or apparatus. The objects of the present invention are also achieved by reading out and executing the program codes stored in the storage medium by the computer (CPU or MPU) of the system or apparatus.

In this case, the program code reads out from the storage medium implement the functions of the above-described embodiments, and the storage medium which stores the program codes constitutes the present invention.

The storage medium for supplying the program codes includes a flexible disk, hard disk, optical disk, magneto-optical disk, CD-ROM, CD-R, nonvolatile memory card, and ROM.

The functions of the above-described embodiments are implemented by executing the readout program codes by the computer. Also, the present invention includes a case where an OS (Operating System) or the like running on the computer performs some or all of actual processes on the basis of the instructions of the program codes and thereby implements the functions of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-284413, filed on Sep. 29, 2005, which is hereby incorporated by reference herein in its entirety.

What is claimed is:

1. An image forming apparatus having a plurality of detachable units, the image forming apparatus permitting mounting image forming units which form an image on a recording medium and are different in performance, and recording medium conveyance units which convey the recording medium and are different in specification, the image forming apparatus comprising:

a detection unit which detects a positional relationship between the mounted image forming unit and the mounted recording medium conveyance unit; and a control unit which controls an operation of the image forming apparatus, wherein said control unit controls operation timings of the image forming unit and the recording medium conveyance unit on the basis of the positional relationship detected by said detection unit.

2. The apparatus according to claim 1, wherein said control unit controls the operation timings to correct a position of an image to be formed on the recording medium.

3. The apparatus according to claim 1, wherein said control unit controls a timing when the image forming unit forms an image, and thereby corrects an image position in a direction perpendicular to a direction in which the recording medium is conveyed.

4. The apparatus according to claim 1, wherein said control unit controls a timing when the recording medium conveyance unit conveys the recording medium, and thereby corrects an image position in a direction in which the recording medium is conveyed.

5. An image forming apparatus which detachably mounts and supports an exchangeable image forming subsystem having an image carrier, an exposure unit, a charging unit, and a developing unit, and an exchangeable recording medium conveyance subsystem which conveys a recording medium in the image forming apparatus, comprising:

a detection unit which detects a positional relationship between the mounted image forming subsystem and the mounted recording medium conveyance subsystem; and a control unit which controls an operation of the image forming apparatus, wherein the image forming apparatus permits mounting image forming subsystems different in performance and recording medium conveyance subsystems different in specification, and said control unit controls operation timings of the image forming subsystem and the recording medium conveyance subsystem on the basis of the positional relationship detected by said detection unit.

6. The apparatus according to claim 5, wherein said control unit controls the operation timings to correct a position of an image to be formed on the recording medium.

7. The apparatus according to claim 5, wherein said control unit controls a timing when the image forming subsystem forms an image, and thereby corrects an image position in a direction perpendicular to a direction in which the recording medium is conveyed.

8. The apparatus according to claim 5, wherein said control unit controls a timing when the recording medium conveyance subsystem conveys the recording medium, and thereby corrects an image position in a direction in which the recording medium is conveyed.

9. An image forming apparatus which includes, as a plurality of detachable units, at least an image forming unit which forms an image on a recording medium and a recording medium conveyance unit which conveys the recording medium, and executes image formation corresponding to a combination of the units, comprising:

a position detection unit which detects a registration error amount between the recording medium conveyance unit and the image forming unit positioned by a positioning unit, on the basis of reading of a reference pattern arranged on one of the recording medium conveyance unit and the image forming unit; and a control unit which calculates a correction amount on the basis of the registration error amount detected by said position detection unit and controls operation timings of the image forming unit and the recording medium conveyance unit in accordance with the correction amount.

10. The apparatus according to claim 9, wherein said control unit calculates, on the basis of the registration error amount detected by said position detection unit, a correction amount in a direction in which an image is formed on the recording medium and a correction amount in a direction in which the recording medium is conveyed.

11. The apparatus according to claim 9, wherein said control unit controls a timing when the image forming unit forms an image, on the basis of a correction amount in a direction in which an image is formed on the recording medium.

12. The apparatus according to claim 9, wherein said control unit controls timings when the recording medium conveyance unit feeds and conveys the recording medium, on the basis of a correction amount in a direction in which the recording medium is conveyed.

13. An image forming apparatus which includes, as a plurality of detachable units having different functions, at least an image forming unit which forms an image on a recording medium and a recording medium conveyance unit which conveys the recording medium, and executes image formation corresponding to a combination of the units, comprising:

a calculation unit which calculates a registration error amount between the recording medium conveyance unit and the image forming unit positioned by a positioning unit, on the basis of a result of image formation on the recording medium; and a control unit which calculates a correction amount on the basis of the registration error amount calculated by said calculation unit and controls operation timings of the image forming unit and the recording medium conveyance unit in accordance with the correction amount.

14. The apparatus according to claim 13, wherein a pattern for correcting a registration error in a direction in which an image is formed on the recording medium and a pattern for correcting a registration error in a direction in which the recording medium is conveyed are formed as the result of image formation, and said calculation unit calculates registration error amounts in the respective directions in accordance with the corresponding patterns.

15. The apparatus according to claim 13, wherein said control unit calculates, on the basis of the registration error amount calculated by said calculation unit, a correction amount in a direction in which an image is formed on the recording medium and a correction amount in a direction in which the recording medium is conveyed.

16. The apparatus according to claim 13, wherein said control unit controls a timing when the image forming unit forms an image, on the basis of a correction amount in a direction in which an image is formed on the recording medium.

17. The apparatus according to claim 13, wherein said control unit controls timings when the recording medium conveyance unit feeds and conveys the recording medium, on the basis of a correction amount in a direction in which the recording medium is conveyed.

18. A method of controlling an image forming apparatus which includes, as a plurality of detachable units having different functions, at least an image forming unit which forms an image on a recording medium and a recording medium conveyance unit which conveys the recording medium, and executes image formation corresponding to a combination of the units, comprising the steps of:

detecting a registration error amount between the recording medium conveyance unit and the image forming unit positioned by a positioning unit, on the basis of reading of a reference pattern arranged on one of the recording medium conveyance unit and the image forming unit; and calculating a correction amount on the basis of the registration error amount detected in the step of a detecting registration error amount, and controlling operation timings of the image forming unit and the recording medium conveyance unit in accordance with the correction amount.

19. A method of controlling an image forming apparatus which includes, as a plurality of detachable units having different functions, at least an image forming unit which forms an image on a recording medium and a recording medium feed conveyance unit which conveys the recording medium, and executes image formation corresponding to a combination of the units, comprising the steps of:

calculating a registration error amount between the recording medium feed conveyance unit and the image forming unit positioned by a positioning unit, on the basis of a result of image formation on the recording medium; and calculating a correction amount on the basis of the registration error amount calculated in the step of calculating a registration error amount, and controlling operation timings of the image forming unit and the recording medium feed conveyance unit in accordance with the correction amount.

* * * * *